US008739904B2

(12) United States Patent
Patel

(10) Patent No.: US 8,739,904 B2
(45) Date of Patent: Jun. 3, 2014

(54) SUPERABRASIVE CUTTERS WITH GROOVES ON THE CUTTING FACE, AND DRILL BITS AND DRILLING TOOLS SO EQUIPPED

(75) Inventor: Suresh G. Patel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 36 days.

(21) Appl. No.: 12/537,750

(22) Filed: Aug. 7, 2009

(65) Prior Publication Data

US 2011/0031036 A1 Feb. 10, 2011

(51) Int. Cl.
*E21B 10/567* (2006.01)
*E21B 10/43* (2006.01)

(52) U.S. Cl.
USPC ..... 175/428; 175/431; 76/108.2

(58) Field of Classification Search
CPC ..... E21B 10/003; E21B 10/26; E21B 10/62; E21B 10/627; E21B 10/42; E21B 10/58; E21B 10/56; E21B 10/567; E21B 10/5673; E21B 10/43; E21B 10/5735; E21B 10/46; B23B 51/02; B23P 15/28
USPC ..... 175/401, 412, 426, 428, 430, 431, 432, 175/434, 420, 420.1, 1; 76/108.2, 108.4, 76/108, 4
See application file for complete search history.

(56) References Cited

U.S. PATENT DOCUMENTS

| | | | | |
|---|---|---|---|---|
| 734,515 | A * | 7/1903 | Collins | 175/413 |
| 1,650,492 | A * | 11/1927 | Coaton | 175/420 |
| 2,641,446 | A * | 6/1953 | Haglund et al. | 175/400 |
| 2,707,897 | A * | 5/1955 | Beeson | 411/30 |
| 2,735,656 | A * | 2/1956 | Hoglund | 175/420.1 |
| 2,777,672 | A * | 1/1957 | Haglund et al. | 175/420.1 |
| 2,842,342 | A * | 7/1958 | Haglund | 175/420.1 |
| 2,888,247 | A * | 5/1959 | Haglund | 175/379 |
| 3,388,757 | A | 6/1968 | Fittinger | |
| 3,745,623 | A | 7/1973 | Wentorf, Jr. et al. | |
| 4,200,159 | A | 4/1980 | Peschel et al. | |
| 4,512,426 | A | 4/1985 | Bidegaray | |
| 4,545,441 | A | 10/1985 | Williamson | |
| 4,552,232 | A | 11/1985 | Frear | |
| 4,593,777 | A | 6/1986 | Barr | |
| 4,640,375 | A | 2/1987 | Barr et al. | |

(Continued)

FOREIGN PATENT DOCUMENTS

| | | |
|---|---|---|
| EP | 0117506 A2 | 9/1984 |
| EP | 0117552 A2 | 9/1984 |

(Continued)

OTHER PUBLICATIONS

Center. (n.d.) The American Heritage® Dictionary of the English Language, Fourth Edition. (2003). Retrieved Nov. 9, 2012 from http://www.thefreedictionary.com/center.*

(Continued)

*Primary Examiner* — Shane Bomar
*Assistant Examiner* — Wei Wang
(74) *Attorney, Agent, or Firm* — TraskBritt

(57) ABSTRACT

Cutters for a drill bit wherein the cutters have at least one groove in a face of a superabrasive table of the cutters. The cutters may also include ribs adjacent to the at least one groove.

21 Claims, 29 Drawing Sheets

(56) References Cited

U.S. PATENT DOCUMENTS

| | | | | | |
|---|---|---|---|---|---|
| 4,686,080 | A | * | 8/1987 | Hara et al. | 419/8 |
| 4,762,492 | A | * | 8/1988 | Nagai | 433/174 |
| 4,858,707 | A | | 8/1989 | Jones et al. | |
| 4,872,520 | A | * | 10/1989 | Nelson | 175/430 |
| 4,984,642 | A | * | 1/1991 | Renard et al. | 175/430 |
| 5,007,493 | A | | 4/1991 | Coolidge et al. | |
| 5,054,246 | A | * | 10/1991 | Phaal et al. | 451/540 |
| 5,145,017 | A | | 9/1992 | Holster et al. | |
| 5,172,778 | A | | 12/1992 | Tibbitts et al. | |
| 5,279,375 | A | | 1/1994 | Tibbitts et al. | |
| 5,314,033 | A | | 5/1994 | Tibbitts | |
| 5,332,051 | A | | 7/1994 | Knowlton | |
| 5,333,699 | A | | 8/1994 | Thigpen et al. | |
| 5,351,772 | A | * | 10/1994 | Smith | 175/428 |
| 5,377,773 | A | | 1/1995 | Tibbitts | |
| 5,379,853 | A | | 1/1995 | Lockwood et al. | |
| 5,379,854 | A | * | 1/1995 | Dennis | 175/434 |
| 5,437,343 | A | | 8/1995 | Cooley et al. | |
| 5,447,208 | A | | 9/1995 | Lund et al. | |
| 5,449,048 | A | * | 9/1995 | Thigpen et al. | 175/430 |
| 5,460,233 | A | | 10/1995 | Meany et al. | |
| 5,486,137 | A | * | 1/1996 | Flood et al. | 451/540 |
| 5,558,170 | A | | 9/1996 | Thigpen et al. | |
| 5,655,612 | A | | 8/1997 | Grimes et al. | |
| 5,667,028 | A | | 9/1997 | Truax et al. | |
| 5,706,906 | A | | 1/1998 | Jurewicz et al. | |
| 5,778,994 | A | | 7/1998 | Spatz | |
| 5,848,657 | A | * | 12/1998 | Flood et al. | 175/426 |
| 5,881,830 | A | | 3/1999 | Cooley | |
| 5,944,129 | A | | 8/1999 | Jensen | |
| 5,957,228 | A | * | 9/1999 | Yorston et al. | 175/430 |
| 5,979,577 | A | | 11/1999 | Fielder | |
| 5,979,578 | A | | 11/1999 | Packer | |
| 5,996,713 | A | | 12/1999 | Pessier et al. | |
| 6,000,483 | A | | 12/1999 | Jurewicz et al. | |
| 6,011,232 | A | * | 1/2000 | Matthias | 219/69.17 |
| 6,045,440 | A | * | 4/2000 | Johnson et al. | 451/540 |
| 6,050,354 | A | | 4/2000 | Pessier et al. | |
| 6,053,263 | A | | 4/2000 | Meiners | |
| 6,065,554 | A | * | 5/2000 | Taylor et al. | 175/430 |
| 6,068,071 | A | | 5/2000 | Jurewicz | |
| 6,082,474 | A | * | 7/2000 | Matthias | 175/432 |
| 6,145,608 | A | | 11/2000 | Lund et al. | |
| 6,164,394 | A | | 12/2000 | Mensa-Wilmot et al. | |
| 6,167,975 | B1 | | 1/2001 | Estes | |
| 6,196,340 | B1 | | 3/2001 | Jensen et al. | |
| 6,202,770 | B1 | * | 3/2001 | Jurewicz et al. | 175/428 |
| 6,230,828 | B1 | | 5/2001 | Beuershausen et al. | |
| 6,241,034 | B1 | | 6/2001 | Steinke et al. | |
| 6,241,035 | B1 | | 6/2001 | Portwood | |
| 6,269,894 | B1 | * | 8/2001 | Griffin | 175/434 |
| 6,272,753 | B2 | | 8/2001 | Packer | |
| 6,315,067 | B1 | * | 11/2001 | Fielder | 175/432 |
| 6,315,652 | B1 | * | 11/2001 | Snyder et al. | 451/540 |
| 6,394,199 | B1 | | 5/2002 | Skyles et al. | |
| 6,443,248 | B2 | | 9/2002 | Yong et al. | |
| 6,447,560 | B2 | | 9/2002 | Jensen et al. | |
| 6,513,608 | B2 | | 2/2003 | Eyre et al. | |
| 6,527,069 | B1 | * | 3/2003 | Meiners et al. | 175/432 |
| 6,564,886 | B1 | | 5/2003 | Mensa-Wilmot et al. | |
| 6,601,662 | B2 | * | 8/2003 | Matthias et al. | 175/374 |
| 6,672,406 | B2 | | 1/2004 | Beuershausen | |
| 6,739,417 | B2 | * | 5/2004 | Smith et al. | 175/432 |
| 6,810,972 | B2 | | 11/2004 | Sved | |
| 6,810,973 | B2 | | 11/2004 | Sved | |
| 6,814,168 | B2 | | 11/2004 | Sved | |
| 6,827,159 | B2 | | 12/2004 | Sved | |
| 6,904,983 | B2 | * | 6/2005 | Thigpen et al. | 175/428 |
| 6,935,444 | B2 | | 8/2005 | Lund et al. | |
| 6,986,297 | B2 | | 1/2006 | Scott | |
| 7,316,279 | B2 | * | 1/2008 | Wiseman et al. | 175/57 |
| 7,517,589 | B2 | | 4/2009 | Eyre | |
| 7,608,333 | B2 | | 10/2009 | Eyre | |
| 7,740,673 | B2 | | 6/2010 | Eyre | |
| 7,754,333 | B2 | | 7/2010 | Eyre et al. | |
| 7,762,359 | B1 | * | 7/2010 | Miess | 175/432 |
| 7,942,218 | B2 | * | 5/2011 | Cooley et al. | 175/432 |
| 7,946,363 | B2 | * | 5/2011 | Zhang et al. | 175/434 |
| 8,087,478 | B2 | | 1/2012 | Patel | |
| 8,191,656 | B2 | | 6/2012 | Dourfaye et al. | |
| 8,327,955 | B2 | | 12/2012 | Patel | |
| 2001/0003932 | A1 | * | 6/2001 | Packer | 76/108.2 |
| 2003/0116361 | A1 | * | 6/2003 | Smith et al. | 175/428 |
| 2004/0049193 | A1 | * | 3/2004 | Capanni | 606/69 |
| 2004/0149493 | A1 | * | 8/2004 | McDonough | 175/331 |
| 2004/0149495 | A1 | * | 8/2004 | Thigpen et al. | 175/426 |
| 2004/0163851 | A1 | * | 8/2004 | McDonough et al. | 175/374 |
| 2005/0137598 | A1 | * | 6/2005 | Auth | 606/73 |
| 2005/0247492 | A1 | | 11/2005 | Shen et al. | |
| 2005/0269139 | A1 | | 12/2005 | Shen et al. | |
| 2007/0181348 | A1 | * | 8/2007 | Lancaster et al. | 175/432 |
| 2008/0035387 | A1 | * | 2/2008 | Hall et al. | 175/426 |
| 2008/0156544 | A1 | * | 7/2008 | Singh et al. | 175/341 |
| 2008/0156545 | A1 | | 7/2008 | Tibbitts | |
| 2008/0236900 | A1 | * | 10/2008 | Cooley et al. | 175/432 |
| 2008/0264696 | A1 | | 10/2008 | Dourfaye et al. | |
| 2010/0243334 | A1 | | 9/2010 | Dourfaye et al. | |
| 2010/0307829 | A1 | * | 12/2010 | Patel | 175/57 |
| 2010/0314176 | A1 | | 12/2010 | Zhang et al. | |
| 2010/0326741 | A1 | | 12/2010 | Patel | |
| 2013/0092455 | A1 | | 4/2013 | Patel | |

FOREIGN PATENT DOCUMENTS

| | | | |
|---|---|---|---|
| EP | 0189212 | A1 | 7/1986 |
| EP | 0236924 | A2 | 9/1987 |
| EP | 0542237 | A1 | 5/1993 |
| EP | 0852283 | A2 | 7/1998 |
| EP | 0918135 | A1 | 5/1999 |
| GB | 2344607 | A | 11/1999 |
| GB | 2373522 | A | 9/2002 |
| GB | 2378202 | A | 2/2003 |
| GB | 2378721 | A | 2/2003 |
| WO | 9708420 | A1 | 3/1997 |
| WO | 9735091 | A1 | 9/1997 |

OTHER PUBLICATIONS

International Search Report for International Application No. PCT/US2010/044315 mailed Mar. 23, 2011, 3 pages.

International Written Opinion for International Application No. PCT/US2010/044315 mailed Mar. 23, 2011, 4 pages.

International Preliminary Report on Patentability for International Application No. PCT/US2010/044315 dated Feb. 7, 2012, 6 pages.

* cited by examiner

SUPERABRASIVE CUTTERS WITH GROOVES ON THE CUTTING FACE, AND DRILL BITS AND DRILLING TOOLS SO EQUIPPED

This application is related to U.S. patent application Ser. No. 12/493,640, filed Jun. 29, 2009, now U.S. Pat. No. 8,327,955, issued Dec. 11, 2012, titled NON-PARALLEL FACE POLYCRYSTALLINE DIAMOND CUTTER AND DRILLING TOOLS SO EQUIPPED.

TECHNICAL FIELD

This invention relates to devices used in drilling and boring through subterranean formations. More particularly, this invention relates to polycrystalline diamond or other superabrasive cutters intended to be installed on a drill bit or other tool used for earth or rock boring, such as may occur in the drilling or enlarging of an oil, gas, geothermal or other subterranean borehole, and to bits and tools so equipped.

BACKGROUND

There are three types of bits which are generally used to drill through subterranean formations. These bit types are: (a) percussion bits (also called impact bits); (b) rolling cone bits, including tri-cone bits; and (c) drag bits or fixed-cutter rotary bits (including core bits so configured), the majority of which currently employ diamond or other superabrasive cutters, polycrystalline diamond compact (PDC) cutters being most prevalent.

In addition, there are other structures employed downhole, generically termed "tools" herein, which are employed to cut or enlarge a borehole or which may employ superabrasive cutters, inserts or plugs on the surface thereof as cutters or wear-prevention elements. Such tools might include, merely by way of example, reamers, stabilizers, tool joints, wear knots and steering tools. There are also formation cutting tools employed in subterranean mining, such as drills and boring tools.

Percussion bits are used with boring apparatus known in the art that move through a geologic formation by a series of successive impacts against the formation, causing a breaking and loosening of the material of the formation. It is expected that the cutter of the invention will have use in the field of percussion bits.

Bits referred to in the art as rock bits, tri-cone bits or rolling cone bits (hereinafter "rolling cone bits") are used to bore through a variety of geologic formations, and demonstrate high efficiency in firmer rock types. Prior art rolling cone bits tend to be somewhat less expensive than PDC drag bits, with limited performance in comparison. However, they have good durability in many hard-to-drill formations. An exemplary prior art rolling cone bit is shown in FIG. 2. A typical rolling cone bit operates by the use of three rotatable cones oriented substantially transversely to the bit axis in a triangular arrangement, with the narrow cone ends facing a point in the center of the triangle which they form. The cones have cutters formed or placed on their surfaces. Rolling of the cones in use due to rotation of the bit about its axis causes the cutters to imbed into hard rock formations and remove formation material by a crushing action. Prior art rolling cone bits may achieve a rate-of-penetration (ROP) through a hard rock formation ranging from less than one foot per hour up to about thirty feet per hour. It is expected that the cutter of the invention will have use in the field of rolling cone bits as a cone insert for a rolling cone, as a gage cutter or trimmer, and on wear pads on the gage.

A third type of bit used in the prior art is a drag bit or fixed-cutter bit. An exemplary drag bit is shown in FIG. 1. The drag bit of FIG. 1 is designed to be turned in a clockwise direction (looking downward at a bit being used in a hole, or counterclockwise if looking at the drag bit from its cutting end as shown in FIG. 1) about its longitudinal axis. The majority of current drag bit designs employ diamond cutters comprising polycrystalline diamond compacts (PDCs) mounted to a substrate, typically of cemented tungsten carbide (WC). State-of-the-art drag bits may achieve an ROP ranging from about one foot per hour to in excess of one thousand feet per hour. A disadvantage of state-of-the-art PDC drag bits is that they may prematurely wear due to impact failure of the PDC cutters, as such cutters may be damaged very quickly if used in highly stressed or tougher formations composed of limestones, dolomites, anhydrites, cemented sandstones interbedded formations such as shale with sequences of sandstone, limestone and dolomites, or formations containing hard "stringers." It is expected that the cutter of the invention will have use in the field of drag bits as a cutter, as a gage cutter or trimmer, and on wear pads on the gage.

As noted above, there are additional categories of structures or "tools" employed in boreholes, which tools employ superabrasive elements for cutting or wear prevention purposes, including reamers, stabilizers, tool joints, wear knots and steering tools. It is expected that the cutter of the present invention will have use in the field of such downhole tools for such purposes, as well as in drilling and boring tools employed in subterranean mining.

It has been known in the art for many years that PDC cutters perform well on drag bits. A PDC cutter typically has a diamond layer or table formed under high temperature and pressure conditions to a cemented carbide substrate (such as cemented tungsten carbide) containing a metal binder or catalyst such as cobalt. The substrate may be brazed or otherwise joined to an attachment member such as a stud or to a cylindrical backing element to enhance its affixation to the bit face. The cutting element may be mounted to a drill bit either by press-fitting or otherwise locking the stud into a receptacle on a steel-body drag bit, or by brazing the cutter substrate (with or without cylindrical backing) directly into a preformed pocket, socket or other receptacle on the face of a bit body, as on a matrix-type bit formed of WC particles cast in a solidified, usually copper-based, binder as known in the art.

A PDC is normally fabricated by placing a disk-shaped cemented carbide substrate into a container or cartridge with a layer of diamond crystals or grains loaded into the cartridge adjacent one face of the substrate. A number of such cartridges are typically loaded into an ultra-high pressure press. The substrates and adjacent diamond crystal layers are then compressed under ultra-high temperature and pressure conditions. The ultra-high pressure and temperature conditions cause the metal binder from the substrate body to become liquid and sweep from the region behind the substrate face next to the diamond layer through the diamond grains and act as a reactive liquid phase to promote a sintering of the diamond grains to form the polycrystalline diamond structure. As a result, the diamond grains become mutually bonded to form a diamond table over the substrate face, which diamond table is also bonded to the substrate face. The metal binder may remain in the diamond layer within the pores existing between the diamond grains or may be removed and optionally replaced by another material, as known in the art, to form a so-called thermally stable diamond ("TSD"). The binder is removed by leaching or the diamond table is formed with silicon, a material having a coefficient of thermal expansion (CTE) similar to that of diamond. Variations of this general process exist in the art, but this detail is provided so that the reader will understand the concept of sintering a diamond layer onto a substrate in order to form a PDC cutter. For more background information concerning processes used to form polycrystalline diamond cutters, the reader is directed to U.S. Pat. No. 3,745,623, issued on Jul. 17, 1973, in the name of Wentorf, Jr. et al.

The cutting action in drag bits is primarily performed by the outer semi-circular portion of the cutters. As the drill bit is rotated and downwardly advanced by the drill string, the cutting edges of the cutters will cut a helical groove of a generally semicircular cross-sectional configuration into the formation.

Vibration of the drill bit is a significant problem both to overall performance of the drill bit and drill bit wear life, particularly in drag-type drill bits. The vibration problem of a drill bit becomes more significant when the well bore is drilled at a substantial angle to the vertical, such as in horizontal and directional well drilling. In such drilling the drill bit and the adjacent drill string to the drill bit are acted on by the downward force of gravity and the varying weight on the drill bit. Such conditions produce unbalanced loading of the cutters of the drill bit resulting in radial vibration, typically described as "bit whirl."

One cause of drill bit vibration is imbalanced cutting forces on the drill bit. Circumferential drilling imbalance forces are always present on drill bits. Such forces tend to push the drill bit towards the side of the well bore. Where the drill bit is provided with a typical cutting structure, gauge cutters on the drill bit are used to cut the edge of the well bore. In this instance, the effective friction between the cutters of the drill bit near the gauge area increases causing the instantaneous center of rotation of the drill bit to translate to a point other than the geometric center of the drill bit resulting in the drill bit to whirl in a reverse or backward rotation motion in the well bore. Whirling of the drill bit continues because the drill bit generates insufficient friction with the well bore by the gauge of the drill bit and the wall of the well bore independent of drill bit orientation in the well bore. The continual change of the center of rotation of the drill bit during whirling causes the cutters of the drill bit to travel faster in a sideways direction and in a backward direction in the well bore, causing increased impact loads on the drill bit.

Gravity also causes vibration of the drill bit when drilling a directional well bore at an angle with respect to the vertical by the radial forces on the drill bit inducing a vertical deflection resulting in drill bit whirl.

Drill bit steering tools further cause drill bit vibration from the steering tool having a bent housing or steering tools connected to the drill bit simulating a bent housing. Vibration of the drill bit results when the bent housing or steering tools simulation of a bent housing are rotated in the well bore causing an off-center rotation of the drill bit and drill bit whirl. Drill bit tilt also creates bit whirl when the drill string is not oriented in the center of the well bore. When this occurs, the end of the drill string and the drill bit are slightly tilted in the well bore.

Surface formation stratification also causes drill bit whirl. When drilling, as the drill bit passes through a comparatively soft formation striking a much harder formation with hard stringers in the formation, the drill bit will whirl because not all the cutters on the drill bit strike the much harder formation or hard stringers at the same time. The uneven striking of the much harder formation or hard stringers by the cutters on the drill bit causes impact forces to be incurred on some of the cutters while locally loading the drill bit, resulting in vibration and drill bit whirl.

All vibration of the drill bit and resulting drill bit whirl shortens drill bit life.

Potential solutions to drill bit vibration and drill bit whirl use various geometries of the cutters of the drill bit to improve their resistance to chipping, while other solutions have been directed at the use of gauge pads and protrusions placed behind the cutters of the drill bit. Other potential solutions to drill bit vibration and drill bit whirl involve the use of shaped cutters on the drill bit with the thinking that the shaped cutter will serve as a stabilizing element on the drill bit. However effective a shaped cutter may be as a stabilizing element on the drill bit, as the shaped cutter wears, any stabilizing force it may create on the drill bit in the well bore decreases.

Improved drill bit stability provided by a cutting element on the drill bit that exhibits minimal change of shape during the drilling of the well bore is desired over the prior art solutions to drill bit vibration and drill bit whirl.

BRIEF SUMMARY

Cutting elements or cutters for a drill bit or other drilling tool, wherein the cutters have at least one groove in the superabrasive table of the cutters.

Some cutting elements or cutters for a drill bit or other drilling tool include ribs accompanying the at least one groove in the superabrasive table of the cutters.

Drill bits and drilling tools including cutting elements or cutters according to embodiments of the present invention.

DETAILED DESCRIPTION

Figure 1:
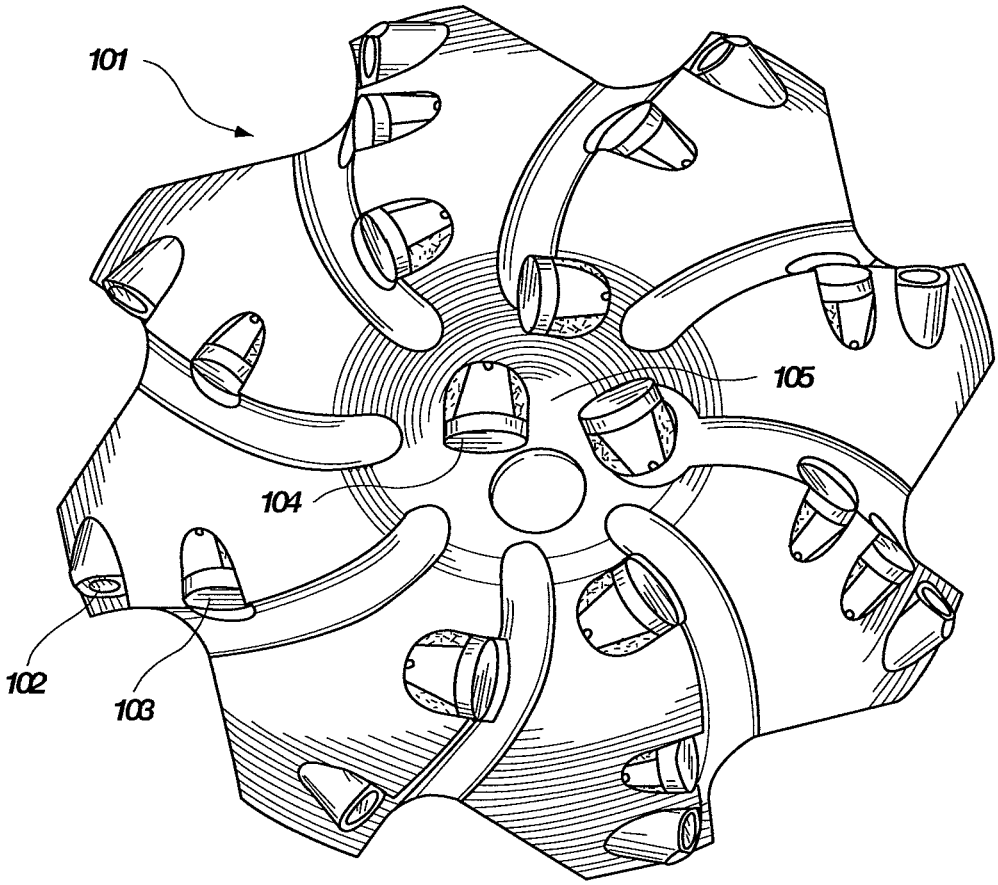
Fig. 1 (PRIOR ART)
FIG. 1 depicts a distal end or face view of a prior art drag bit.

Referring again to FIG. 1, a prior art drag bit is illustrated in distal end or face view. The drag bit 101 includes a plurality of cutters 102, 103 and 104 which may be arranged as shown in rows emanating generally radially from approximately the center of the bit 105. It is contemplated that the cutters described herein will primarily be used on drag bits of any configuration.

Figure 2:
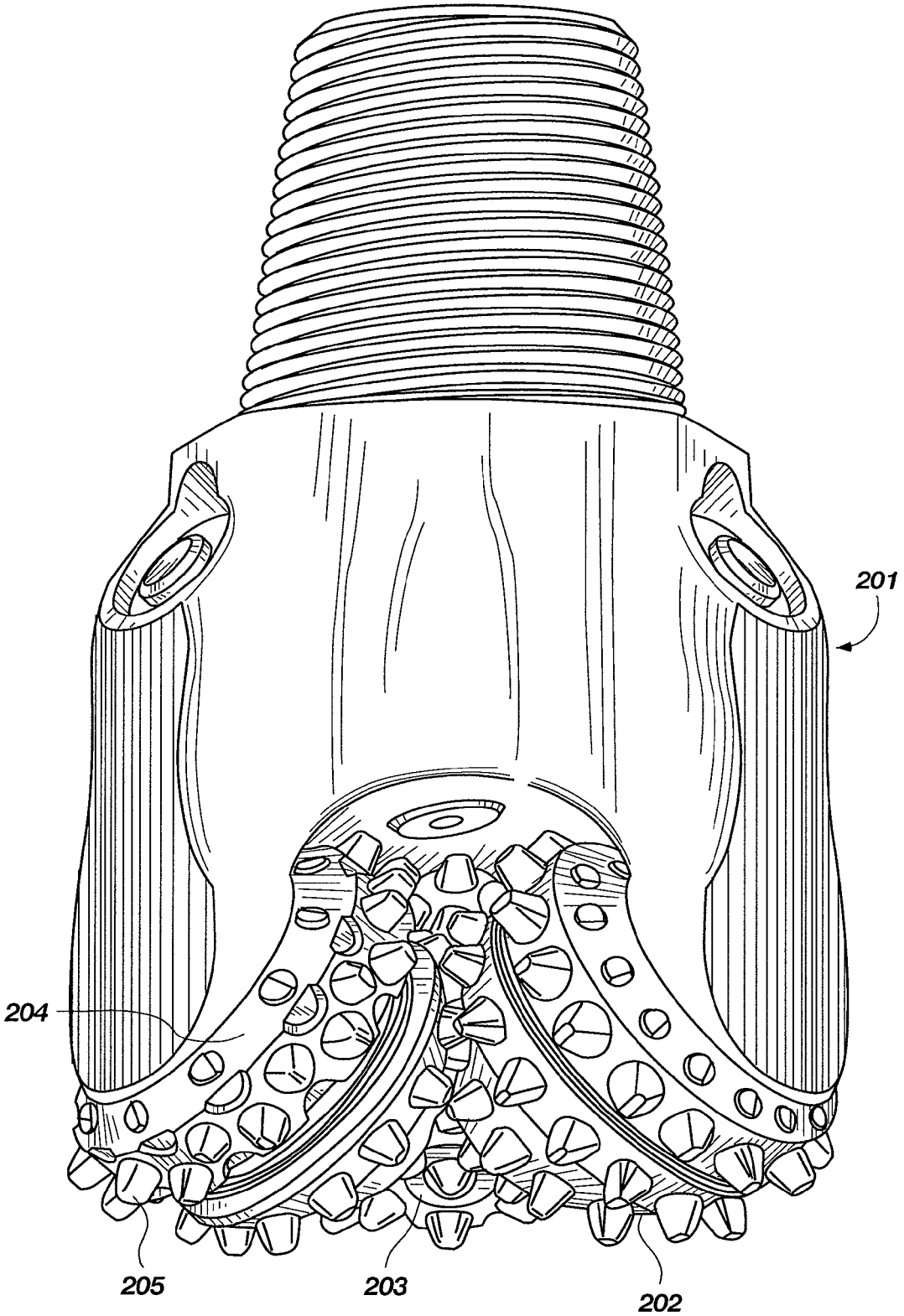
Fig. 2 (PRIOR ART)
FIG. 2 depicts a side view of a prior art roller cone bit.

In FIG. 2, a prior art roller cone bit is illustrated in side view. The roller cone bit 201 includes three rotatable cones 202, 203 and 204, each of which carries a plurality of cone inserts 205. It is contemplated that the cutters described herein will also be used on roller cone bits of various configurations in the capacity of cone inserts, gage cutters and on wear pads.

Figure 3:
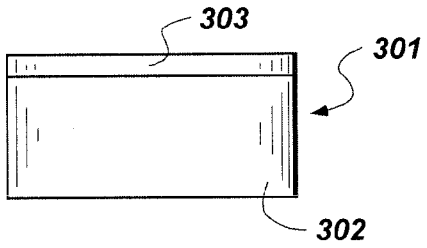
Fig. 3 (PRIOR ART)
FIG. 3 depicts a prior art diamond cutter.

FIG. 3 depicts a side view of a prior art polycrystalline diamond cutter typically used in drag bits. The cutter 301 is cylindrical in shape and has a substrate 302 which is typically made of cemented carbide such as tungsten carbide (WC) or other materials, depending on the application. The cutter 301 also has a sintered polycrystalline diamond table 303 formed onto substrate 302 by the manufacturing process mentioned above. Cutter 301 may be directly mounted to the face of a drag bit, or secured to a stud which is itself secured to the face of a bit.

Figure 4:
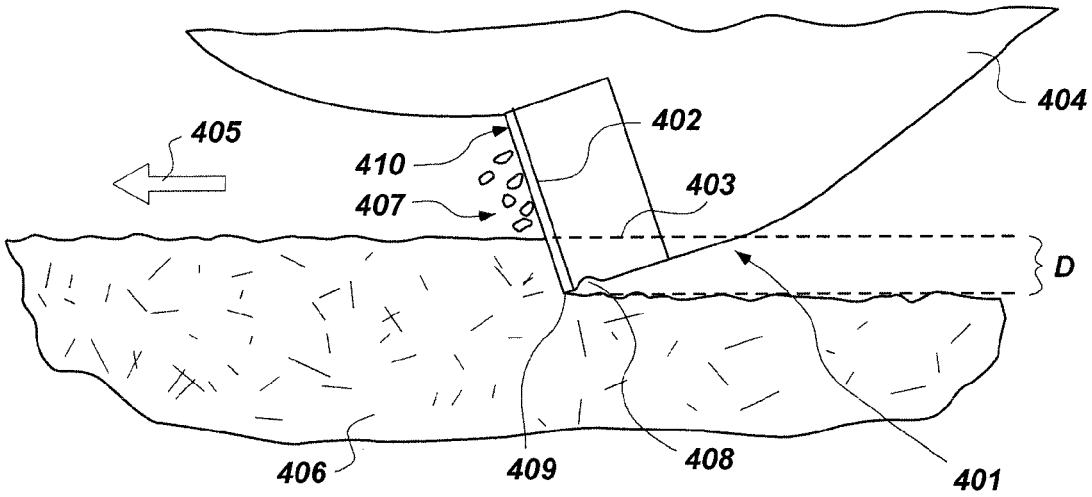
Fig. 4 (PRIOR ART)
FIG. 4 depicts a prior art diamond cutter in use.

FIG. 4 depicts a prior art diamond cutter 401, such as the type depicted in FIG. 3, in use on a bit. The cutter 401 has a disc-shaped PDC diamond layer or table 402, typically at 0.020 to 0.030 of an inch thickness (although as noted before, thicker tables have been attempted), sintered onto a tungsten carbide substrate 403. The cutter 401 is installed on a bit 404. As the bit 404 with cutter 401 move in the direction indicated by arrow 405, the cutter 401 engages rock 406, resulting in shearing of the rock 406 by the diamond layer or table 402 and sheared rock 407 sliding along the cutting face 410 and away from the cutter 401. The reader should note that in plastic subterranean formations, the sheared rock 407 may be very long strips, while in a non-plastic formation, the sheared rock 407 may comprise discrete particles, as shown. The cutting action of the cutter 401 results in a depth-of-cut D being made in the rock 406. It can also be seen from the figure that on the trailing side of the cutter 401 opposite the cut, both diamond layer or table 402 and stud or substrate 403 are present within the depth-of-cut D. This has several negative implications. It has been found that prior art cutters tend to experience abrasive and erosive wear on the substrate 403 within the depth-of-cut D behind the diamond layer or table 402 under certain cutting conditions. This wear is shown at reference numeral 408. Although it may sometimes be beneficial for this wear 408 to occur because of the self-sharpening effect that it provides for the diamond layer or table 402 (enhancing cutting efficiency and keeping weight-on-bit low), wear 408 causes support against bending stresses for the diamond layer or table 402 to be reduced, and the diamond layer or table 402 may prematurely spall, crack or break. This propensity for damage may be enhanced by the high unit stresses experienced at cutting edge 409 of cutting face 410.

Another problem is that the cutting face 410 of the diamond layer or table 402, which is very hard but also very brittle, is supported within the depth-of-cut D not only by other diamond within the diamond layer or table 402, but also by a portion of the stud or substrate 403. The substrate 403 is typically tungsten carbide and is of lower stiffness than the diamond layer or table 402. Consequently, when severe tangential forces are placed on the diamond layer or table 402 and the supporting substrate 403, the diamond layer or table 402, which is extremely weak in tension and takes very little strain to failure, tends to crack and break when the underlying substrate 403 flexes or otherwise "gives."

Moreover, when use of a "double thick" (0.060 of an inch depth) diamond layer was attempted in the prior art, it was found that the thickened diamond layer or table 402 was also very susceptible to cracking, spalling and breaking. This is believed to be at least in part due to the magnitude, distribution and type (tensile, compressive) residual stresses (or lack thereof) imparted to the diamond table during the manufacturing process, although poor sintering of the diamond table may play a role. The diamond layer and carbide substrate have different thermal expansion coefficients and bulk moduli, which create detrimental residual stresses in the diamond layer and along the diamond/substrate interface. The "thickened" diamond table prior art cutter had substantial residual tensile stresses residing in the substrate immediately behind the cutting edge. Moreover, the diamond layer at the cutting edge was poorly supported, actually largely unsupported by the substrate as shown in FIG. 4, and thus possessed decreased resistance to tangential forces.

For another discussion of the deficiencies of prior art cutters as depicted in FIG. 4, the reader is directed to U.S. Pat. No. 5,460,233.

In a cutter configuration as in the prior art (see FIG. 4), it was eventually found that the depth of the diamond layer should be in the range of 0.020 to 0.030 of an inch for ease of manufacture and a perceived resistance to chipping and spalling. It was generally believed in the prior art that use of a diamond layer greater than 0.035 of an inch may result in a cutter highly susceptible to breakage, and may have a shorter service life.

Reference is made to FIGS. 5*a* through 5*d* which depict an end view, a side view, an enlarged side view and a perspective view, respectively, of an embodiment of a prior art cutter. The cutter 501 is of a shallow frustoconical configuration and includes a circular diamond layer or table 502 (e.g., polycrystalline diamond), a superabrasive material, having a back surface plane 502' bonded (i.e., sintered) to a cylindrical substrate 503 (e.g., tungsten carbide). An interface between the diamond layer 502 and the substrate 503 is, as shown, comprised of mutually parallel ridges separated by valleys, with the ridges and valleys extending laterally across cutter 501 from side to side. Of course, many other interface geometries are known in the art and are suitable for use with the invention. The diamond layer 502 is of a thickness "$T_1$." The substrate 503 has a thickness "$T_2$" The diamond layer 502 includes rake land 508 with a rake land angle Φ relative to the sidewall 506 of the diamond layer 502 (parallel to a longitudinal axis or center line 507 of the cutter 501) and extending forwardly and radially inwardly toward the longitudinal axis 507. The rake land angle Φ in the preferred embodiment is defined as the included acute angle between the surface of rake land 508 and the sidewall 506 of the diamond layer 502 which, in the preferred embodiment, is parallel to longitudinal axis 507. It is preferred for the rake land angle Φ to be in the range of 10° to 80°, but it is most preferred for the rake land angle Φ to be in the range of 30° to 60°. However, it is believed to be possible to utilize rake land angles outside of this range and still produce an effective cutter which employs the structure of the invention.

The dimensions of the rake land 508 are significant to performance of the cutter 501. The inventors have found that the width $W_1$ of the rake land 508 should be at least about 0.050 of an inch, measured from the inner boundary of the rake land 508 (or the center of the cutting face 513, if the rake land 508 extends thereto) to the cutting edge 509 along or parallel to (e.g., at the same angle) to the actual surface of the rake land 508. The direction of measurement, if the cutting face 513 is circular, is generally radial but at the same angle as the rake land 508. It may also be desirable that the width of the rake land 508 (or height, looking head-on at a moving cutter mounted to a bit) be equal to or greater than the design of the DOC, although this is not a requirement of the invention.

Diamond layer 502 also includes a cutting face 513 having a flat central area 511 radially inward of the rake land 508, and a cutting edge 509. The flat central area 511 of the cutting face 513 being parallel to the back surface plane 502' of the diamond layer or table 502. Between the cutting edge 509 and the substrate 503 resides a portion or depth of the diamond layer 502 referred to as the base layer 510, while the portion or depth between the flat central area 511 of cutting face 513 and the base layer 510 is referred to as the rake land layer 512.

Figure 5A:
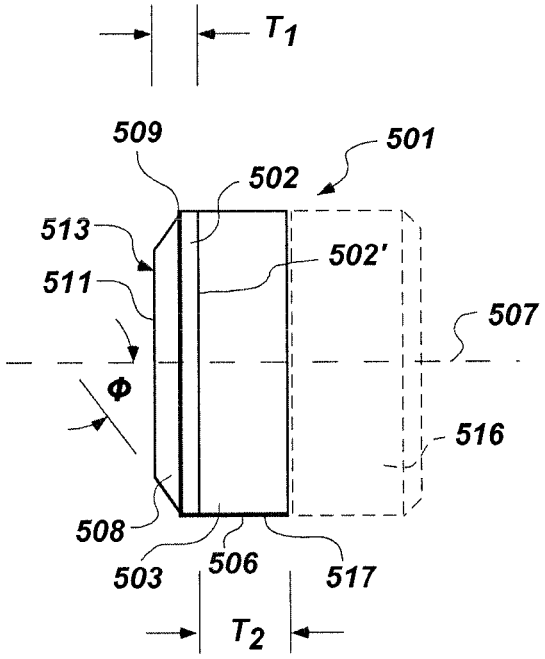
Fig. 5a (PRIOR ART)
FIGS. 5*a*-5*d* depict a prior art cutter.
Figure 5B:
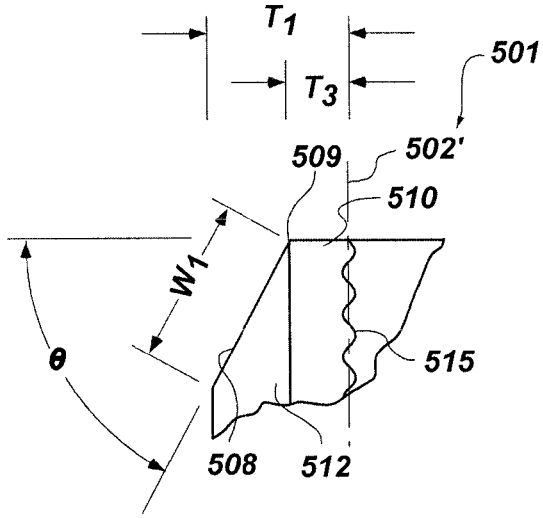
Fig. 5b (PRIOR ART)
Figure 5C:
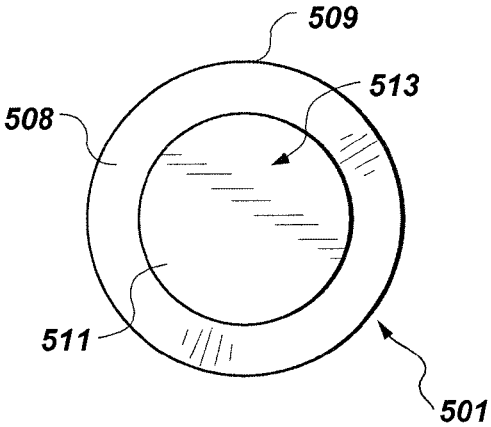
Fig. 5c (PRIOR ART)
Figure 5D:
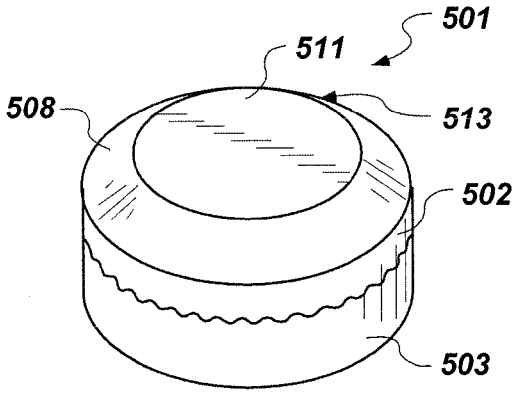
Fig. 5d (PRIOR ART)

The flat central area 511 of cutting face 513, as depicted in FIGS. 5*a*, 5*c* and 5*d*, is a flat surface oriented perpendicular to longitudinal axis 507, as shown by dashed lines in FIG. 5*a*. In alternative embodiments of the invention, it is possible to have a convex cutting face area, such as that described in U.S. Pat. No. 5,332,051 to Knowlton. It is also possible to configure such that the rake land 508 surface of revolution defines a conical point at the flat central area 511 of the cutting face 513. However, the preferred embodiment of the invention is that depicted in FIGS. 5*a*-5*d*.

In the depicted cutter 501, the thickness $T_1$ of the diamond layer or table 502 is preferably in the range of 0.070 to 0.150 of an inch, with a most preferred range of 0.080 to 0.100 of an inch. This thickness results in a cutter which, in the invented configuration, has substantially improved impact resistance, abrasion resistance and erosion resistance.

In the embodiment depicted, the base layer 510 thickness $T_3$ is approximately 0.050 of an inch as measured perpendicular to the cutting face 513 of the supporting substrate 503, parallel to longitudinal axis 507. The rake land layer 512 is approximately 0.030 to 0.050 of an inch thick and the rake angle θ of the rake land 508 as shown is 65° but may vary. Boundary 515 of the back surface plane 502' of the diamond layer 502 and substrate 503 to the rear of the cutting edge 509 should lay at least 0.015 of an inch longitudinally to the rear of the cutting edge 509 and, in the embodiment of FIGS. 5*a*-5*d*, this distance is substantially greater. The diameter of the cutter 501 depicted is approximately 0.750 of an inch, and the thickness of the substrate 503 $T_2$ is approximately 0.235 to 0.215 of an inch, although these two dimensions are not critical.

As shown in FIGS. 5*a*-5*d*, the sidewall 517 of the cutter 501 is parallel to the longitudinal axis 507 of the cutter 501. Thus, as shown, angle θ equals angle Φ, the angle between rake land 508 and axis 507. However, cutters need not be circular or even symmetrical in cross-section, and the sidewall 517 of the cutter 501 may not always be parallel to the longitudinal axis 507 of the cutter 501. Thus, the angle of rake land 508 may be set as angle θ or as angle Φ, depending upon cutter configuration and designer preference.

Another optional, but desirable, feature of the embodiment depicted in FIGS. 5*a*-5*d* is the use of a low-friction finish on the flat central area 511 of cutting face 513, including rake land 508. The preferred low-friction finish is a polished mirror finish which has been found to reduce friction between the diamond layer 502 and the formation material being cut and to enhance the integrity of the surface of cutting face 513, such as in U.S. Pat. No. 5,447,208 issued to Lund et al.

Yet another optional feature applicable to the embodiment of FIGS. 5*a*-5*d* to a cutter is the use of a small peripheral chamfer or radius at the cutting edge as taught by the prior art to increase the durability of the cutting edge while running into the borehole and at the inception of drilling, at least along the portion which initially contacts the formation. The inventors have, to date, however, not been able to demonstrate the necessity for such a feature in testing. Alternately, the cutting edge may also be optionally honed in lieu of radiusing or chamfering.

Another optional cutter feature usable in the invention feature depicted in broken lines in FIG. 5*a* is the use of a backing cylinder 516 face-bonded to the back of substrate 503. This design permits the construction of a cutter having a greater dimension (or length) along its longitudinal axis 507 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

Figure 5E:
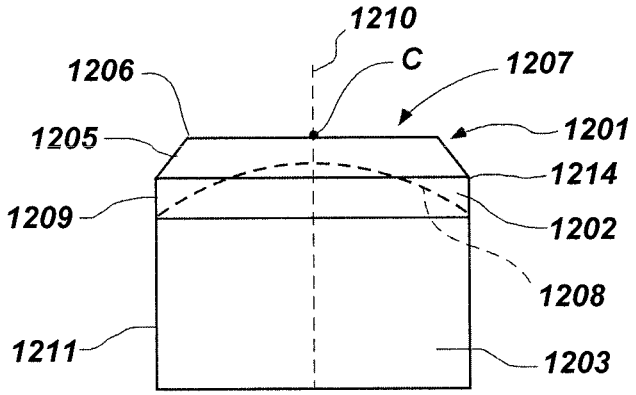
Fig. 5e (PRIOR ART)
FIG. 5*e* depicts a prior art cutter.

FIG. 5*e* depicts an embodiment of a prior art cutter 1201. The substrate 1203 is radiused or forms a dome 1208, as shown by dashed lines, beneath the diamond table 1202. The diamond table 1202 has a sidewall 1209 that is shown as being generally parallel to the substrate sidewall 1211 and to the longitudinal axis 1210, as shown by dashed lines, of the cutter 1201, but which could be angled otherwise. The diamond table 1202 also includes a cutting edge 1214, a rake land 1205 and a central cutting face area 1207. The central cutting face area 1207 is that portion of a proximal end of the diamond table 1202 within the inner boundary 1206 of the rake land 1205.

Figure 6:
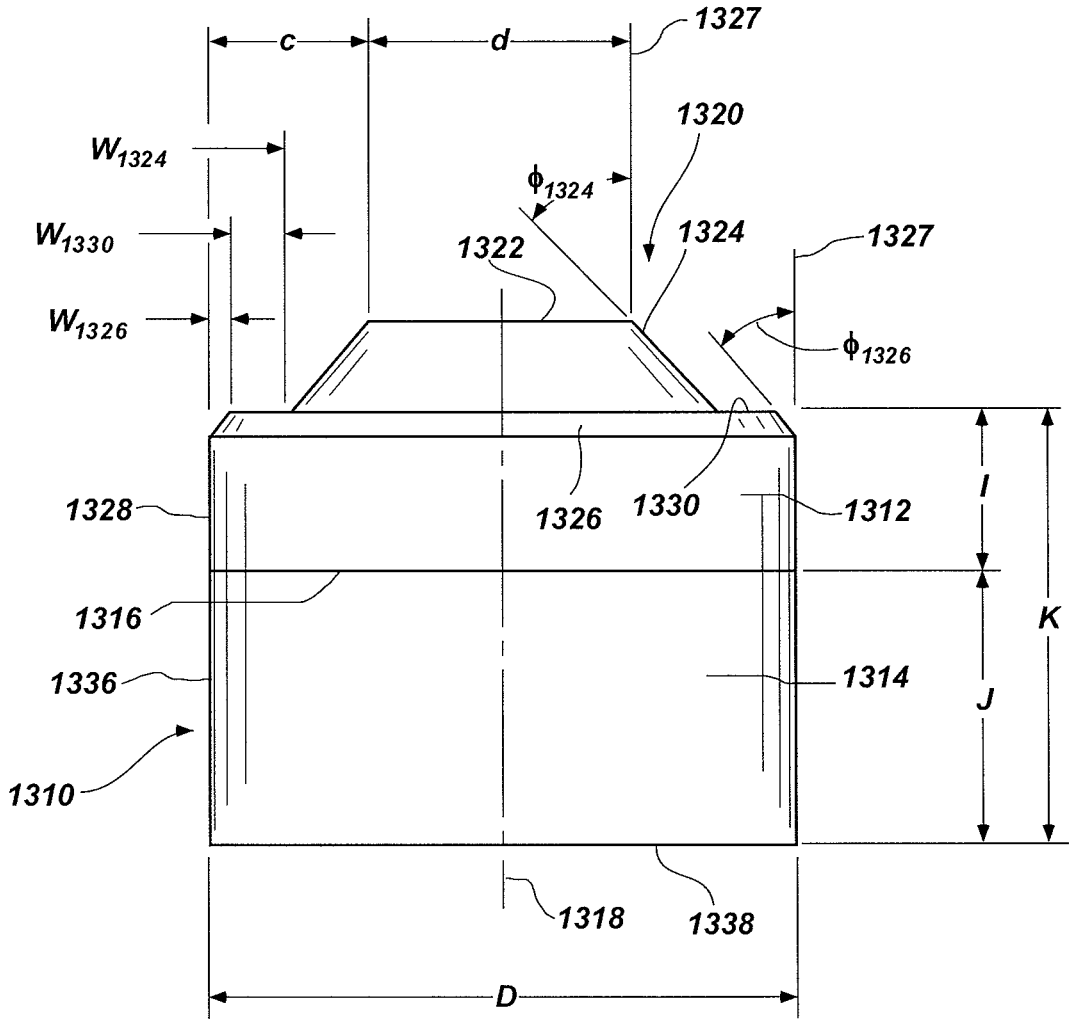
Fig. 6 (PRIOR ART)
FIG. 6 is a side view of a multi-aggressive cutting face of a prior art cutter.

FIG. 6 of the drawings illustrates a prior art cutting element particularly suitable for use in drilling a borehole through formations ranging from relatively hard formations to relatively soft formations. Cutting element or cutter 1310 comprises a superabrasive or diamond table 1312 disposed onto metallic carbide substrate 1314 using materials and high pressure, high temperature fabrication methods known within the art. Materials such as polycrystalline diamond (PCD) may be used for superabrasive or diamond table 1312 and tungsten carbide (WC) may be used for substrate 1314, however various other materials known within the art may be used in lieu of the preferred materials. Such alternative materials suitable for superabrasive or diamond table 1312 include, for example, thermally stable product (TSP), diamond film, cubic boron nitride and related $C_3N_4$ structures. Alternative materials suitable for substrate 1314 include cemented carbides such as tungsten (W), niobium (Nb), zirconium (Zr), vanadium (V), tantalum (Ta), titanium (Ti), and hafnium (Hf). Interface 1316 (FIG. 6) denotes a boundary, or junction, between superabrasive or diamond table 1312 and substrate 1314 and imaginary longitudinal axis or centerline 1318 denotes the longitudinal centerline of cutting element 1310. Superabrasive or diamond table 1312 has an overall longitudinal length denoted as dimension I and substrate 1314 has an overall longitudinal length denoted as dimension J, resulting in cutter 1310 having an overall length K. Substrate 1314 has an exterior sidewall 1336 and superabrasive or diamond table 1312 has an exterior sidewall 1328, which are preferably of the same diameter, denoted as dimension D, as depicted in FIG. 6, and are concentric and parallel with imaginary longitudinal axis or centerline 1318. Superabrasive or diamond table 1312 is provided with a multi-aggressiveness cutting face 1320 which, as viewed in FIG. 6, is exposed so as to be generally transverse to imaginary longitudinal axis 1318.

Multi-aggressiveness cutting face 1320 preferably comprises: a radially outermost, full circumference, less aggressive sloped surface, or chamfer 1326; a generally full-circumference, aggressive cutting surface, or shoulder 1330; a radially and longitudinally intermediate, generally full-circumference, intermediately aggressive sloped cutting surface 1324; and an aggressive, radially innermost, or centermost, cutting surface 1322. The radially outermost sloped surface or chamfer 1326 is angled with respect to sidewall surface 1328 of superabrasive or diamond table 1312 which is preferably, but not necessarily, parallel to longitudinal axis or centerline 1318, which is generally perpendicular to back surface 1338 of substrate 1314. The angle of chamfer 1326, denoted as $\phi_{1326}$, as well as the angle of slope of other cutting surfaces shown and described herein, are measured with respect to a reference line 1327 extending upwardly from sidewall 1328 of superabrasive or diamond table 1312. Vertically extending reference line 1327 is parallel to longitudinal axis 1318, however, it will be understood by those in the art that chamfer angles can be measured from other reference lines or datums. For example, chamfer angles can be measured directly with respect to the longitudinal axis, or to a vertical reference line shifted radially inwardly from a sidewall of a cutter, or with respect to back surface 1338. Chamfer angles, or cutting surface angles, as described and illustrated herein will generally be as measured from a vertically extending reference line parallel to the longitudinal axis 1318. The width of chamfer 1326 is denoted by width $W_{1326}$, as illustrated in FIG. 6. Shoulder 1330, being of a width $W_{1330}$ is preferably, but not necessarily, perpendicular to longitudinal axis 1318 and thus will preferably be generally perpendicular to sidewall 1328. Sloped cutting surface 1324, being of a selected height and width, is angled with respect to the surface of sidewall 1328 as to have a reference angle of $\phi_{1324}$. If desired for manufacturing convenience, the angle of slope of sloped cutting surface 1324 and chamfer 1326 can alternatively be measured with respect to back surface 1338. Radially innermost, or centermost, cutting surface 1322, having a diameter d is preferably, but not necessarily, perpendicular to longitudinal axis 1318 and thus is generally parallel to back surface 1338 of substrate 1314. Radially innermost, or centermost, cutting surface 1322 is preferably planar and is sized so that diameter d is less than substrate 1314/superabrasive/or diamond table 1312, or cutter 1310, diameter D and thus is radially inset from sidewall 1328 by a dimension C.

The following dimensions are representative of an exemplary multi-aggressiveness cutter 1310 having a PDC superabrasive or diamond table 1312 with a thickness preferably ranging between approximately 0.070 of an inch to 0.175 of an inch or greater with approximately 0.125 of an inch being well suited for many applications. PDC superabrasive or diamond table 1312 has been bonded onto a tungsten carbide (WC) substrate 1314 having a diameter D that would provide a multi-aggressiveness cutting element suitable for drilling formations within a wide range of hardness. Such exemplary dimensions and angles are: D—ranging from approximately 0.020 of an inch to approximately 1 inch or more with approximately 0.250 to approximately 0.750 of an inch being well suited for a wide variety of applications; d—ranging from approximately 0.100 to approximately 0.200 of an inch with approximately 0.150 to approximately 0.175 of an inch being well suited for a wide variety of applications; $W_{1326}$—ranging from approximately 0.005 to approximately 0.020 of an inch with approximately 0.010 to approximately 0.015 of an inch being well suited for a wide variety of applications; $W_{1324}$—ranging from approximately 0.025 to approximately 0.075 of an inch with approximately 0.040 to 0.060 of an inch being well suited for a wide variety of applications; $W_{1330}$—ranging from approximately 0.025 to approximately 0.075 of an inch with 0.040 to approximately 0.060 of an inch being well suited for a wide variety of applications; angle $\phi_{1326}$—ranging from approximately 30° to approximately 60° with approximately 45° being well suited for a wide variety of applications; and angle $\phi_{1324}$—ranging from approximately 30° to approximately 60° with approximately 45° being well suited for a wide variety of applications. However, it should be understood that other dimensions and angles of these ranges can readily be used depending on the degree, or magnitude, of aggressivity desired for each cutting surface, which in turn will influence the DOC of that cutting surface at a given WOB in a formation of a particular hardness. Furthermore, the dimensions and angles may also be specifically tailored so as to modify the radial and longitudinal extent each particular cutting surface is to have and thus induce a direct affect on the overall aggressiveness, or aggressivity profile, of cutting face 1320 of exemplary cutting element or cutter 1310.

Figure 7:
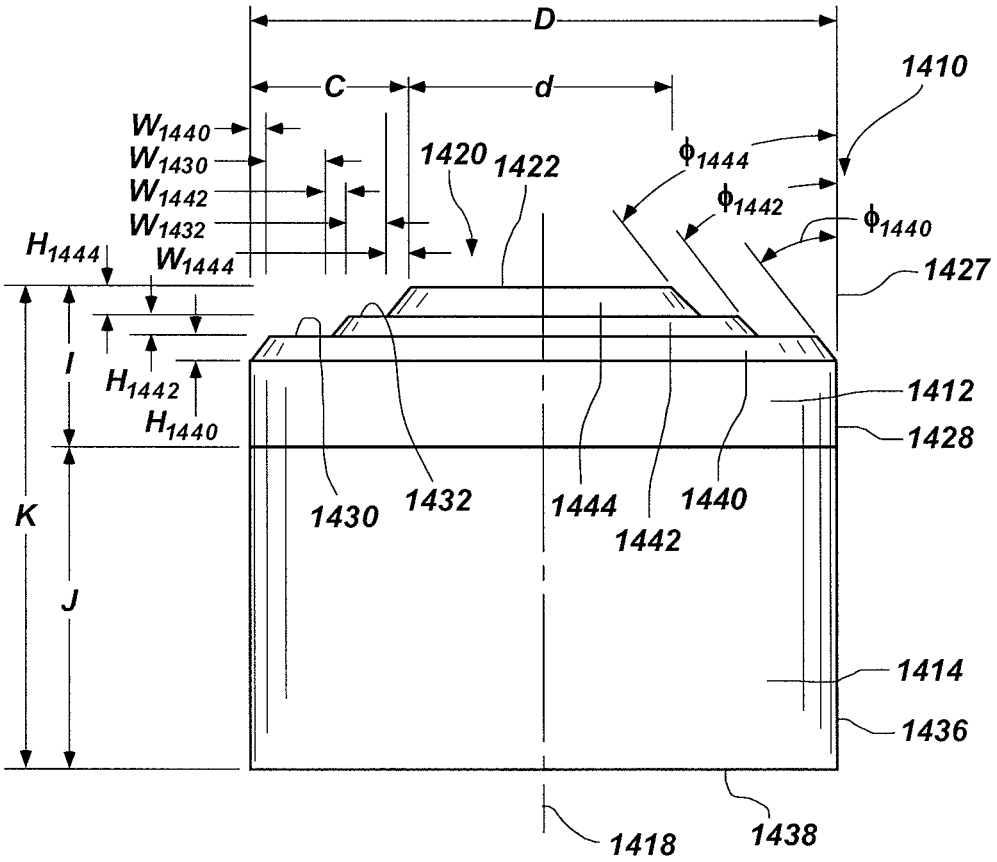
Fig. 7 (PRIOR ART)
FIG. 7 is a side view of a multi-aggressive cutting face of a prior art cutter.
Figure 8:
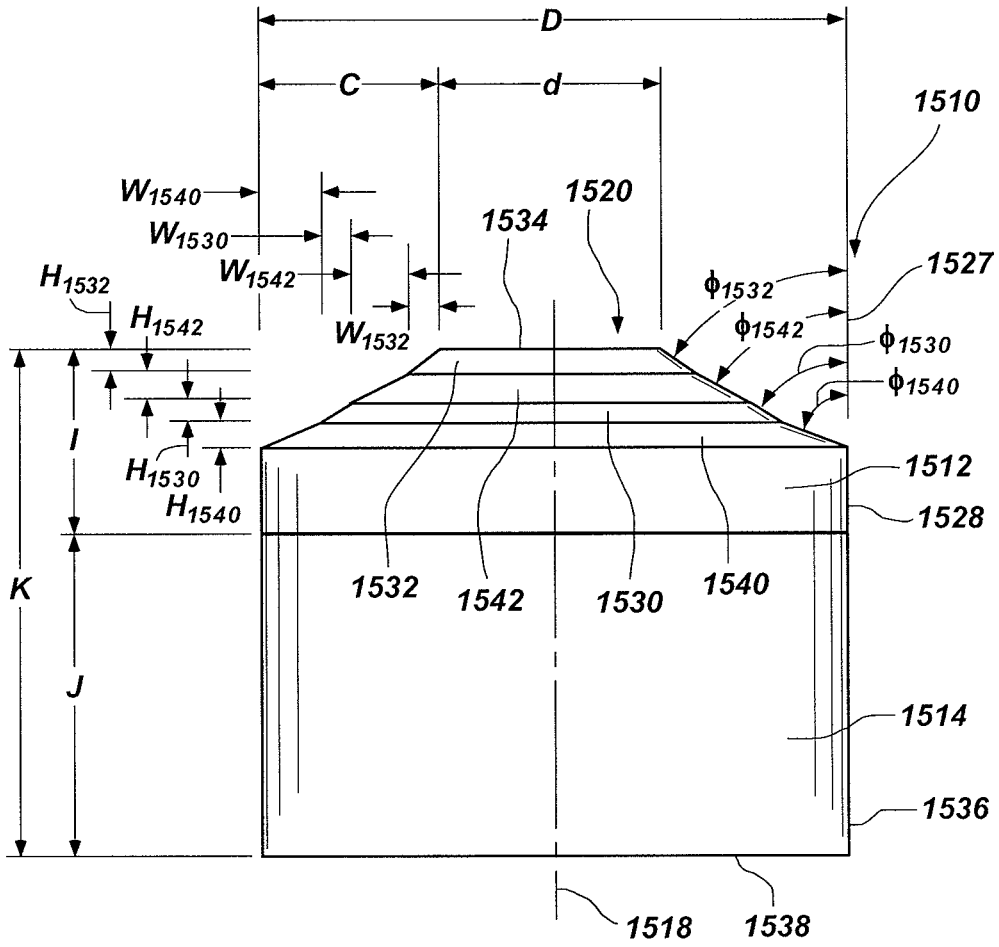
Fig. 8 (PRIOR ART)
FIG. 8 is a side view of a multi-aggressive cutting face of a prior art cutter.

FIGS. 7 and 8 illustrate prior art cutting elements including alternative multi-aggressiveness cutting faces which are particularly suitable for use with practicing the present method of drilling boreholes in subterranean formations. The variously illustrated cutters, while not only embodying the multi-aggressiveness feature of the present invention, additionally offer improved durability and cutting surface geometry as compared to prior known cutters suitable for installation upon subterranean rotary drill bits, such as drag-type drill bits.

An additional alternative cutting element or cutter 1410 is illustrated in FIG. 7. As with previously described and illustrated cutters herein, cutter 1410 is provided with a multi-aggressiveness cutting face 1420 preferably comprising a plurality of sloped cutting surfaces 1440, 1442, and 1444 and a centermost, or radially innermost cutting surface 1422, which is generally perpendicular to the longitudinal axis 1418. Back surface 1438 of substrate 1414 is also generally, but not necessarily parallel with radially innermost cutting surface 1422. Sloped cutting surfaces 1440, 1442, and 1444 are sloped with respect to sidewalls 1428 and 1436, which are, in turn, preferably parallel to longitudinal axis 1418. Thus, cutter 1410 is provided with a plurality of cutting surfaces which are progressively more aggressive the more radially inward each sloped cutting surface, 1440, 1442 and 1444 is positioned. Each of the respective cutting surfaces, or chamfer angles, $\phi_{1440}$, $\phi_{1442}$, and $\phi_{1444}$ can be approximately the same angle as measured from an imaginary reference line 1427 extending from sidewall 1428 and parallel to the longitudinal axis 1418. A cutting surface angle of approximately 45° as illustrated is well suited for many applications. Optionally, each of the respective cutting surface angles $\phi_{1440}$, $\phi_{1442}$, and $\phi_{1444}$ can be a progressively greater angle with respect to the periphery of the cutter 1410 in relation to the radial distance that each sloped cutting surface 1440, 1442 and 1444 is located away from longitudinal axis 1418. For example, angle $\phi_{1440}$ can be a more acute angle, such as approximately 25°, angle $\phi_{1442}$ can be a slightly larger angle, such as approximately 45°, and angle $\phi_{1444}$ can be a yet larger angle, such as approximately 65°.

Aggressive, generally non-sloping cutting surfaces or shoulders 1430 and 1432 are respectively positioned radially and longitudinally intermediate of sloped cutting surfaces 1440, 1442, and 1444. As with radially innermost cutting surface 1422, sloped cutting surfaces 1440, 1442, and 1444 are generally perpendicular with longitudinal axis 1418 and hence are also generally perpendicular to sidewall 1428 and periphery of cutting element 1410.

As with cutter 1310 discussed and illustrated previously, each of the sloped cutting surfaces 1440, 1442, 1444 of alternative cutter 1410 are preferably angled with respect to the periphery of cutter 1410, which is generally but not necessarily parallel to longitudinal axis 1418, within respective ranges. That is, angles $\phi_{1440}$, $\phi_{1442}$, and $\phi_{1444}$ taken as illustrated, are each approximately 45°. However, angles $\phi_{1440}$, $\phi_{1442}$, and $\phi_{1444}$ may each be of respectively different angles as compared to each other and need not be approximately equal. In general, it is preferred that each of the sloped cutting surfaces 1440, 1442, 1444 be angled within a range extending from about 25° to about 65°, however sloped cutting surfaces angled outside of this preferred range may be incorporated in cutters embodying the present invention.

Each respective sloped cutting surface preferably exhibits a respective height $H_{1440}$, $H_{1442}$, and $H_{1444}$, and width $W_{1440}$, $W_{1442}$, and $W_{1444}$. Preferably non-sloping cutting surfaces or shoulders 1430 and 1432 preferably exhibit a width $W_{1430}$ and $W_{1432}$, respectively. The various dimensions C, d, D, I, J, and K are identical and consistent with the previously provided descriptions of the other cutting elements disclosed herein.

For example, the following respective dimensions would be exemplary of a cutter 1410 having a diameter D of approximately 0.75 of an inch and a diameter d of approximately 0.350 of an inch. Sloped cutting surfaces 1440, 1442, and 1444 having the following respective heights and widths would be consistent with this particular embodiment with $H_{1440}$ being approximately 0.0125 of an inch, $H_{1442}$ being approximately 0.030 of an inch, $H_{1444}$ being approximately 0.030 of an inch, $W_{1440}$ being approximately 0.030 of an inch, $W_{1442}$ being approximately 0.030 of an inch, and $W_{1444}$ being approximately 0.030 of an inch. It should be noted that dimensions other than these exemplary dimensions may be utilized in practicing the present invention. It should be kept in mind that when selecting the various widths, heights and angles to be exhibited by the various cutting surfaces to be provided on a cutter in accordance with the present invention, that changing one characteristic such as width, will likely affect one or more of the other characteristics such as the height and/or angle. Thus, when designing or selecting cutting elements to be used in practicing the present invention, it may be necessary to take into consideration how changing or modifying one characteristic of a given cutting surface will likely influence one or more other characteristics of a given cutter and to accordingly take such into consideration when selecting, designing, using, or otherwise practicing the present invention.

Thus it can now be appreciated that cutting element or cutter 1410, as illustrated in FIG. 7, includes a cutting face 1420 that generally exhibits an overall aggressivity, which progressively increases from a relatively low aggressiveness near the periphery of the cutter 1410 to a greatest-most aggressivity proximate the centermost or longitudinal axis 1418 of the exemplary cutting element or cutter 1410. Thus, the centermost, or radially innermost cutting surface 1422 will be the most aggressive cutting surface upon cutting element or cutter 1410 being installed at a preselected cutter backrake angle in a drill bit. Cutter 1410, as illustrated in FIG. 7, is also provided with two relatively more aggressive non-sloping cutting surfaces or shoulders 1430 and 1432, each positioned radially and longitudinally so as to effectively provide cutting face 1420 with a slightly more overall aggressive, multi-aggressiveness cutting face to engage a variety of formations regarded as being slightly harder than what could be defined as a normal range of formation hardnesses. Thus, one can now appreciate how, in accordance with the present invention, the cutting face of a cutter can be specifically customized, or tailored, to optimize the range of hardness and types of formations that may be drilled. The operation of drilling a borehole with a drill bit equipped with cutting elements or cutters 1410 is essentially the same as the previously discussed cutting element or cutter 1310.

A yet additional, alternative cutting element or cutter 1510 is illustrated in FIG. 8. As with previously described and illustrated cutters herein, cutter 1510 is provided with a multi-aggressiveness cutting face 1520 preferably comprising a plurality of sloped cutting surfaces 1540 and 1542 and a centermost most, or radially innermost cutting surface 1534 which is generally perpendicular to the longitudinal axis 1518. Back surface 1538 of substrate 1514 is also generally, but not necessarily parallel with radially innermost cutting surface 1534. Sloped cutting surfaces 1540 and 1542 are sloped so as to be substantially angled with respect to reference line 1527 extending from sidewalls 1528 and 1536, which are in turn, preferably parallel to longitudinal axis 1518. Thus, cutter 1510 is provided with a plurality of Cutting surfaces which are of differing aggressiveness and which will preferably, but not necessarily, progressively more fully engage the formation being drilled in proportion to the softness of the formation being drilled and/or the particular amount of weight-on-bit being applied upon cutting element 1510. Each of the respective backrake angles $\phi_{1530}$ and $\phi_{1532}$ may be approximately the same angle, such as approximately 60° as illustrated. Optionally, cutting surface angle $\phi_{1540}$ may be less than cutting surface angle $\phi_{1542}$ so as to provide a progressively greater aggressiveness with respect to the radial distance each substantially sloped surface is located away from longitudinal axis 1518. For example, angle $\phi_{1540}$ may be approximately 60°, while angle $\phi_{1542}$ can be a larger angle, such as approximately 75°, with radially innermost cutting surface 1534 being oriented at yet larger angle, such as approximately 90°, or perpendicular, to centerline 1518 and sidewall 1536.

Lesser sloped, or less substantially sloped, cutting surfaces 1530 and 1532 may be approximately the same angle, such as approximately 45° as shown in FIG. 8, or these exemplarily lesser sloped cutting surfaces 1530 and 1532 may be oriented at differing angles so that angles $\phi_{1530}$ and $\phi_{1532}$ are not approximately equal.

Because lesser sloped cutting surfaces 1530 and 1532 are less substantially sloped with respect to longitudinal axis 1518/reference line 1527, lesser sloped cutting surfaces 1530 and 1532 will be significantly less aggressive upon cutter 1510 being installed in a bit, preferably at a selected cutter backrake angle usually as measured from the longitudinal axis 1518 of the cutter 1510, but not necessarily. Generally, less aggressive lesser sloped cutting surfaces 1530 and 1532 are respectively positioned radially and longitudinally intermediate of more aggressive sloped cutting surfaces 1540 and 1542.

As with cutters 1310 and 1410 discussed and illustrated previously, each of the lesser sloped cutting surfaces 1540 and 1542 of alternative cutter 1510 are preferably angled with respect to the periphery of cutter 1510, which is generally but not necessarily parallel to longitudinal axis 1518, within respective preferred ranges. That is, cutting surface angle $\phi_{1540}$ ranges from approximately 10° to approximately 80° with approximately 60° being well suited for a wide variety of applications and cutting surface angle $\phi_{1542}$ ranges from approximately 10° to approximately 80° with approximately 60° being well suited for a wide variety of applications. Each respective lesser sloped cutting surface 1540, 1542, 1530, and 1532 preferably exhibits a respective height $H_{1540}$, $H_{1542}$, $H_{1530}$, and $H_{1532}$, and a respective width $W_{1540}$, $W_{1542}$, $W_{1530}$, and $W_{1532}$. The various dimensions C, d, D, I, J, and K are identical and consistent with the previously provided descriptions of the other cutting elements disclosed herein.

For example, the following respective dimensions would be exemplary of a cutter 1510 having a diameter D of approximately 0.750 of an inch and a diameter d of approximately 0.500 of an inch. Cutting surfaces 1530, 1532, 1540 and 1542 having the following respective heights and widths would be consistent with this particular embodiment with $H_{1530}$ being approximately 0.030 of an inch, $H_{1532}$ being approximately 0.030 of an inch, $H_{1540}$ being approximately 0.030 of an inch, $H_{1542}$ being approximately 0.030 of an inch, $W_{1530}$ being approximately 0.020 of an inch, and $W_{1532}$ being approximately 0.060 of an inch, $W_{1540}$ being approximately 0.020 of an inch, and $W_{1542}$ being approximately 0.060 of an inch. Although, respective dimensions other than these exemplary dimensions may be utilized in accordance with the present invention. As described with respect to cutter 1410 hereinabove, the above-described cutting surfaces of exemplary cutter 1510 may be modified to exhibit dimensions and angles differing from the above exemplary dimensions and angles. Thus, changing one or more respective characteristic such as width, height, and/or angle that a given cutting surface is to exhibit, will likely affect one or more of the other characteristics of a given cutting surface, as well as the remainder of cutting surfaces provided on a given cutter.

Alternative cutter 1510, as illustrated in FIG. 8, includes cutting face 1520 which generally exhibits an overall multi-aggressivity cutting face profile which includes the relatively high aggressive sloped cutting surface 1540 near the periphery of cutter 1510, the relatively less aggressive cutting surface 1530 radially inward from cutting surface 1540, the second relatively aggressive cutting surface 1542 yet further radially inward from cutting surface 1540, the second relative less aggressive cutting surface 1532 radially adjacent the centermost, most-aggressive cutting surface 1534 generally centered about longitudinal axis 1518. Thus, centermost, or radially innermost cutting surface 1534 will likely be the most aggressive cutting surface upon which cutting element 1510 is installed at a preselected cutter backrake angle in a subterranean drill bit.

Furthermore, alternative cutter 1510, as illustrated in FIG. 8, is provided with at least two, longitudinally and radially positioned aggressive sloped cutting surfaces 1540 and 1542 to provide cutting face 1520 with a slightly less overall aggressive, multi-aggressiveness cutting face in comparison to cutter 1410 (FIG. 7) to engage a variety of formations regarded as being slightly softer than what could be defined as a normal range of formation hardnesses. Thus, one can now appreciate how, in accordance with the present invention, the cutting face of a cutter can be specifically customized, or tailored, to optimize the range of hardness and types of formations that may be drilled. The general operation of drilling a borehole with a drill bit equipped with cutting elements 1510 is essentially the same as the previously discussed cutting elements 1310 (FIG. 6) and 1410, however, the cutting characteristics will be slightly different in that, as compared to cutting element 1410 for example, as sloped cutting surfaces 1540 and 1542 will be slightly less aggressive than non-sloped cutting surfaces 1430 and 1432 of cutting element 1410, which were shown as being generally perpendicular to longitudinal axis 1418. Therefore, when in operation, cutting element 1510 would ideally be used for drilling relative medium to soft formations with sloped cutting surfaces 1540 and 1542 at respectively deeper depths-of-cut as these surfaces although more aggressive than cutting surfaces 1530 and 1532, are not very aggressive in an absolute sense due to the their respective angles $\phi_{1540}$ and $\phi_{1542}$ being of a more obtuse angle taken as shown in FIG. 8. Such angles effectively cause cutting surfaces 1540 and 1542 to less aggressively engage the formation being drilled. Even less aggressive cutting surfaces 1530 and 1532, which can be referred to as being non-aggressive in an absolute sense, are ideal for engaging soft to very soft formations due to their respective angles $\phi_{1530}$ and $\phi_{1532}$ being relatively acute taken as shown in FIG. 8.

Figure 9:
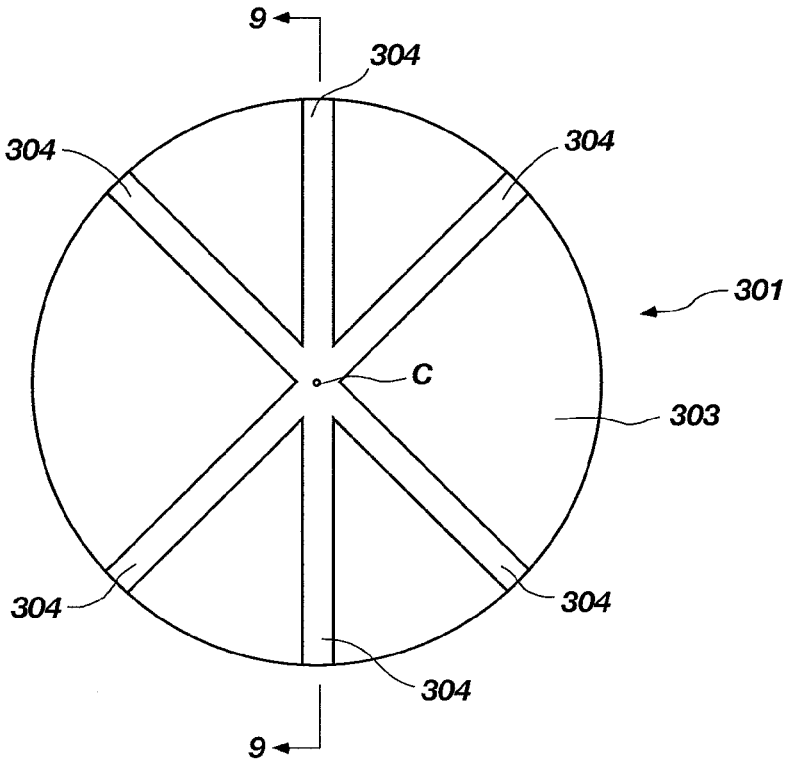
FIG. 9 is a front view of a groove or channel pattern for a cutter.

Referring to FIG. 9, a cutter 301, of the general type previously described hereinabove and illustrated in drawing FIG. 3, is shown according to an embodiment of the invention having a plurality of grooves or channels 304 formed on diameters of the polycrystalline diamond table 303 of the cutter 301 generally in the pattern of an X with the plurality of grooves or channels 304 intersecting about the geometric center C of the cutter 301 forming a common area. The grooves or channels 304 are formed on diameters of the diamond table 303 to add stability to the drill bit (not depicted) on which the cutter 301 is installed, by a formation chip (not depicted) being cut from the formation engaging the grooves or channels 304 as the chip moves across the diamond table 303 of the cutter 301. When the grooves or channels 304 are formed on diameters of the cutter 301 as a chip being cut from a formation moves across the diamond table 303, the forces on the cutter 301 act about the geometric center C of the cutter 301. If the grooves or channels 304 are not formed on a diameter of the cutter 301, the forces on the cutter 301 from a chip being cut from a formation moving across the diamond table 303 of the cutter 301 do not act about the geometric center C of the cutter 301 thereby causing a force imbalance on the cutter 301 and a drill bit on which the cutter 301 is installed which, in turn, may cause the drill bit to vibrate or whirl.

The grooves or channels 304 increase in depth from a bottom of the cutter 301 either to the geometric center C or a top thereof. The shape of the bottom of the grooves or channels 304 may be any desired shape to facilitate engaging the formation chip being cut to engage the groove or channel 304, as well as to slide thereacross through the groove or channel 304. The width of the grooves or channels 304 may be any desired width depending upon the diameter of the cutter 301. In this manner, a chip being cut from a formation engages a groove or channel 304 with a greater stabilizing force as the chip moves across the diamond table 303 of the cutter 301, while the thickness of the diamond table 303 on the bottom of the cutter 301 is maintained to reduce the likelihood of the forces on the diamond table 303 to cause chipping, spalling or cracking of the diamond table 303 during operation of the drill bit on which the cutter 301 is installed during drilling operations.

Figure 9A:
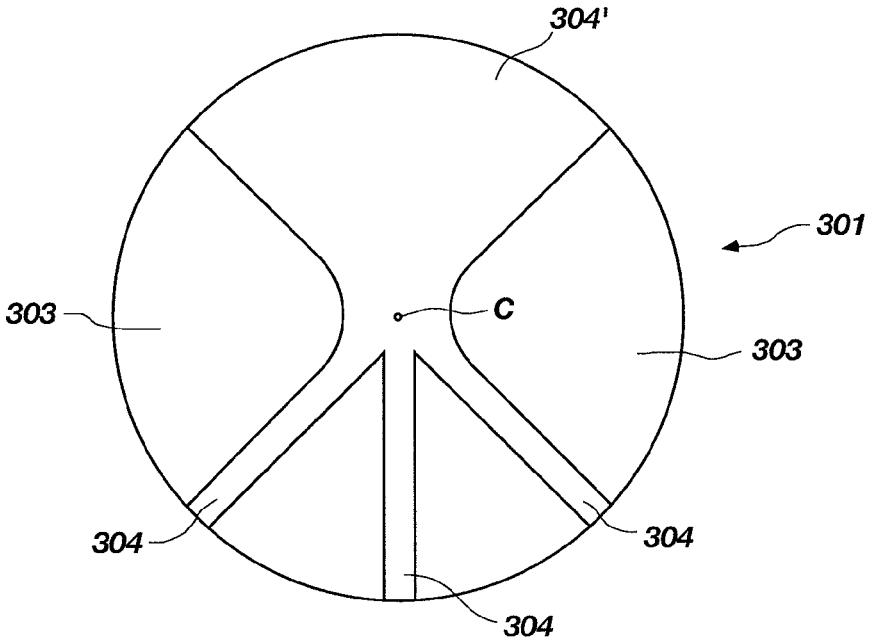
FIG. 9A is a front view of a groove or channel pattern for a cutter.

Referring to FIG. 9A, a cutter 301 is shown having a plurality of grooves or channels 304 formed on diameters of the polycrystalline diamond table 303 of the cutter 301 in an alternative arrangement forming a wider groove or channel 304' on an upper portion of the diamond table 303 of the cutter 301. The grooves or channels 304 are formed on diameters of the diamond table 303 to add stability to the drill bit (not depicted) on which the cutter 301 is installed by a formation chip being cut from the formation engaging the grooves or channels 304 as the chip moves across the diamond table 303 of the cutter 301. When the grooves or channels 304 are formed on diameters of the cutter 301, as a chip being cut from a formation moves across the diamond table 303, the forces on the cutter 301 act about the geometric center C of the cutter 301. If the grooves or channels 304 are not formed on a diameter of the cutter 301, the forces on the cutter 301 from a chip being cut from a formation moving across the diamond table 303 of the cutter 301 do not act about the geometric center C of the cutter 301 thereby causing a force imbalance on the cutter 301 and a drill bit on which the cutter 301 is installed which, in turn, may cause the drill bit to vibrate or whirl.

The grooves or channels 304 increase in depth from the bottom of the cutter 301 either to the geometric center C or the top thereof. The shape of the bottom of the grooves or channels 304 may be any desired shape to facilitate engaging the formation chip being cut to engage the groove or channel 304, as well as to slide across through the groove or channel 304. The width of the grooves or channels 304 or wider groove or channel 304' may be any desired width depending upon the diameter of the cutter 301 and the width of the individual grooves or channels 304. In this manner, a chip being cut from a formation engages a groove or channel 304 with a greater stabilizing force as the chip moves across the diamond table 303 of the cutter 301 into the wider groove or channel 304', while the thickness of the diamond table 303 on the bottom of the cutter 301 is maintained to reduce the likelihood of the forces on the diamond table 303 to cause chipping, spalling or cracking of the diamond table 303 during operation of the drill bit on which the cutter 301 is installed during drilling operations.

Figure 9B:
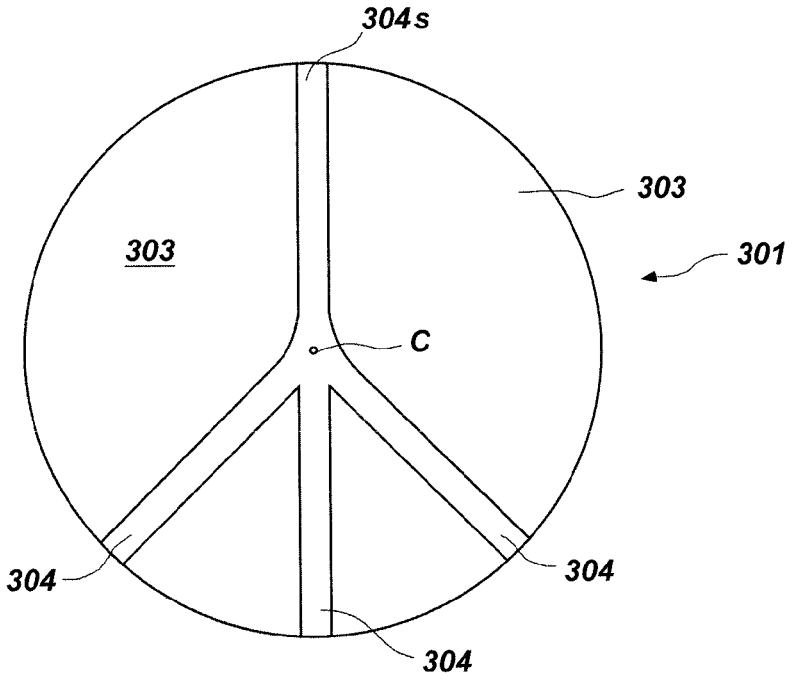
FIG. 9B is a front view of a groove or channel pattern for a cutter.

Referring to FIG. 9B, a cutter 301 is shown having a plurality of grooves or channels 304 formed on diameters of the polycrystalline diamond table 303 of the cutter 301 with the three grooves or channels 304 converging of a single groove or channel 304*s* on the upper portion of the diamond table 303 of the cutter 301. The grooves or channels 304 are formed on diameters of the diamond table 303 to add stability to the drill bit (not depicted) on which the cutter 301 is installed by a formation chip being cut from the formation engaging the grooves or channels 304 as the chip moves across the diamond table 303 of the cutter 301. When the grooves or channels 304 are formed on diameters of the cutter 301, as a chip being cut from a formation moves across the diamond table 303, the forces on the cutter 301 act about the geometric center C of the cutter 301. If the grooves or channels 304 are not formed on a diameter of the cutter 301, the forces on the cutter 301 from a chip being cut from a formation moving across the diamond table 303 of the cutter 301 do not act about the geometric center C of the cutter 301 thereby causing a force imbalance on the cutter 301 and a drill bit on which the cutter 301 is installed which, in turn, may cause the drill bit to vibrate or whirl.

The grooves or channels 304 increase in depth from the bottom of the cutter 301 either to the center C or the top thereof. The shape of the bottom of the grooves or channels 304 may be any desired shape to facilitate engaging the formation chip being cut to engage the groove or channel 304, as well as to slide across through the groove or channel 304. The width of the grooves or channels 304 or single groove or channel 304*s* may be any desired width depending upon the diameter of the cutter 301 and the width of the individual grooves or channels 304. In this manner, a chip being cut from a formation engages a groove or channel 304 with a greater stabilizing force as the chip moves across the diamond table 303 of the cutter 301 into the single groove or channel 304*s*, while the thickness of the diamond table 303 on the bottom of the cutter 301 is maintained to reduce the likelihood of the forces on the diamond table 303 to cause chipping, spalling or cracking of the diamond table 303 during operation of the drill bit on which the cutter 301 is installed during drilling operations.

Figure 9C:
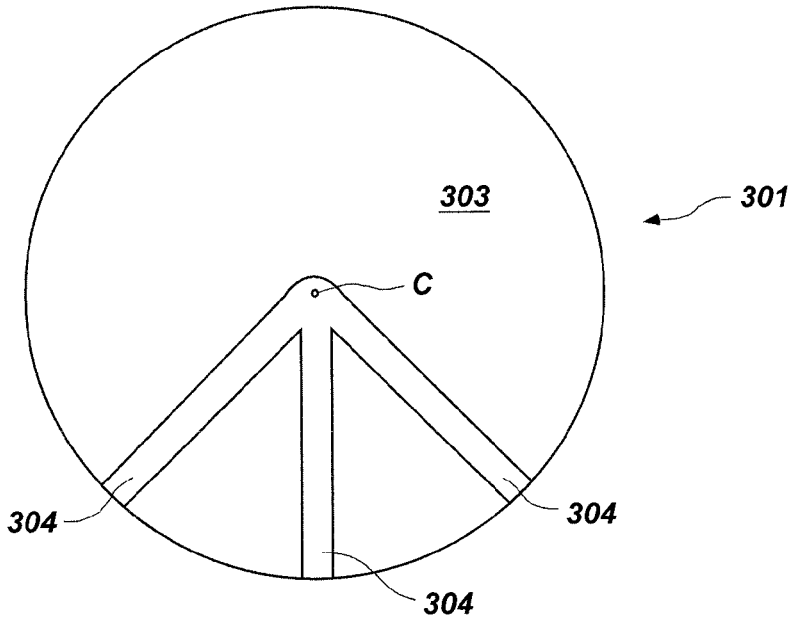
FIG. 9C is a front view of a groove or channel pattern for a cutter.

Referring to FIG. 9C, a cutter 301 is shown having a plurality of grooves or channels 304 formed on diameters of the polycrystalline diamond table 303 of the cutter 301 terminating at approximately the geometric center C of the diamond table 303. The grooves or channels 304 are formed on diameters of the diamond table 303 to add stability to the drill bit (not depicted) on which the cutter 301 is installed by a formation chip being cut from the formation engaging the grooves or channels 304 as the chip moves across the diamond table 303 of the cutter 301 to the geometric center C of the diamond table 303. When the grooves or channels 304 are formed on diameters of the cutter 301, as a chip being cut from a formation moves across the diamond table 303, the forces on the cutter 301 act about the geometric center C of the cutter 301. If the grooves or channels 304 are not formed on a diameter of the cutter 301, the forces on the cutter 301 from a chip being cut from a formation moving across the diamond table 303 of the cutter 301 do not act about the geometric center C of the cutter 301 thereby causing a force imbalance on the cutter 301 and a drill bit on which the cutter 301 is installed which, in turn, may cause the drill bit to vibrate or whirl.

The grooves or channels 304 increase in depth from the bottom of the cutter 301 to the geometric center C. The shape of the bottom of the grooves or channels 304 may be any desired shape to facilitate engaging the formation chip being cut to engage the groove or channel 304, as well as to slide across through the groove or channel 304. The width of the grooves or channels 304 may be any desired width depending upon the diameter of the cutter 301 and the width of the individual grooves or channels 304. In this manner, a chip being cut from a formation engages a groove or channel 304 with a greater stabilizing force as the chip moves across the diamond table 303 of the cutter 301 into the groove or channel 304, while the thickness of the diamond table 303 on the bottom of the cutter 301 is maintained to reduce the likelihood of the forces on the diamond table 303 to cause chipping, spalling or cracking of the diamond table 303 during operation of the drill bit on which the cutter 301 is installed during drilling operations.

Figure 9D:
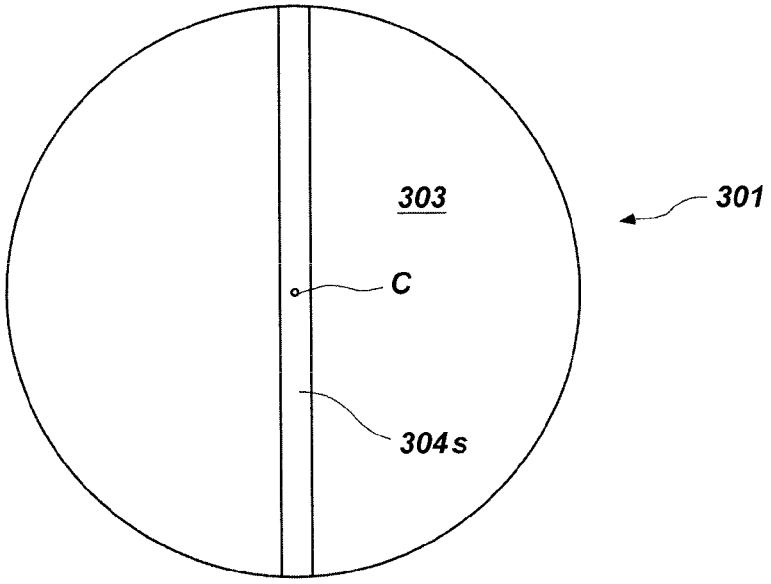
FIG. 9D is a front view of a groove or channel pattern for a cutter.

Referring to FIG. 9D, a cutter 301 is shown having a single groove or channel 304*s* formed on a diameter of the polycrystalline diamond table 303 of the cutter 301 extending across the cutter 301 through the geometric center C of the diamond table 303. The groove or channel 304 is formed on a diameter of the diamond table 303 to add stability to the drill bit (not depicted) on which the cutter 301 is installed by a formation chip being cut from the formation engaging the groove or channel 304 as the chip moves across the diamond table 303 of the cutter 301 to the geometric center C of the diamond table 303. When the groove or channel 304 is formed on diameters of the cutter 301, as a chip being cut from a formation moves across the diamond table 303, the forces on the cutter 301 act about the geometric center C of the cutter 301. If the grooves or channels 304 are not formed on a diameter of the cutter 301, the forces on the cutter 301 from a chip being cut from a formation moving across the diamond table 303 of the cutter 301 do not act about the geometric center C of the cutter 301 thereby causing a force imbalance on the cutter 301 and a drill bit on which the cutter 301 is installed which, in turn, may cause the drill bit to vibrate or whirl.

The groove or channel 304 increases in depth from the bottom of the cutter 301 to the geometric center C. The shape of the bottom of the grooves or channels 304 may be any desired shape to facilitate engaging the formation chip being cut to engage the groove or channel 304, as well as to slide across through the groove or channel 304. The width of the grooves or channels 304 may be any desired width depending upon the diameter of the cutter 301 and the width of the individual groove or channel 304. In this manner, a chip being cut from a formation engages a groove or channel 304 with a greater stabilizing force as the chip moves across the diamond table 303 of the cutter 301 into the groove or channel 304, while the thickness of the diamond table 303 on the bottom of the cutter 301 is maintained to reduce the likelihood of the forces on the diamond table 303 to cause chipping, spalling or cracking of the diamond table 303 during operation of the drill bit on which the cutter 301 is installed during drilling operations.

Figure 9E:
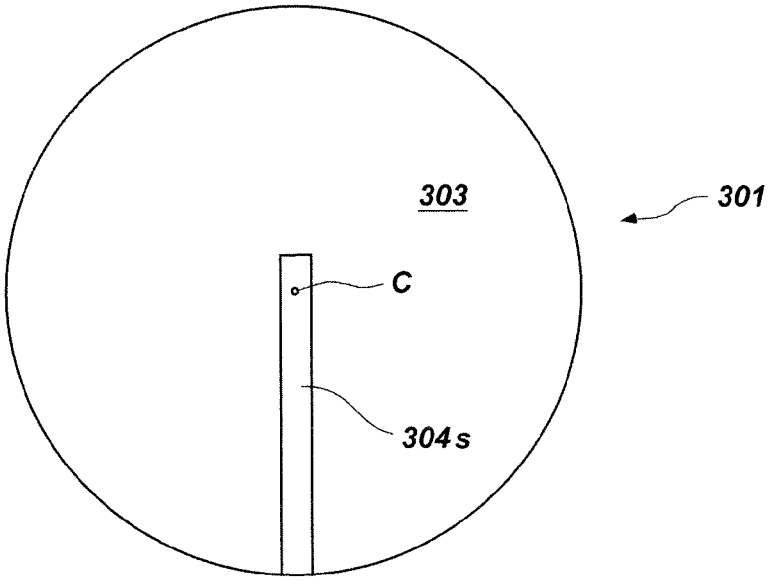
FIG. 9E is a front view of a groove or channel pattern for a cutter.

Referring to FIG. 9E, a cutter 301 is shown having a single groove or channel 304*s* formed on a diameter of the polycrystalline diamond table 303 of the cutter 301 terminating at approximately the geometric center C of the diamond table 303. The groove or channel 304 is formed on a diameter of the diamond table 303 to add stability to the drill bit (not depicted) on which the cutter 301 is installed by a formation chip being cut from the formation engaging the grooves or channels 304 as the chip moves across the diamond table 303 of the cutter 301 to the geometric center C of the diamond table 303. When the groove or channel 304 is formed on diameters of the cutter 301, as a chip being cut moves across the diamond table 303, the forces on the cutter 301 act about the geometric center C of the cutter 301. If the groove or channel 304 is not formed on a diameter of the cutter 301, the forces on the cutter 301 from a chip being cut from a formation moving across the diamond table 303 of the cutter 301 do not act about the geometric center C of the cutter 301 thereby causing a force imbalance on the cutter 301 and a drill bit on which the cutter 301 is installed which, in turn, may cause the drill bit to vibrate or whirl.

The groove or channel 304 increases in depth from the bottom of the cutter 301 to the geometric center C. The shape of the bottom of the grooves or channel 304 may be any desired shape to facilitate engaging the formation chip being cut to engage the groove or channel 304, as well as to slide across through the groove or channel 304. The width of the grooves or channels 304 may be any desired width depending upon the diameter of the cutter 301 and the width of the individual groove or channel 304. In this manner, a chip being cut from a formation engages a groove or channel 304 with a greater stabilizing force as the chip moves across the diamond table 303 of the cutter 301 into the groove or channel 304, while the thickness of the diamond table 303 on the bottom of the cutter 301 is maintained to reduce the likelihood of the forces on the diamond table 303 to cause chipping, spalling or cracking of the diamond table 303 during operation of the drill bit on which the cutter 301 is installed during drilling operations.

Figure 9F:
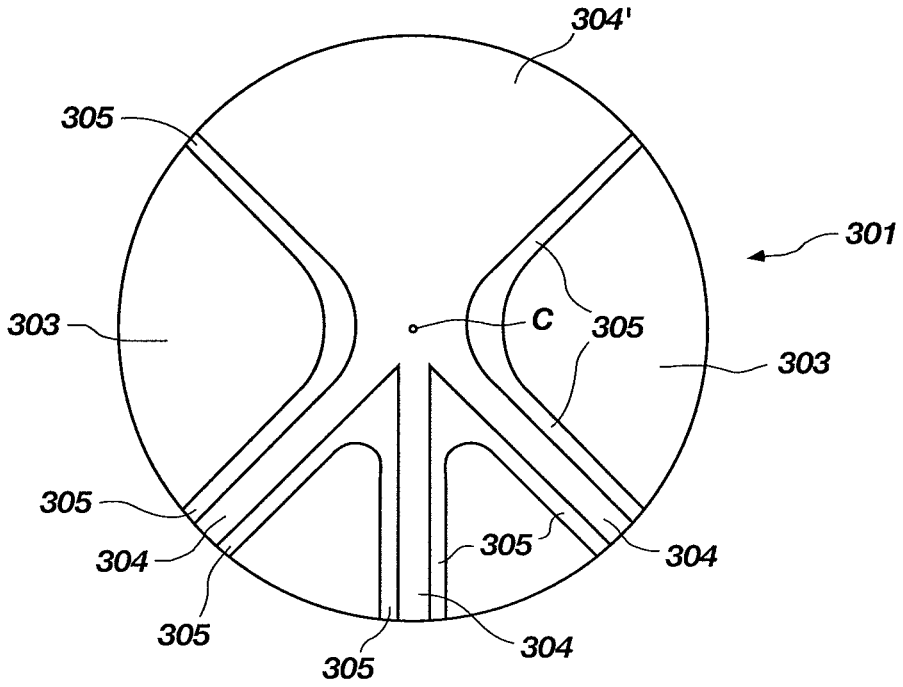
FIG. 9F is a front view of a groove or channel pattern having ribs for a cutter.

Referring to FIG. 9F, a cutter 301 is shown having grooves or channels 304, including widened groove or channel 304', formed on diameters of the polycrystalline diamond table 303 of the cutter 301 terminating at approximately the geometric center C of the diamond table 303. The grooves or channels 304 formed on diameters of the diamond table 303 to add stability to the drill bit (not depicted) on which the cutter 301 is installed by a formation chip being cut from the formation engaging the grooves or channels 304 as the chip moves across the diamond table 303 of the cutter 301 to the geometric center C of the diamond table 303. When the grooves or channels 304 are formed on diameters of the cutter 301, as a chip being cut moves across the diamond table 303, forces on the cutter 301 act about the geometric center C of the cutter 301. If the grooves or channels 304 are not formed on a diameter of the cutter 301, the forces on the cutter 301 from a chip being cut from a formation moving across the diamond table 303 of the cutter 301 do not act about the geometric center C of the cutter 301 thereby causing a force imbalance on the cutter 301 and a drill bit on which the cutter 301 is installed which, in turn, may cause the drill bit to vibrate or whirl.

The grooves or channels 304 increase in depth from the bottom of the cutter 301 to the geometric center C. The shape of the bottom of the grooves or channels 304 may be any desired shape to facilitate engaging the formation chip being cut to engage grooves or channels 304, as well as to slide across through the grooves or channels 304. The width of the grooves or channels 304 may be any desired width depending upon the diameter of the cutter 301 and the width of the individual groove or channel 304. In this manner, a chip being cut from a formation engages a groove or channel 304 with a greater stabilizing force as the chip moves across the diamond table 303 of the cutter 301 into the groove or channel 304, while the thickness of the diamond table 303 on the bottom of the cutter 301 is maintained to reduce the likelihood of the forces on the diamond table 303 to cause chipping, spalling or cracking of the diamond table 303 during operation of the drill bit on which the cutter 301 is installed during drilling operations.

Additionally, the grooves or channels 304, including widened groove or channel 304', have ribs 305 located on the sides thereof. The ribs 305 may be formed raised from or above the surface 303, or common with or at the same level with the surface 303. The ribs 305 may be made of diamond, tungsten carbide, cubic boron nitride, leached polycrystalline diamond, cobalt, etc. When the ribs 305 are raised and formed using cubic boron nitride or tungsten carbide, the cutter 301 may be used to cut casing material and components, in order to drill through a casing shoe, a casing bit or sidewall of a casing, following which the ribs 305 may wear and cutting may continue with the polycrystalline diamond of the diamond table 303. When the ribs 305 are inset onto the surface of the diamond table 303, if a rib 305 fails due to overloading, any cracking through a rib 305 is not transmitted into the base material. The ribs 305 and grooves or channels 304 help increase surface area for cooling of the cutter 301. The ribs 305 and grooves or channels 304 help to lock the face of the cutter 301 into the formation by helping to reduce lateral vibrations of the drill bit and axial vibrations of the drill bit. The ribs 305 and grooves and channels 304 cause thin ribbons of formation material to be cut by the cutter 301 during drilling for enhanced cutter 301 cleaning, and provide better flow of formation material around the drill bit during drilling, better directed diversion of formation material by the cutter 301 during drilling, and better cleaning using reduced mud flow during drilling. In addition, the ribs 305 and grooves or channels 304 provide increased surface area on the face of the cutter 301 and additional diamond volume for enhanced heat transfer and more effective cooling of the cutter 301. Further, by varying the angular orientation and topography of ribs 305, the force applied by the cutter 301 to the formation may be varied somewhat independent of the contact area and point loading by the cutter 301 may be enhanced.

Figure 10:
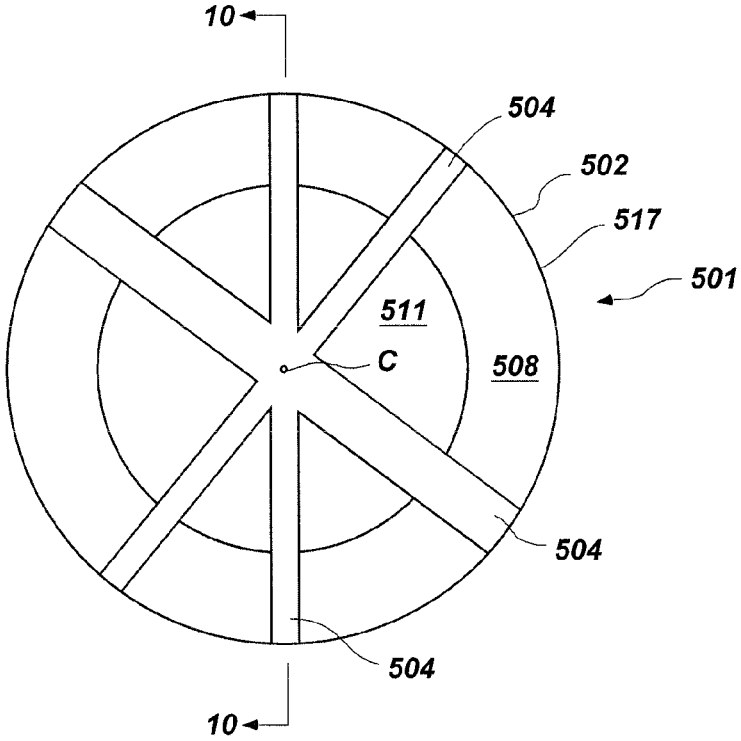
FIG. 10 is a front view of a groove or channel pattern for a cutter.

Referring to FIG. 10, a cutter 501, of the type such as previously described hereinabove and illustrated in drawing FIGS. 5*a*-5*d*, is shown having a plurality of grooves or channels 504 formed on diameters of the diamond table 502 of the cutter 501 generally in the pattern of an X with the plurality of grooves or channels 504 intersecting about the geometric center C of the cutter 501 forming a common area. The grooves or channels 504 are formed on diameters of the diamond table 502 to add stability to the drill bit (not depicted) on which the cutter 501 is installed by a formation chip being cut from the formation engaging the grooves or channels 504 as the chip moves across the diamond table 502 of the cutter 501. When the grooves or channels 504 are formed on diameters of the cutter 501, as a chip being cut from a formation moves across the diamond table 502, the forces on the cutter 501 act about the geometric center C of the cutter 501. If the grooves or channels 504 are not formed on a diameter of the cutter 501, the forces on the cutter 501 from a chip being cut from a formation moving across the diamond table 502 of the cutter 501 do not act about the geometric center C of the cutter 501 thereby causing a force imbalance on the cutter 501 and a drill bit on which the cutter 501 is installed which, in turn, may cause the drill bit to vibrate or whirl.

The grooves or channels 504 increase in depth from a bottom of the cutter 501 either to the geometric center C or a top thereof. The shape of the bottom of the grooves 504 may be any desired shape to facilitate engaging the formation chip being cut to engage the groove or channel 504, as well as to slide across through the groove or channel 504. The width of the grooves or channels 504 may be any desired width depending upon the diameter of the cutter 501. In this manner, a chip being cut from a formation engages a groove or channel 504 with a greater stabilizing force as the chip moves across the diamond table 502 of the cutter 501, while the thickness of the diamond table 502 on the bottom of the cutter 501 is maintained to reduce the likelihood of the forces on the diamond table 502 to cause chipping, spalling or cracking of the diamond table 502 during operation of the drill bit on which the cutter 501 is installed during drilling operations.

Figure 10A:
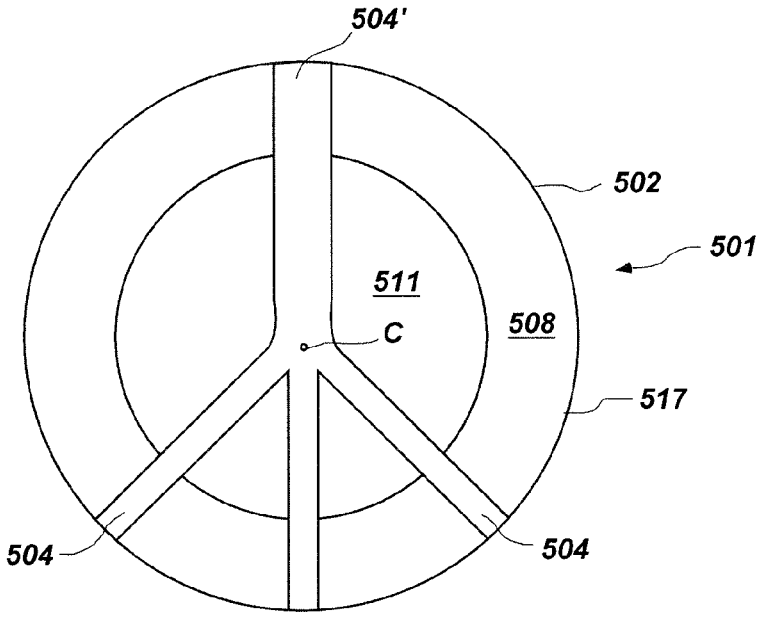
FIG. 10A is a front view of a groove or channel pattern for a cutter.

Referring to FIG. 10A, a cutter 501 is shown having a plurality of grooves or channels 504 formed on diameters of the polycrystalline diamond table 502 of the cutter 501 in an alternative arrangement forming a wider groove or channel 504' on an upper portion of the diamond table 502 of the cutter 501. The grooves or channels 504 are formed on diameters of the diamond table 502 to add stability to the drill bit (not depicted) the cutter 501 is installed upon by a formation chip being cut from the formation engaging the grooves or channels 504 as the chip moves across the diamond table 502 of the cutter 501. When the grooves or channels 504 are foamed on diameters of the cutter 501, as a chip being cut moves across the diamond table 502, the forces on the cutter 501 act about the geometric center C of the cutter 501. If the grooves or channels 504 are not formed on a diameter of the cutter 501, the forces on the cutter 501 from a chip being cut from a formation moving across the diamond table 502 of the cutter 501 do not act about the geometric center C of the cutter 501 thereby causing a force imbalance on the cutter 501 and a drill bit on which the cutter 501 is installed which, in turn, may cause the drill bit to vibrate or whirl.

The grooves or channels 504 increase in depth from the bottom of the cutter 501 either to the geometric center C or the top thereof. The shape of the bottom of the grooves 504 may be any desired shape to facilitate engaging the formation chip being cut to engage the groove or channel 504, as well as to slide across through the groove or channel 504. The width of the grooves or channels 504 or wider groove or channel 504' may be any desired width depending upon the diameter of the cutter 501 and the width of the individual groove or channel 504. In this manner, a chip being cut from a formation engages a groove or channel 504 with a greater stabilizing force as the chip moves across the diamond table 502 of the cutter 501 into the wider groove or channel 504', while the thickness of the diamond table 502 on the bottom of the cutter 501 is maintained to reduce the likelihood of the forces on the diamond table 502 to cause chipping, spalling or cracking of the diamond table 502 during operation of the drill bit on which the cutter 501 is installed during drilling operations.

Figure 10B:
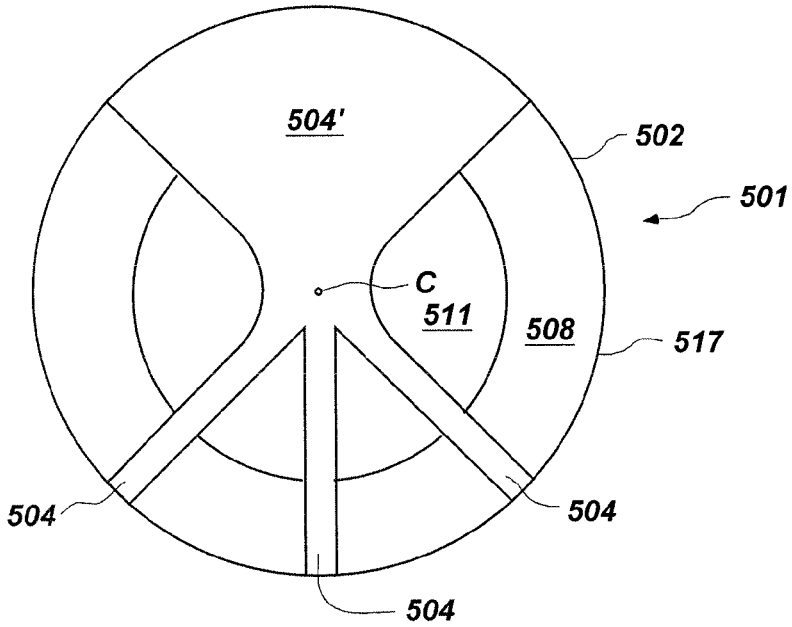
FIG. 10B is a front view of a groove or channel pattern for a cutter.

Referring to FIG. 10B, a cutter 501 is shown having a plurality of grooves or channels 504 formed on diameters of the polycrystalline diamond table 502 of the cutter 501 with either the three grooves or channels 504 converging on a single wider groove or channel 504' on the upper portion of the diamond table 502 of the cutter 501. The grooves or channels 504 are formed on diameters of the diamond table 303 to add stability to the drill bit on which the cutter 501 is installed by a formation chip being cut from the formation engaging the grooves or channels 504 as the chip moves across the diamond table 502 of the cutter 501. When the grooves or channels 504 are formed on diameters of the cutter 501, as a chip being cut from a formation moves across the diamond table 502, the forces on the cutter 501 act about the geometric center C of the cutter 501. If the grooves or channels 504 are not formed on a diameter of the cutter 501, the forces on the cutter 501 from a chip being cut from a formation moving across the diamond table 502 of the cutter 501 do not act about the geometric center C of the cutter 501 thereby causing a force imbalance on the cutter 501 and a drill bit on which the cutter 501 is installed which, in turn, may cause the drill bit to vibrate or whirl.

The grooves or channels 504 increase in depth from the bottom of the cutter 501 either to the center C or the top thereof. The shape of the bottom of the grooves 504 may be any desired shape to facilitate engaging the formation chip being cut to engage the groove or channel 504, as well as to slide across through the groove or channel 504. The width of the grooves or channels 504 or wider groove or channel 504' may be any desired width depending upon the diameter of the cutter 501 and the width of the individual groove or channel 504. In this manner, a chip being cut from a formation engages a groove or channel 504 with a greater stabilizing force as the chip moves across the diamond table 502 of the cutter 501 into the wider groove or channel 504', while the thickness of the diamond table 502 on the bottom of the cutter 501 is maintained to reduce the likelihood of the forces on the diamond table 502 to cause chipping, spalling or cracking of the diamond table 502 during operation of the drill bit on which the cutter 301 is installed during drilling operations.

Figure 10C:
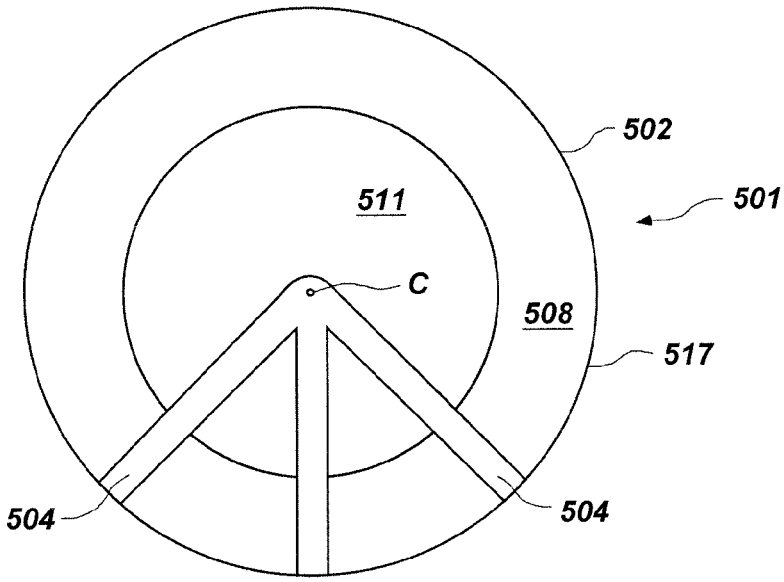
FIG. 10C is a front view of a groove or channel pattern for a cutter.

Referring to FIG. 10C, a cutter 501 is shown having a plurality of grooves or channels 504 formed on diameters of the polycrystalline diamond table 502 of the cutter 501 terminating at approximately the geometric center C of the diamond table 502. The grooves or channels 504 are formed on diameters of the diamond table 502 to add stability to the drill bit (not depicted) on which the cutter 501 is installed by a formation chip being cut from the formation engaging the grooves or channels 504 as the chip moves across the diamond table 502 of the cutter 501 to the geometric center C of the diamond table 502. When the grooves or channels 504 are formed on diameters of the cutter 501, as a chip being cut from a formation moves across the diamond table 502, the forces on the cutter 501 act about the geometric center C of the cutter 501. If the grooves or channels 504 are not formed on a diameter of the cutter 501, the forces on the cutter 501 from a chip being cut from a formation moving across the diamond table 502 of the cutter 501 do not act about the geometric center C of the cutter 501 thereby causing a force imbalance on the cutter 501 and a drill bit on which the cutter 501 is installed which, in turn, may cause the drill bit to vibrate or whirl.

The grooves or channels 504 increase in depth from the bottom of the cutter 501 to the geometric center C. The shape of the bottom of the grooves 504 may be any desired shape to facilitate engaging the formation chip being cut to engage the groove or channel 504, as well as to slide across through the groove or channel 504. The width of the grooves or channels 504 may be any desired width depending upon the diameter of the cutter 501 and the width of the individual groove or channel 504. In this manner, a chip being cut from a formation engages a groove or channel 504 with a greater stabilizing force as the chip moves across the diamond table 502 of the cutter 501 into the groove or channel 504, while the thickness of the diamond table 502 on the bottom of the cutter 501 is maintained to reduce the likelihood of the forces on the diamond table 502 to cause chipping, spalling or cracking of the diamond table 502 during operation of the drill bit on which the cutter 501 is installed during drilling operations.

Figure 10D:
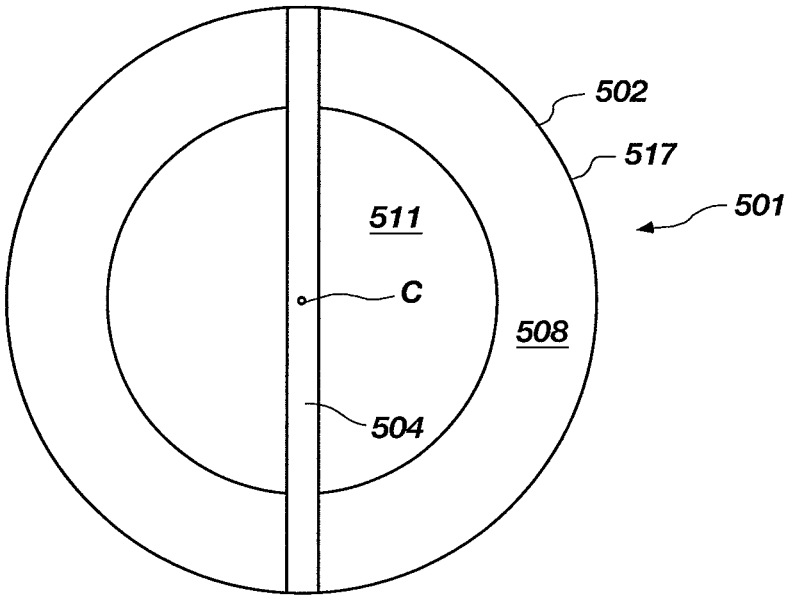
FIG. 10D is a front view of a groove or channel pattern for a cutter.

Referring to FIG. 10D, a cutter 501 is shown having a single groove or channel 504 formed on a diameter of the diamond table 502 of the cutter 501 extending across the cutter 501 through the geometric center C of the diamond table 502. The single groove or channel 504 is formed on a diameter of the diamond table 502 to add stability to the drill bit on which the cutter 501 is installed by a formation chip being cut from the formation engaging the groove or channel 504 as the chip moves across the diamond table 502 of the cutter 501 to the geometric center C of the diamond table 502. When the groove or channel 504 is formed on diameters of the cutter 501, as a chip being cut from a formation moves across the diamond table 502, the forces on the cutter 501 act about the geometric center C of the cutter 501. If the groove or channel 504 is not formed on a diameter of the cutter 501, the forces on the cutter 501 from a chip being cut from a formation moving across the diamond table 502 of the cutter 501 do not act about the geometric center C of the cutter 501 thereby causing a force imbalance on the cutter 501 and a drill bit on which the cutter 501 is installed which, in turn, may cause the drill bit to vibrate or whirl.

The groove or channel 504 increases in depth from the bottom of the cutter 501 to the geometric center C. The shape of the bottom of the grooves 504 may be any desired shape to facilitate engaging the formation chip being cut to engage the groove or channel 504, as well as to slide across through the groove or channel 504. The width of the groove or channel 504 may be any desired width depending upon the diameter of the cutter 501 and the width of the individual groove or channel 504. In this manner, a chip being cut from a formation engages a groove or channel 504 with a greater stabilizing force as the chip moves across the diamond table 502 of the cutter 501 into the groove or channel 504, while the thickness of the diamond table 502 on the bottom of the cutter 501 is maintained to reduce the likelihood of the forces on the diamond table 502 to cause chipping, spalling or cracking of the diamond table 502 during operation of the drill bit on which the cutter 301 is installed during drilling operations.

Figure 10E:
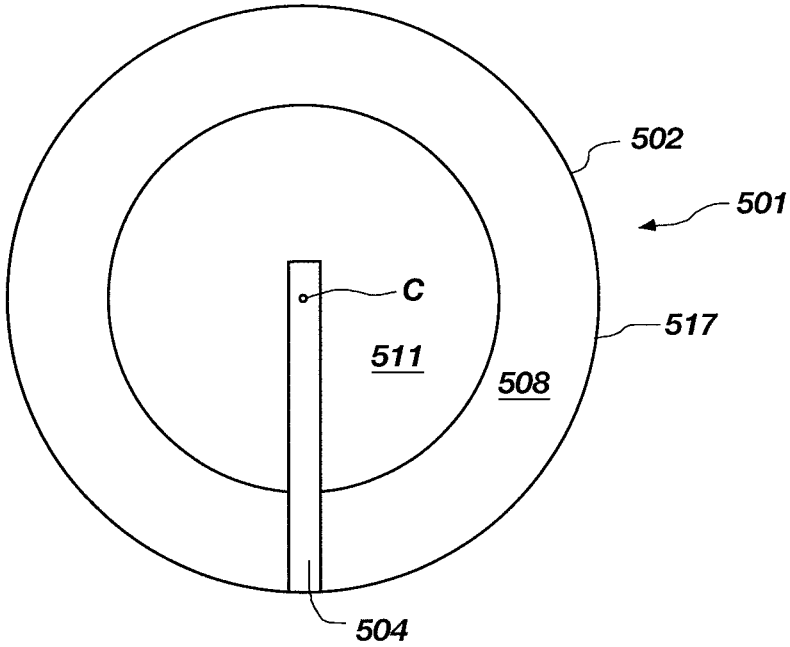
FIG. 10E is a front view of a groove or channel pattern for a cutter.

Referring to FIG. 10E, a cutter 501 is shown having a single groove or channel 504 formed on a diameter of the polycrystalline diamond table 502 of the cutter 501 terminating at approximately the geometric center C of the diamond table 502. The groove or channel 504 is formed on a diameter of the diamond table 502 to add stability to the drill bit (not depicted) on which the cutter 501 is installed upon by a formation chip being cut from the formation engaging the grooves or channels 504 as the chip moves across the diamond table 502 of the cutter 501 to the geometric center C of the diamond table 502. When the groove or channel 504 is formed on diameters of the cutter 501, as a chip being cut moves across the diamond table 502, the forces on the cutter 501 act about the geometric center C of the cutter 501. If the groove or channel 504 is not formed on a diameter of the cutter 501, the forces on the cutter 501 from a chip being cut from a formation moving across the diamond table 502 of the cutter 501 do not act about the geometric center C of the cutter 501 thereby causing a force imbalance on the cutter 501 and a drill bit on which the cutter 501 is installed which, in turn, may cause the drill bit to vibrate or whirl.

The groove or channel 501 increases in depth from the bottom of the cutter 501 to the geometric center C. The shape of the bottom of the grooves 504 may be any desired shape to facilitate engaging the formation chip being cut to engage the groove or channel 504, as well as to slide across through the groove or channel 504. The width of the grooves or channels 504 may be any desired width depending upon the diameter of the cutter 501 and the width of the individual groove or channel 504. In this manner, a chip being cut from a formation engages a groove or channel 504 with a greater stabilizing force, as the chip moves across the diamond table 502 of the cutter 501 into the groove or channel 504, while the thickness of the diamond table 502 on the bottom of the cutter 501 is maintained to reduce the likelihood of the forces on the diamond table 502 to cause chipping, spalling or cracking of the diamond table 502 during operation of the drill bit on which the cutter 301 is installed during drilling operations.

Figure 11:
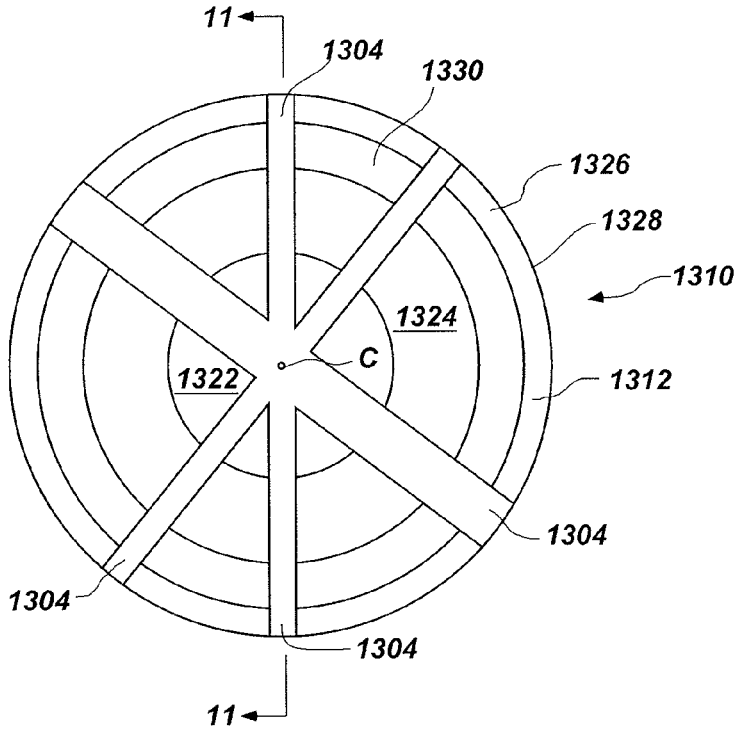
FIG. 11 is a front view of a groove or channel pattern for a cutter.

Referring to FIG. 11, a cutter 1310, of the type such as previously described hereinabove and illustrated in drawing FIG. 6, is shown having a plurality of grooves or channels 1304 formed on diameters of the polycrystalline diamond table 1312 of the cutter 1310 generally in the pattern of an X with the plurality of grooves or channels 1304 intersecting about the geometric center C of the cutter 1310 forming a common area. The grooves or channels 1304 are formed on diameters of the diamond table 1312 to add stability to the drill bit on which the cutter 1310 is installed by a formation chip being cut from the formation engaging the grooves or channels 1304 as the chip moves across the diamond table 1312 of the cutter 1310. When the grooves or channels 1304 are formed on diameters of the cutter 1310, as a chip being cut from a formation moves across the diamond table 1312, the forces on the cutter 1310 act about the geometric center C of the cutter 1310. If the grooves or channels 1304 are not formed on a diameter of the cutter 1310, the forces on the cutter 1310 from a chip being cut from a formation moving across the diamond table 1312 of the cutter 1310 do not act about the geometric center C of the cutter 1310 thereby causing a force imbalance on the cutter 1310 and a drill bit on which the cutter 1310 is installed which, in turn, may cause the drill bit to vibrate or whirl.

The grooves or channels 1304 increase in depth from a bottom of the cutter 1310 either to the geometric center C or a top thereof. The shape of the bottom of the grooves or channels 1304 may be any desired shape to facilitate engaging the formation chip being cut to engage the groove or channel 1304, as well as to slide across through the groove or channel 1304. The width of the grooves or channels 1304 may be any desired width depending upon the diameter of the cutter 1310. In this manner, a chip being cut from a formation engages a groove or channel 1304 with a greater stabilizing force as the chip moves across the diamond table 1312 of the cutter 1310, while the thickness of the diamond table 1312 on the bottom of the cutter 1310 is maintained to reduce the likelihood of the forces on the diamond table 1312 to cause chipping, spalling or cracking of the diamond table 1312 during operation of the drill bit on which the cutter 1310 is installed during drilling operations.

Figure 11A:
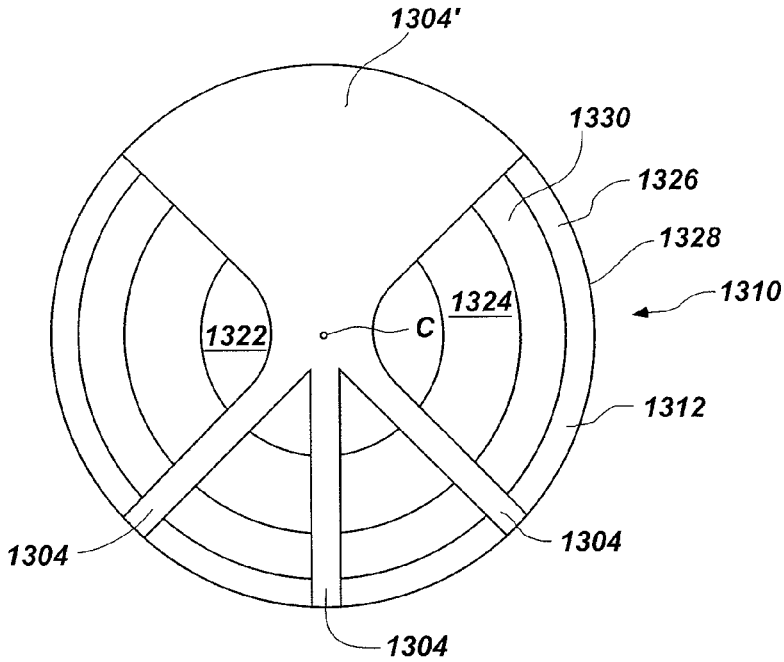
FIG. 11A is a front view of a groove or channel pattern for a cutter.
Figure 11B:
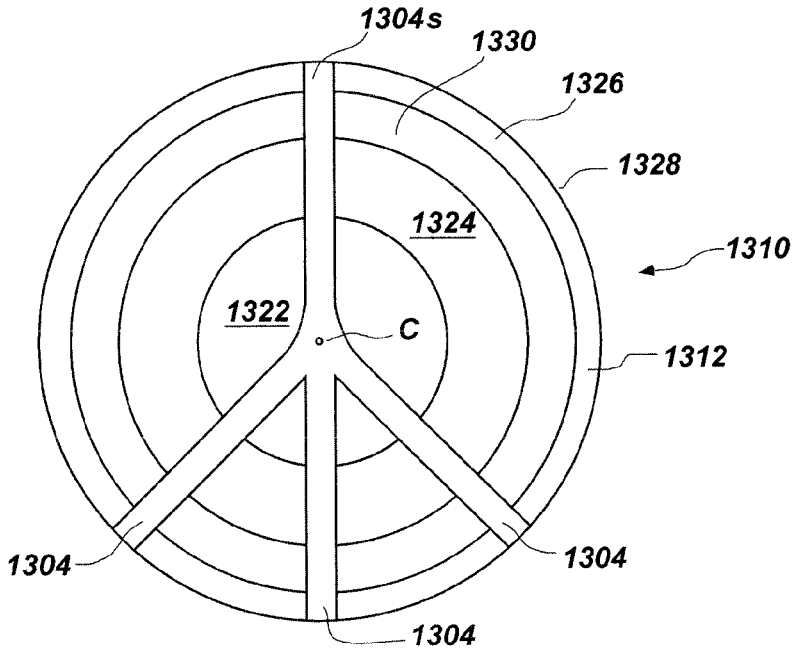
FIG. 11B is a front view of a groove or channel pattern for a cutter.

Referring to FIG. 11A, a cutter 1310 is shown having a plurality of grooves or channels 1304 formed on diameters of the diamond table 1312 of the cutter 1310 in an alternative arrangement forming a wider groove or channel 1304' on an upper portion of the diamond table 1312 of the cutter 1310. The grooves or channels 1304 are formed on diameters of the diamond table 1312 to add stability to the drill bit on which the cutter 1310 is installed by a formation chip being cut from the formation engaging the grooves or channels 1304 as the chip moves across the diamond table 1312 of the cutter 1310. When the grooves or channels 1304 are formed on diameters of the cutter 1310, as a chip being cut moves across the diamond table 1312, the forces on the cutter 1310 act about the geometric center C of the cutter 1310. If the grooves or channels 1304 are not formed on a diameter of the cutter 1310, the forces on the cutter 1310 from a chip being cut from a formation moving across the diamond table 1312 of the cutter 1310 do not act about the geometric center C of the cutter 1310 thereby causing a force imbalance on the cutter 1310 and a drill bit on which the cutter 1310 is installed which, in turn, may cause the drill bit to vibrate or whirl.

The grooves or channels 1304 increase in depth from the bottom of the cutter 1310 either to the geometric center C or the top thereof. The shape of the bottom of the grooves or channels 1304 may be any desired shape to facilitate engaging the formation chip being cut to engage the groove or channel 1304, as well as to slide across through the groove or channel 1304. The width of the grooves or channels 1304 or wider groove or channel 1304' may be any desired width depending upon the diameter of the cutter 1310 and the width of the individual groove or channel 1304. In this manner, a chip being cut from a formation engages a groove or channel 1304 with a greater stabilizing force as the chip moves across the diamond table 1312 of the cutter 1310 into the wider groove or channel 1304', while the thickness of the diamond table 1312 on the bottom of the cutter 1310 is maintained to reduce the likelihood of the forces on the diamond table 1312 to cause chipping, spalling or cracking of the diamond table 1312 during operation of the drill bit on which the cutter 1310 is installed during drilling operations.

Referring to FIG. 11 B, a cutter 1310 is shown having a plurality of grooves or channels 1304 formed on diameters of the polycrystalline diamond table 1312 of the cutter 1310 with either of the three grooves or channels 1304 converging of a single groove or channel **1304*s* on the upper portion of the diamond table 1312 of the cutter 1310. The grooves or channels 1304 are formed on diameters of the diamond table 1312 to add stability to the drill bit (not depicted) on which the cutter 1310 is installed by a formation chip being cut from the formation engaging the grooves or channels 1304 as the chip moves across the diamond table 1312 of the cutter 1310. When the grooves or channels 1304 are formed on diameters of the cutter 1310, as a chip being cut from a formation moves across the diamond table 1312, the forces on the cutter 1310 act about the geometric center C of the cutter 1310. If the grooves or channels 1304 are not formed on a diameter of the cutter 1310, the forces on the cutter 1310 from a chip being cut from a formation moving across the diamond table 1312 of the cutter 1310 do not act about the geometric center C of the cutter 1310 thereby causing a force imbalance on the cutter 1310 and a drill bit on which the cutter 1310** is installed which, in turn, may cause the drill bit to vibrate or whirl.

The grooves or channels 1304 increase in depth from the bottom of the cutter 1310 either to the geometric center C or the top thereof. The shape of the bottom of the grooves or channels 1304 may be any desired shape to facilitate engaging the formation chip being cut to engage the groove or channel 1304, as well as to slide across through the groove or channel 1304. The width of the grooves or channels 1304 or single groove or channel **1304*s* may be any desired width depending upon the diameter of the cutter 1310 and the width of the individual groove or channel 1304. In this manner, a chip being cut from a formation engages a groove or channel 1304 with a greater stabilizing force as the chip moves across the diamond table 1312 of the cutter 1310 into the groove or channel 1304, while the thickness of the diamond table 1312 on the bottom of the cutter 1310 is maintained to reduce the likelihood of the forces on the diamond table 1312 to cause chipping, spalling or cracking of the diamond table 1312 during operation of the drill bit on which the cutter 301** is installed during drilling operations.

Figure 11C:
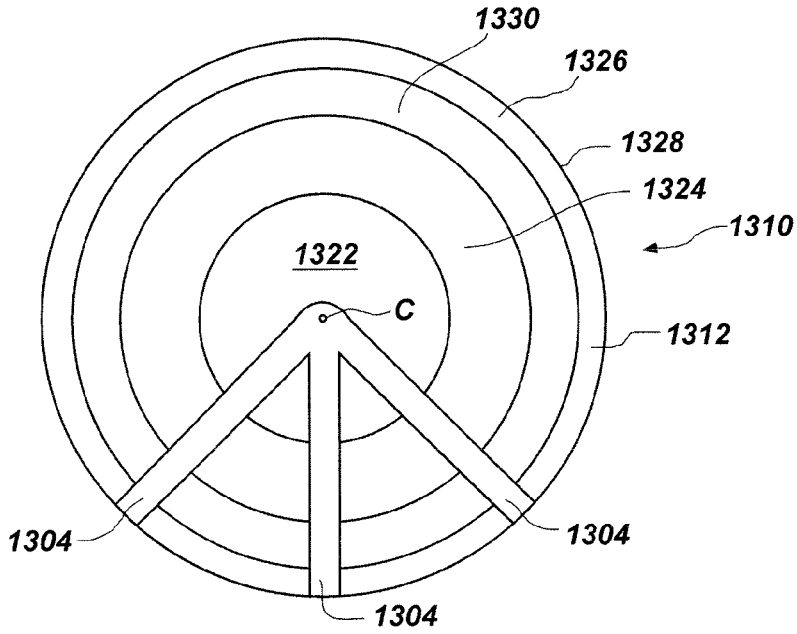
FIG. 11C is a front view of a groove or channel pattern for a cutter.

Referring to FIG. 11C, a cutter 1310 is shown having a plurality of grooves or channels 1304 formed on diameters of the polycrystalline diamond table 1312 of the cutter 1310 terminating at approximately the geometric center C of the diamond table 1312. The grooves or channels 1304 are formed on diameters of the diamond table 1312 to add stability to the drill bit (not depicted) on which the cutter 1310 is installed by a formation chip being cut from the formation engaging the grooves or channels 1304 as the chip moves across the diamond table 1312 of the cutter 1310 to the geometric center C of the diamond table 1312. When the grooves or channels 1304 are formed on diameters of the cutter 1310, as a chip being cut from a formation engages a groove or channel 1304 moves across the diamond table 1312, the forces on the cutter 1310 act about the geometric center C of the cutter 1310. If the grooves or channels 1304 are not formed on a diameter of the cutter 1310, the forces on the cutter 1310 from a chip being cut from a formation moving across the diamond table 1312 of the cutter 1310 do not act about the geometric center C of the cutter 1310 thereby causing a force imbalance on the cutter 1310 and a drill bit on which the cutter 1310 is installed which, in turn, may cause the drill bit to vibrate or whirl.

The grooves or channels 1304 increase in depth from the bottom of the cutter 1310 to the geometric center C. The shape of the bottom of the grooves or channels 1304 may be any desired shape to facilitate engaging the formation chip being cut to engage the groove or channel 1304, as well as to slide across through the groove or channel 1304. The width of the grooves or channels 1304 may be any desired width depending upon the diameter of the cutter 1310 and the width of the individual groove or channel 1304. In this manner, a chip being cut from a formation engages a groove or channel 1304 with a greater stabilizing force as the chip moves across the diamond table 1312 of the cutter 1310 into the groove or channel 1304, while the thickness of the diamond table 1312 on the bottom of the cutter 1310 is maintained to reduce the likelihood of the forces on the diamond table 1312 to cause chipping, spalling or cracking of the diamond table 1312 during operation of the drill bit on which the cutter 1310 is installed during drilling operations.

Figure 11D:
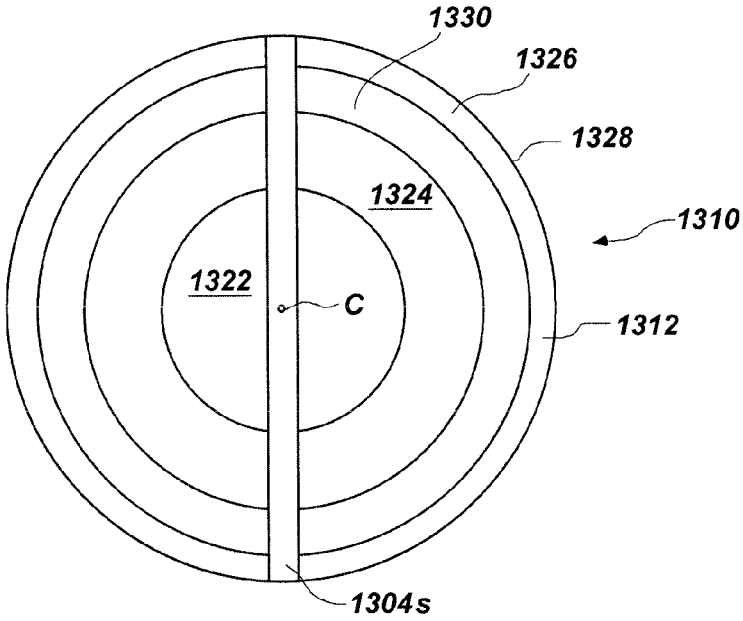
FIG. 11D is a front view of a groove or channel pattern for a cutter.

Referring to FIG. 11D, a cutter 1310 is shown having a single groove or channel 1304*s* formed on a diameter of the polycrystalline diamond table 1312 of the cutter 1310 extending across the cutter 1310 through the geometric center C of the diamond table 1312. The groove or channel 1304 is formed on a diameter of the diamond table 1312 to add stability to the drill bit (not shown) on which the cutter 1310 is installed upon by a formation chip being cut from the formation engaging the groove or channel 1304 as the chip moves across the diamond table 1312 of the cutter 1310 to the geometric center C of the diamond table 1312. When the groove or channel 1304 is formed on diameters of the cutter 1310, as a chip being cut from a formation moves across the diamond table 1312, the forces on the cutter 1310 act about the geometric center C of the cutter 1310. If the groove or channel 1304 is not formed on a diameter of the cutter 1310, the forces on the cutter 1310 from a chip being cut from a formation moving across the diamond table 1312 of the cutter 1310 do not act about the geometric center C of the cutter 1310 thereby causing a force imbalance on the cutter 1310 and a drill bit on which the cutter 1310 is installed which, in turn, may cause the drill bit to vibrate or whirl.

The groove or channel 1304 increases in depth from the bottom of the cutter 1310 to the geometric center C. The shape of the bottom of the grooves or channels 1304 may be any desired shape to facilitate engaging the formation chip being cut to engage the groove or channel 1304, as well as to slide across through the groove or channel 1304. The width of the groove or channel 1304 may be any desired width depending upon the diameter of the cutter 1310 and the width of the individual groove or channel 1304. In this manner, a chip being cut from a formation engages a groove or channel 1304 with a greater stabilizing force as the chip moves across the diamond table 1312 of the cutter 1301 into the groove or channel 1304, while the thickness of the diamond table 1312 on the bottom of the cutter 1310 is maintained to reduce the likelihood of the forces on the diamond table 1312 to cause chipping, spalling or cracking of the diamond table 1312 during operation of the drill bit on which the cutter 1301 is installed during drilling operations.

Figure 11E:
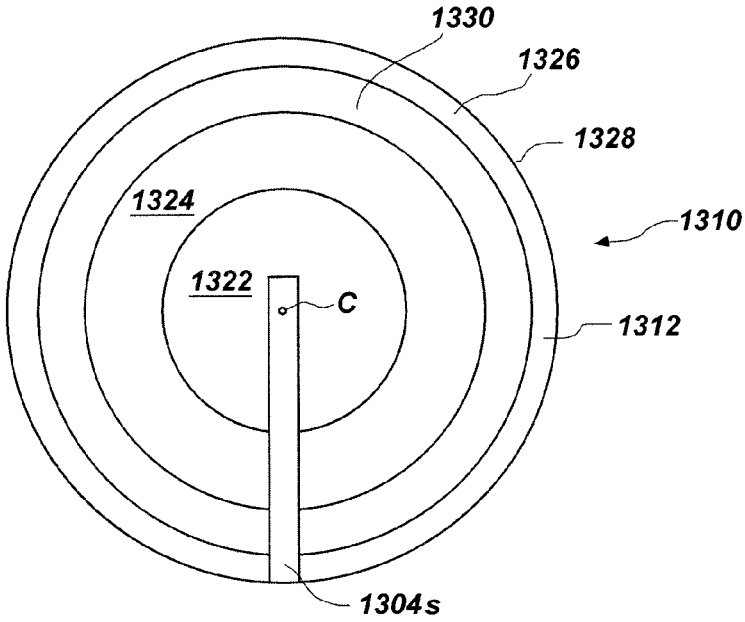
FIG. 11E is a front view of a groove or channel pattern for a cutter.

Referring to FIG. 11E, a cutter 1310 is shown having a single groove or channel 1304*s* formed on a diameter of the polycrystalline diamond table 1312 of the cutter 1310 terminating at approximately the geometric center C of the diamond table 1312. The groove or channel 1304 is formed on a diameter of the diamond table 1312 to add stability to the drill bit (not shown) on which the cutter 1310 is installed by a formation chip being cut from the formation engaging the grooves or channels 1304 as the chip moves across the diamond table 1312 of the cutter 1310 to the geometric center C of the diamond table 1312. When the groove or channel 1304 is formed on diameters of the cutter 1310, as a chip being cut moves across the diamond table 1312, the forces on the cutter 1310 act about the geometric center C of the cutter 1310. If the groove or channel 1304 is not formed on a diameter of the cutter 1310, the forces on the cutter 1310 from a chip being cut from a formation moving across the diamond table 1312 of the cutter 1310 do not act about the geometric center C of the cutter 1310 thereby causing a force imbalance on the cutter 1310 and a drill bit on which the cutter 1310 is installed which, in turn, may cause the drill bit to vibrate or whirl.

The groove or channel 1310 increases in depth from the bottom of the cutter 1310 to the geometric center C. The shape of the bottom of the grooves or channels 1304 may be any desired shape to facilitate engaging the formation chip being cut to engage the groove or channel 1304, as well as to slide across through the groove or channel 1304. The width of the groove or channel 1304 may be any desired width depending upon the diameter of the cutter 1310 and the width of the individual groove or channel 1304. In this manner, a chip being cut from a formation engages a groove or channel 1304 with a greater stabilizing force as the chip moves across the diamond table 1312 of the cutter 1310 into the groove or channel 1304, while the thickness of the diamond table 1312 on the bottom of the cutter 1310 is maintained to reduce the likelihood of the forces on the diamond table 1312 to cause chipping, spalling or cracking of the diamond table 1312 during operation of the drill bit on which the cutter 301 is installed during drilling operations.

Figure 12:
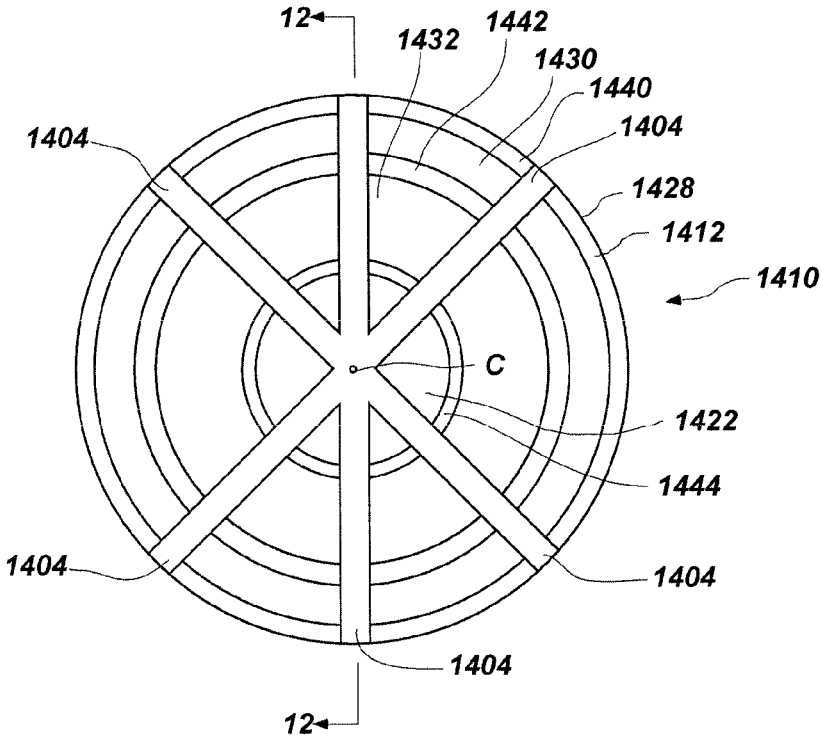
FIG. 12 is a front view of a groove or channel pattern for a cutter.

Referring to FIG. 12, a cutter 1410, of the type such as previously described hereinabove and illustrated in drawing FIG. 7, is shown having a plurality of grooves or channels 1404 formed on diameters of the polycrystalline diamond table 1412 of the cutter 1410 generally in the pattern of an X with the plurality of grooves or channels 1404 intersecting about the geometric center C of the cutter 1410 forming a common area. The grooves or channels 1404 are formed on diameters of the diamond table 1412 to add stability to the drill bit (not depicted) on which the cutter 1410 is installed by a formation chip being cut from the formation engaging the grooves or channels 1404 as the chip moves across the diamond table 1412 of the cutter 1410. When the grooves or channels 1404 are formed on diameters of the cutter 1410, as a chip being cut from a formation moves across the diamond table 1412, the forces on the cutter 1410 act about the geometric center C of the cutter 1410. If the grooves or channels 1404 are not formed on a diameter of the cutter 1410, the forces on the cutter 1410 from a chip being cut from a formation moving across the diamond table 1412 of the cutter 1410 do not act about the geometric center C of the cutter 1410 thereby causing a force imbalance on the cutter 1410 and a drill bit on which the cutter 1410 is installed which, in turn, may cause the drill bit to vibrate or whirl.

The grooves or channels 1404 increase in depth from a bottom of the cutter 1410 either to the geometric center C or a top thereof. The shape of the bottom of the grooves 1404 may be any desired shape to facilitate engaging the formation chip being cut to engage the groove or channel 1404, as well as to slide across through the groove or channel 1404. The width of the grooves or channels 1404 may be any desired width depending upon the diameter of the cutter 1410. In this manner, a chip being cut from a formation engages a groove or channel 1404 with a greater stabilizing force as the chip moves across the diamond table 1412 of the cutter 1410, while the thickness of the diamond table 1412 on the bottom of the cutter 1410 is maintained to reduce the likelihood of the forces on the diamond table 1412 to cause chipping, spalling or cracking of the diamond table 1412 during operation of the drill bit on which the cutter 1410 is installed during drilling operations.

Figure 12A:
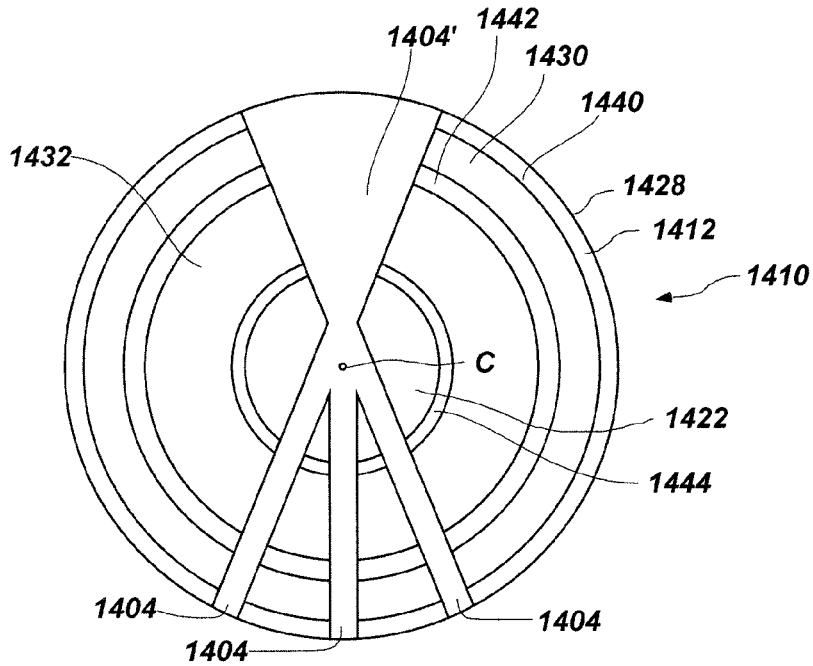
FIG. 12A is a front view of a groove or channel pattern for a cutter.

Referring to FIG. 12A, a cutter 1410 is shown having a plurality of grooves or channels 1404 formed on diameters of the polycrystalline diamond table 1412 of the cutter 1410 in an alternative arrangement forming a wider groove or channel 1404' on an upper portion of the diamond table 1412 of the cutter 1410. The grooves or channels 1404 are formed on diameters of the diamond table 1412 to add stability to the drill bit (not depicted) on which the cutter 1410 is installed by a formation chip being cut from the formation engaging the grooves or channels 1404 as the chip moves across the diamond table 1412 of the cutter 1410. When the grooves or channels 1404 are formed on diameters of the cutter 1410, as a chip being cut moves across the diamond table 1412, the forces on the cutter 1410 act about the geometric center C of the cutter 1410. If the grooves or channels 1404 are not formed on a diameter of the cutter 1410, the forces on the cutter 1410 from a chip being cut from a formation moving across the diamond table 1412 of the cutter 1410 do not act about the geometric center C of the cutter 1410 thereby causing a force imbalance on the cutter 1410 and a drill bit on which the cutter 1410 is installed which, in turn, may cause the drill bit to vibrate or whirl.

The grooves or channels 1404 increase in depth from a bottom of the cutter 1410 either to the geometric center C or a top thereof. The shape of the bottom of the grooves 1404 may be any desired shape to facilitate engaging the formation chip being cut to engage the groove or channel 1404, as well as to slide across through the groove or channel 1404. The width of the grooves or channels 1404 or wider groove or channel 1404' may be any desired width depending upon the diameter of the cutter 1410 and the width of the individual groove or channel 1404. In this manner, a chip being cut from a formation engages a groove or channel 1404 with a greater stabilizing force as the chip moves across the diamond table 1412 of the cutter 1410 into the wider groove or channel 1404', while the thickness of the diamond table 1412 on the bottom of the cutter 1410 is maintained to reduce the likelihood of the forces on the diamond table 1412 to cause chipping, spalling or cracking of the diamond table 1412 during operation of the drill bit on which the cutter 1410 is installed during drilling operations.

Figure 12B:
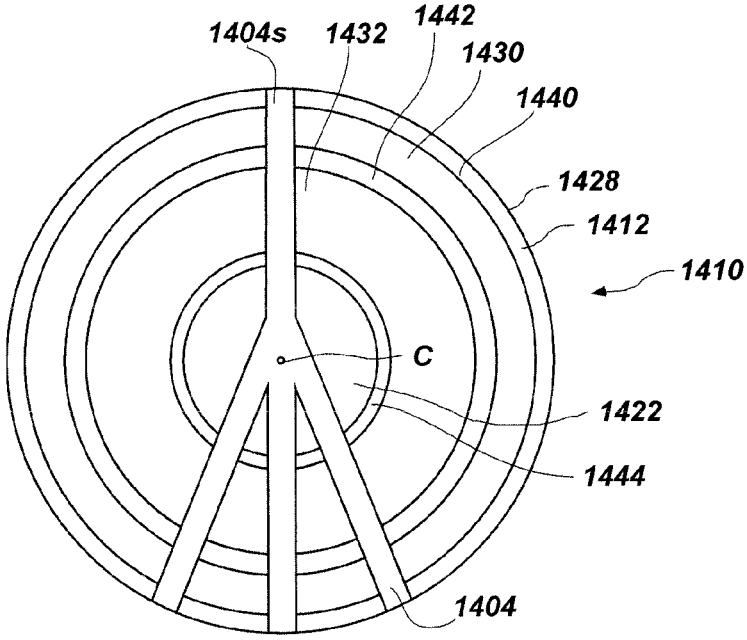
FIG. 12B is a front view of a groove or channel pattern for a cutter.

Referring to FIG. 12B, a cutter 1410 is shown having a plurality of grooves or channels 1404 formed on diameters of the polycrystalline diamond table 1412 of the cutter 1410 with either of the three grooves or channels 1404 converging on a single groove or channel 1404*s* on the upper portion of the diamond table 1412 of the cutter 1410. The grooves or channels 1404 are formed on diameters of the diamond table 1412 to add stability to the drill bit (not depicted) on which the cutter 1410 is installed upon by a formation chip being cut from the formation engaging the grooves or channels 1404 as the chip moves across the diamond table 1412 of the cutter 1410. When the grooves or channels 1404 are formed on diameters of the cutter 1410, as a chip being cut from a formation moves across the diamond table 1412, the forces on the cutter 1410 act about the geometric center C of the cutter 1410. If the grooves or channels 1404 are not formed on a diameter of the cutter 1410, the forces on the cutter 1410 from a chip being cut from a formation moving across the diamond table 1412 of the cutter 1410 do not act about the geometric center C of the cutter 1410 thereby causing a force imbalance on the cutter 1410 and a drill bit on which the cutter 1410 is installed which, in turn, may cause the drill bit to vibrate or whirl.

The grooves or channels 1404 increase in depth from the bottom of the cutter 1410 either to the geometric center C or the top thereof. The shape of the bottom of the grooves 1404 may be any desired shape to facilitate engaging the formation chip being cut to engage the groove or channel 1404, as well as to slide across through the groove or channel 1404. The width of the grooves or channels 1404 or wider groove or channel 1404' may be any desired width depending upon the diameter of the cutter 1410 and the width of the individual groove or channel 1404. In this manner, a chip being cut from a formation engages a groove or channel 1404 with a greater stabilizing force as the chip moves across the diamond table 1412 of the cutter 1410 into the wider groove or channel 1404', while the thickness of the diamond table 1412 on the bottom of the cutter 1410 is maintained to reduce the likelihood of the forces on the diamond table 1412 to cause chipping, spalling or cracking of the diamond table 1412 during operation of the drill bit on which the cutter 1410 is installed during drilling operations.

Figure 12C:
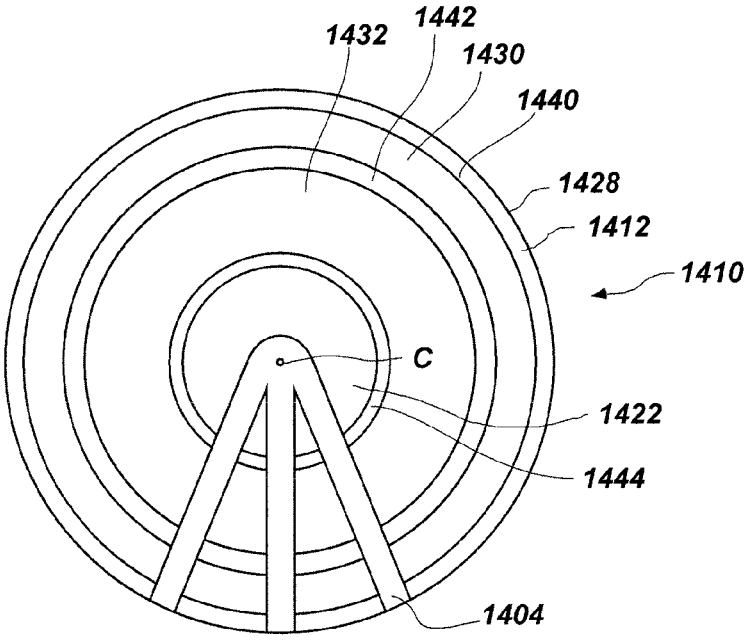
FIG. 12C is a front view of a groove or channel pattern for a cutter.

Referring to FIG. 12C, a cutter 1410 is shown having a plurality of grooves or channels 1404 formed on diameters of the polycrystalline diamond table 1412 of the cutter 1410 terminating at approximately the geometric center C of the diamond table 1412. The grooves or channels 1404 are formed on diameters of the diamond table 1412 to add stability to the drill bit (not depicted) on which the cutter 1410 is installed by a formation chip being cut from the formation engaging the grooves or channels 1404 as the chip moves across the diamond table 1412 of the cutter 1410 to the geometric center C of the diamond table 1412. When the grooves or channels 1404 are formed on diameters of the cutter 1410, as a chip being cut from a formation moves across the diamond table 1412, the forces on the cutter 1410 act about the geometric center C of the cutter 1410. If the grooves or channels 1404 are not formed on a diameter of the cutter 1410, the forces on the cutter 1410 from a chip being cut from a formation moving across the diamond table 1412 of the cutter 1410 do not act about the geometric center C of the cutter 1410 thereby causing a force imbalance on the cutter 1410 and a drill bit on which the cutter 1410 is installed which, in turn, may cause the drill bit to vibrate or whirl.

The grooves or channels 1404 increase in depth from the bottom of the cutter 1410 to the geometric center C. The shape of the bottom of the grooves 1404 may be any desired shape to facilitate engaging the formation chip being cut to engage the groove or channel 1404, as well as to slide across through the groove or channel 1404. The width of the grooves or channels 1404 may be any desired width depending upon the diameter of the cutter 1410 and the width of the individual groove or channel 1404. In this manner, a chip being cut from a formation engages a groove or channel 1404 with a greater stabilizing force as the chip moves across the diamond table 1412 of the cutter 1410 into the groove or channel 1404, while the thickness of the diamond table 1412 on the bottom of the cutter 1410 is maintained to reduce the likelihood of the forces on the diamond table 1412 to cause chipping, spalling or cracking of the diamond table 1412 during operation of the drill bit on which the cutter 1410 is installed during drilling operations.

Figure 12D:
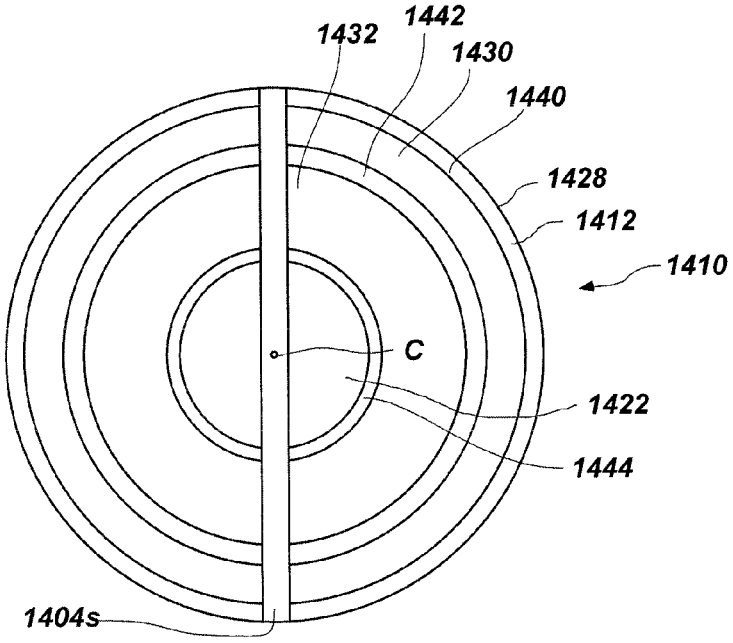
FIG. 12D is a front view of a groove or channel pattern for a cutter.

Referring to FIG. 12D, a cutter 1410 is shown having a single groove or channel 1404*s* formed on a diameter of the polycrystalline diamond table 1412 of the cutter 1410 extending across the cutter 1410 through the geometric center C of the diamond table 1412. The groove or channel 1404 is formed on a diameter of the diamond table 1412 to add stability to the drill bit (not depicted) on which the cutter 1410 is installed by a formation chip being cut from the formation engaging the groove or channel 1404, as the chip moves across the diamond table 1412 of the cutter 1410 to the geometric center C of the diamond table 1412. When the single groove or channel 1404*s* is formed on diameters of the cutter 1410, as a chip being cut from a formation moves across the diamond table 1412, the forces on the cutter 1410 act about the geometric center C of the cutter 1410. If the grooves or channels 1404 are not formed on a diameter of the cutter 1410, the forces on the cutter 1410 from a chip being cut from a formation moving across the diamond table 1412 of the cutter 1410 do not act about the geometric center C of the cutter 1410 thereby causing a force imbalance on the cutter 1410 and a drill bit on which the cutter 1410 is installed which, in turn, may cause the drill bit to vibrate or whirl.

The groove or channel 1404 increases in depth from the bottom of the cutter 1410 to the geometric center C. The shape of the bottom of the grooves 1404 may be any desired shape to facilitate engaging the formation chip being cut to engage the groove or channel 1404, as well as to slide across through the groove or channel 1404. The width of the groove or channel 1404 may be any desired width depending upon the diameter of the cutter 1410 and the width of the individual groove or channel 1404. In this manner, a chip being cut from a formation engages a groove or channel 1404 with a greater stabilizing force as the chip moves across the diamond table 1412 of the cutter 1401 into the groove or channel 1404, while the thickness of the diamond table 1412 on the bottom of the cutter 1410 is maintained to reduce the likelihood of the forces on the diamond table 1412 to cause chipping, spalling or cracking of the diamond table 1412 during operation of the drill bit on which the cutter 1410 is installed during drilling operations.

Figure 12E:
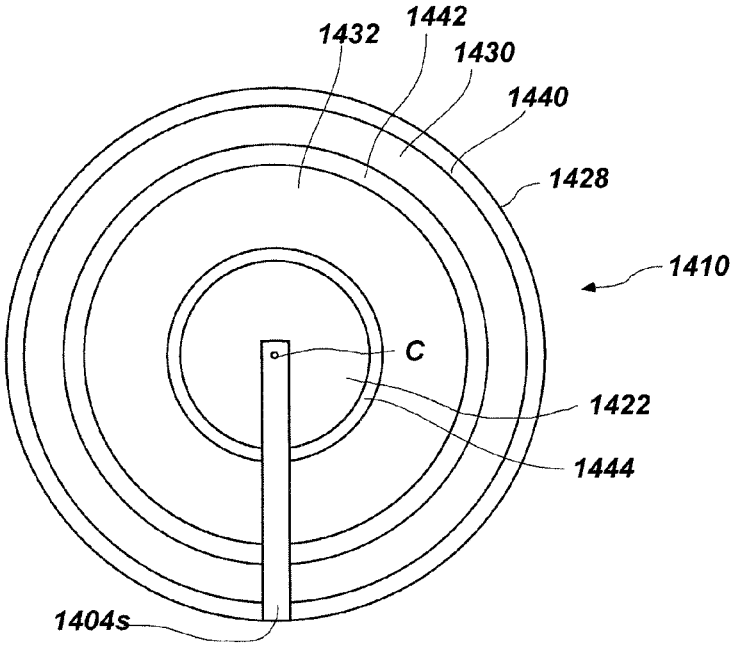
FIG. 12E is a front view of a groove or channel pattern for a cutter.

Referring to FIG. 12E, a cutter 1410 is shown having a single groove or channel 1404*s* formed on a diameter of the polycrystalline diamond table 1412 of the cutter 1410 terminating at approximately the geometric center C of the diamond table 1412. The groove or channel 1404 is formed on a diameter of the diamond table 1412 to add stability to the drill bit (not depicted) on which the cutter 1410 is installed upon by a formation chip being cut from the formation engaging the grooves or channels 1404 as the chip moves across the diamond table 1412 of the cutter 1410 to the geometric center C of the diamond table 1412. When the groove or channel 1404 is formed on diameters of the cutter 1410, as a chip being cut moves across the diamond table 1412, the forces on the cutter 1410 act about the geometric center C of the cutter 1410. If the groove or channel 1404 is not formed on a diameter of the cutter 1410, the forces on the cutter 1410 from a chip being cut from a formation moving across the diamond table 1412 of the cutter 1410 do not act about the geometric center C of the cutter 1410 thereby causing a force imbalance on the cutter 1410 and a drill bit on which the cutter 1410 is installed which, in turn, may cause the drill bit to vibrate or whirl.

The groove or channel 1410 increases in depth from the bottom of the cutter 1410 to the geometric center C. The shape of the bottom of the grooves 1404 may be any desired shape to facilitate engaging the formation chip being cut to engage the groove or channel 1404, as well as to slide across through the groove or channel 1404. The width of the groove or channel 1404 may be any desired width depending upon the diameter of the cutter 1410 and the width of the individual groove or channel 1404. In this manner, a chip being cut from a formation engages a groove or channel 1404 with a greater stabilizing force as the chip moves across the diamond table 1412 of the cutter 1410 into the groove or channel 1404, while the thickness of the diamond table 1412 on the bottom of the cutter 1410 is maintained to reduce the likelihood of the forces on the diamond table 1412 to cause chipping, spalling or cracking of the diamond table 1412 during operation of the drill bit on which the cutter 1410 is installed during drilling operations.

Figure 13:
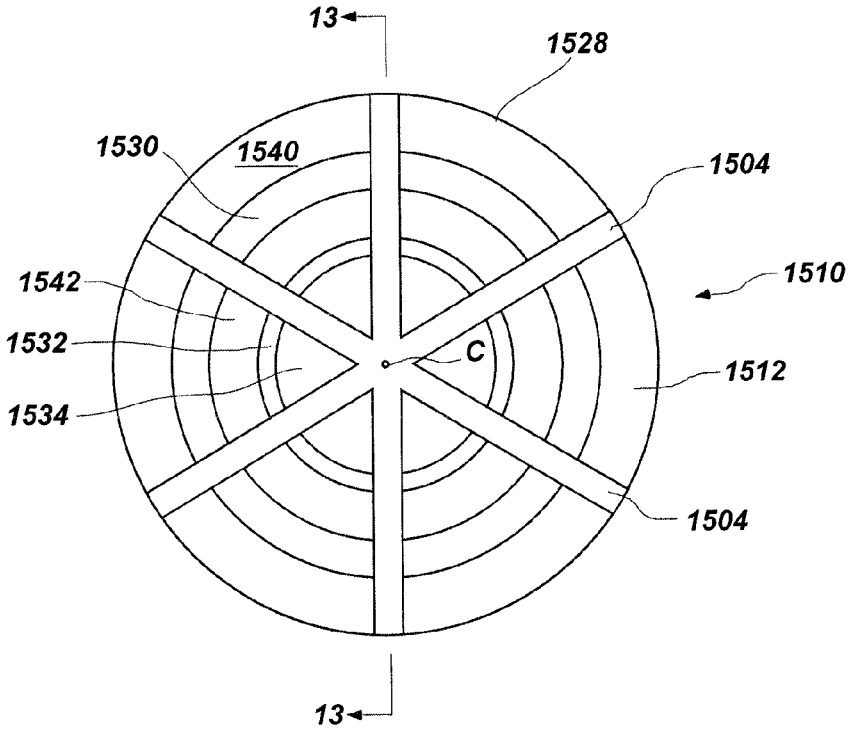
FIG. 13 is a front view of a groove or channel pattern for a cutter.

Referring to FIG. 13, a cutter 1510, of the type such as previously described hereinabove and illustrated in drawing FIG. 8, is shown having a plurality of grooves or channels 1504 formed on diameters of the diamond table 1512 of the cutter 1510 generally in the pattern of an X with the plurality of grooves or channels 1504 intersecting about the geometric center C of the cutter 1510 forming a common area. The grooves or channels 1504 are formed on diameters of the diamond table 1512 to add stability to the drill bit (not depicted) on which the cutter 1510 is installed by a formation chip being cut from the formation engaging the grooves or channels 1504 as the chip moves across the diamond table 1512 of the cutter 1510. When the grooves or channels 1504 are formed on diameters of the cutter 1510, as a chip being cut from a formation moves across the diamond table 1512, the forces on the cutter 1510 act about the geometric center C of the cutter 1510. If the grooves or channels 1504 are not formed on a diameter of the cutter 1510, the forces on the cutter 1510 from a chip being cut from a formation moving across the diamond table 1512 of the cutter 1510 do not act about the geometric center C of the cutter 1510 thereby causing a force imbalance on the cutter 1510 and a drill bit on which the cutter 1510 is installed which, in turn, may cause the drill bit to vibrate or whirl.

The grooves or channels 1504 increase in depth from a bottom of the cutter 1510 either to the geometric center C or a top thereof. The shape of the bottom of the grooves 1504 may be any desired shape to facilitate engaging the formation chip being cut to engage the groove or channel 1504, as well as to slide across through the groove or channel 1504. The width of the grooves or channels 1504 may be any desired width depending upon the diameter of the cutter 1510. In this manner, a chip being cut from a formation engages a groove or channel 1504 with a greater stabilizing force as the chip moves across the diamond table 1512 of the cutter 1510, while the thickness of the diamond table 1512 on the bottom of the cutter 1510 is maintained to reduce the likelihood of the forces on the diamond table 1512 to cause chipping, spalling or cracking of the diamond table 1512 during operation of the drill bit on which the cutter 1510 is installed during drilling operations.

Figure 13A:
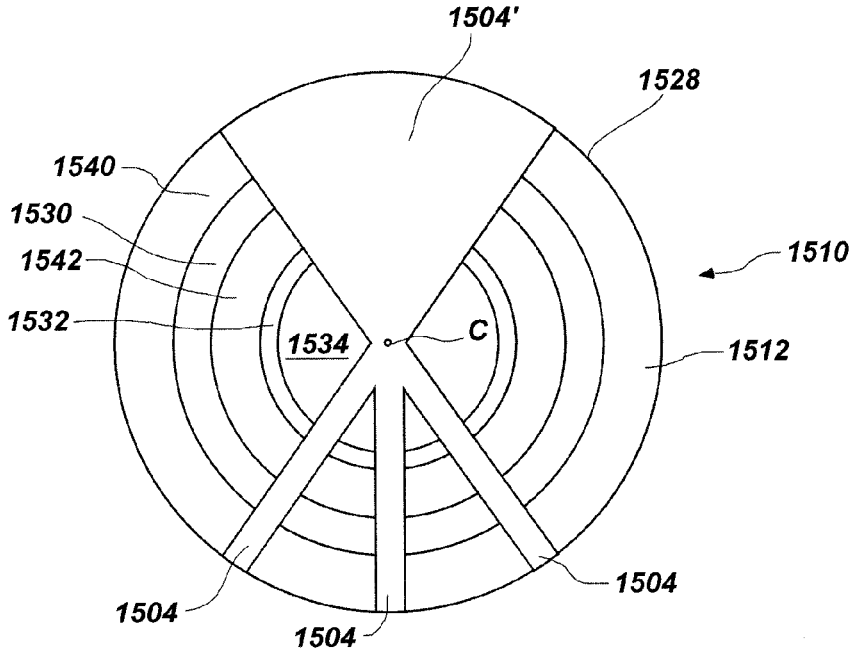
FIG. 13A is a front view of a groove or channel pattern for a cutter.

Referring to FIG. 13A, a cutter 1510 is shown having a plurality of grooves or channels 1504 formed on diameters of the diamond table 1512 of the cutter 1510 in an alternative arrangement forming a wider groove or channel 1504' on an upper portion of a diamond table 1512 of the cutter 1510. The grooves or channels 1504 are formed on diameters of the diamond table 1512 to add stability to the drill bit on which the cutter 1510 is installed by a formation chip being cut from the formation engaging the grooves or channels 1504 as the chip moves across the diamond table 1512 of the cutter 1510. When the grooves or channels 1504 are formed on diameters of the cutter 1510, as a chip being cut moves across the diamond table 1512, the forces on the cutter 1510 act about the geometric center C of the cutter 1510. If the grooves or channels 1504 are not formed on a diameter of the cutter 1510, the forces on the cutter 1510 from a chip being cut from a formation moving across the diamond table 1512 of the cutter 1510 do not act about the geometric center C of the cutter 1510 thereby causing a force imbalance on the cutter 1510 and a drill bit on which the cutter 1510 is installed which, in turn, may cause the drill bit to vibrate or whirl.

The grooves or channels 1504 increase in depth from a bottom of the cutter 1510 either to the geometric center C of the cutter 1510 or a top thereof. The shape of the bottom of the grooves or channels 1504 may be any desired shape to facilitate engaging the formation chip being cut to engage the groove or channel 1504, as well as to slide across through the groove or channel 1504. The width of the grooves or channels 1504 or wider groove or channel 1504' may be any desired width depending upon the diameter of the cutter 1510 and the width of the individual groove or channel 1504. In this manner, a chip being cut from a formation engages a groove or channel 1504 with a greater stabilizing force as the chip moves across the diamond table 1512 of the cutter 1510 into the wider groove or channel 1504', while the thickness of the diamond table 1512 on the bottom of the cutter 1510 is maintained to reduce the likelihood of the forces on the diamond table 1512 to cause chipping, spalling or cracking of the diamond table 1512 during operation of the drill bit on which the cutter 1510 is installed during drilling operations.

Figure 13B:
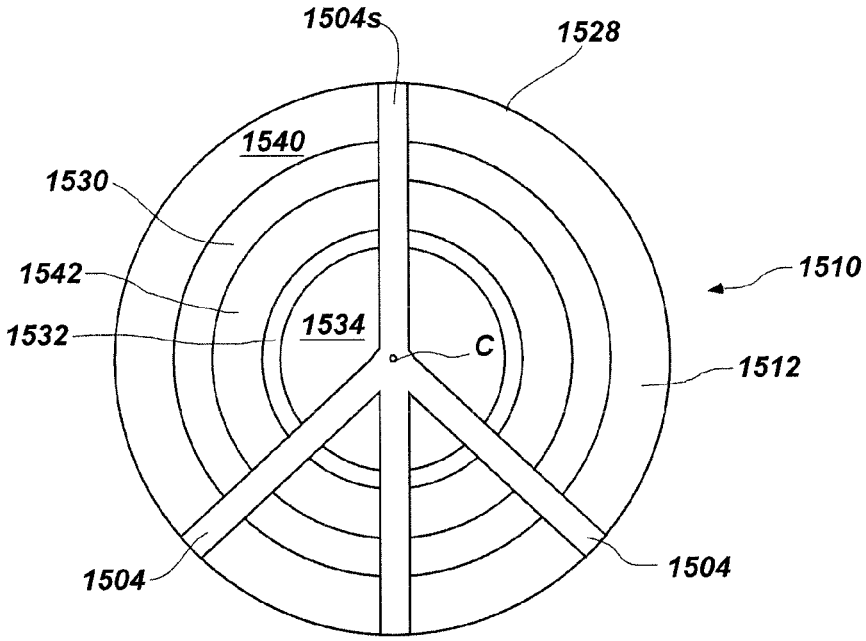
FIG. 13B is a front view of a groove or channel pattern for a cutter.

Referring to FIG. 13B, a cutter 1510 is shown having a plurality of grooves or channels 1504 formed on diameters of the diamond table 1512 of the cutter 1510 with either of the three grooves or channels 1504 converging of a single groove or channel 1504*s* on an upper portion of the diamond table 1512 of the cutter 1510. The grooves or channels 1504 are formed on diameters of the diamond table 1512 to add stability to the drill bit on which the cutter 1510 is installed by a formation chip being cut from the formation engaging the grooves or channels 1504 as the chip moves across the diamond table 1512 of the cutter 1510. When the grooves or channels 1504 are formed on diameters of the cutter 1510, as a chip being cut from a formation moves across the diamond table 1512, the forces on the cutter 1510 act about the geometric center C of the cutter 1510. If the grooves or channels 1504 are not formed on a diameter of the cutter 1510, the forces on the cutter 1510 from a chip being cut from a formation moving across the diamond table 1512 of the cutter 1510 do not act about the geometric center C of the cutter 1510 thereby causing a force imbalance on the cutter 1510 and a drill bit on which the cutter 1510 is installed which, in turn, may cause the drill bit to vibrate or whirl.

The grooves or channels 1504 increase in depth from the bottom of the cutter 1510 either to the geometric center C or the top thereof. The shape of the bottom of the grooves 1504 may be any desired shape to facilitate engaging the formation chip being cut to engage the groove or channel 1504, as well as to slide across through the groove or channel 1504. The width of the grooves or channels 1504 or single groove or channel 1504*s* may be any desired width depending upon the diameter of the cutter 1510 and the width of the individual groove or channel 1504. In this manner, a chip being cut from a formation engages a groove or channel 1504 with a greater stabilizing force as the chip moves across the diamond table 1512 of the cutter 1510 into the single groove or channel 1504*s*, while the thickness of the diamond table 1512 on the bottom of the cutter 1510 is maintained to reduce the likelihood of the forces on the diamond table 1512 to cause chipping, spalling or cracking of the diamond table 1512 during operation of the drill bit on which the cutter 1510 is installed during drilling operations.

Figure 13C:
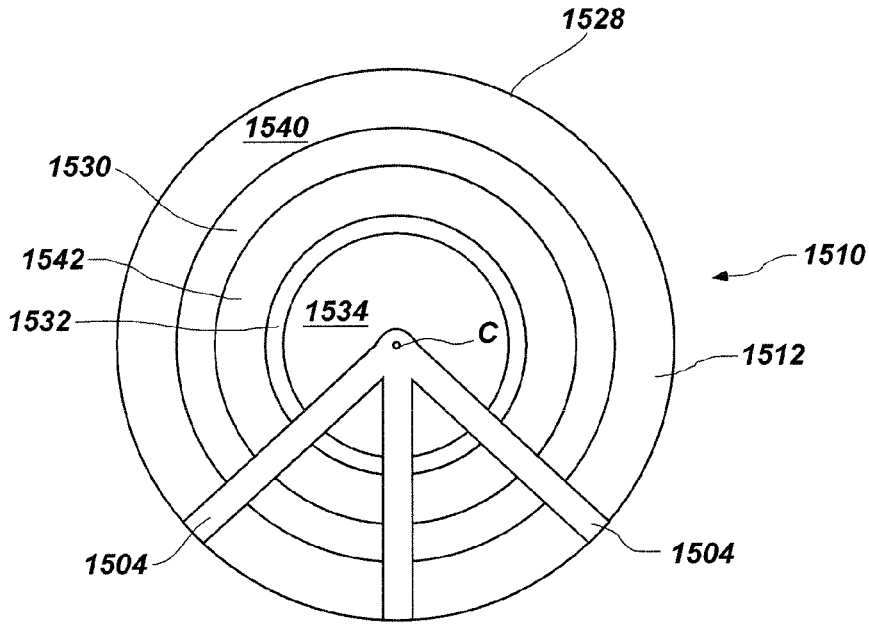
FIG. 13C is a front view of a groove or channel pattern for a cutter.

Referring to FIG. 13C, a cutter 1510 is shown having a plurality of grooves or channels 1504 formed on diameters of the diamond table 1512 of the cutter 1510 terminating at approximately the geometric center C of the diamond table 1512. The grooves or channels 1504 are formed on diameters of the diamond table 1512 to add stability to the drill bit (not depicted) on which the cutter 1510 is installed by a formation chip being cut from the formation engaging the grooves or channels 1504 as the chip moves across the diamond table 1512 of the cutter 1510 to the geometric center C of the diamond table 1512. When the grooves or channels 1504 are formed on diameters of the cutter 1510, as a chip being cut from a formation moves across the diamond table 1512, the forces on the cutter 1510 act about the geometric center C of the cutter 1510. If the grooves or channels 1504 are not formed on a diameter of the cutter 1510, the forces on the cutter 1510 from a chip being cut from a formation moving across the diamond table 1512 of the cutter 1510 do not act about the geometric center C of the cutter 1510 thereby causing a force imbalance on the cutter 1510 and a drill bit on which the cutter 1510 is installed which, in turn, may cause the drill bit to vibrate or whirl.

The grooves or channels 1504 increase in depth from the bottom of the cutter 1510 to the geometric center C. The shape of the bottom of the grooves 1504 may be any desired shape to facilitate engaging the formation chip being cut to engage the groove or channel 1504, as well as to slide across through the groove or channel 1504. The width of the grooves or channels 1504 may be any desired width depending upon the diameter of the cutter 1510 and the width of the individual groove or channel 1504. In this manner, a chip being cut from a formation engages a groove or channel 1504 with a greater stabilizing force as the chip moves across the diamond table 1512 of the cutter 1510 into the groove or channel 1504, while the thickness of the diamond table 1512 on the bottom of the cutter 1510 is maintained to reduce the likelihood of the forces on the diamond table 1512 to cause chipping, spalling or cracking of the diamond table 1512 during operation of the drill bit on which the cutter 1510 is installed during drilling operations.

Figure 13D:
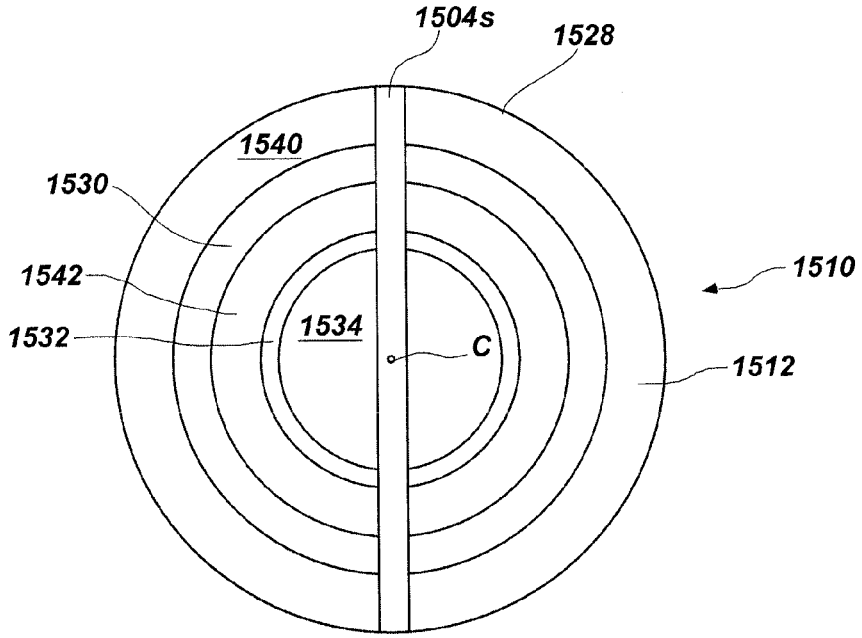
FIG. 13D is a front view of a groove or channel pattern for a cutter.

Referring to FIG. 13D, a cutter 1510 is shown having a single groove or channel 1504*s* formed on a diameter of the diamond table 1512 of the cutter 1510 extending across the cutter 1510 through the geometric center C of the diamond table 1512. The groove or channel 1504 is formed on a diameter of the polycrystalline diamond table 1512 to add stability to the drill bit (not depicted) on which the cutter 1510 is installed by a formation chip being cut from the formation engaging the groove or channel 1504 as the chip moves across the diamond table 1512 of the cutter 1510 to the geometric center C of the diamond table 1512. When the groove or channel 1504 is formed on diameters of the cutter 1510, as a chip being cut from a formation moves across the diamond table 1512, the forces on the cutter 1510 act about the geometric center C of the cutter 1510. If the grooves or channels 1504 are not formed on a diameter of the cutter 1510, the forces on the cutter 1510 from a chip being cut from a formation moving across the diamond table 1512 of the cutter 1510 do not act about the geometric center C of the cutter 1510 thereby causing a force imbalance on the cutter 1510 and a drill bit on which the cutter 1510 is installed which, in turn, may cause the drill bit to vibrate or whirl.

The groove or channel 1504 increases in depth from the bottom of the cutter 1510 to the geometric center C. The shape of the bottom of the grooves 1504 may be any desired shape to facilitate engaging the formation chip being cut to engage the groove or channel 1504, as well as to slide across through the groove or channel 1504. The width of the groove or channel 1504 may be any desired width depending upon the diameter of the cutter 1510 and the width of the individual groove or channel 1504. In this manner, a chip being cut from a formation engages a groove or channel 1504 with a greater stabilizing force as the chip moves across the diamond table 1512 of the cutter 1501 into the groove or channel 1504, while the thickness of the diamond table 1512 on the bottom of the cutter 1510 is maintained to reduce the likelihood of the forces on the diamond table 1512 to cause chipping, spalling or cracking of the diamond table 1512 during operation of the drill bit on which the cutter 1510 is installed during drilling operations.

Figure 13E:
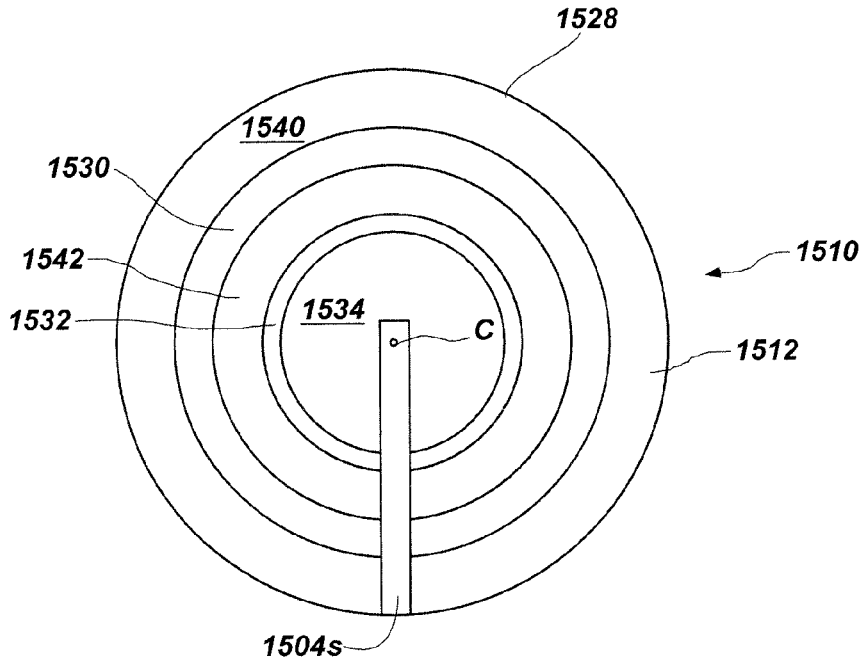
FIG. 13E is a front view of a groove or channel pattern for a cutter.

Referring to FIG. 13E, a cutter 1510 is shown having a single groove or channel 1504*s* formed on a diameter of the diamond table 1512 of the cutter 1510 terminating at approximately the geometric center C of the diamond table 1512. The groove or channel 1504 is formed on a diameter of the diamond table 1512 to add stability to the drill bit (not depicted) on which the cutter 1510 is installed by a formation chip being cut from the formation engaging the grooves or channels 1504 as the chip moves across the diamond table 1512 of the cutter 1510 to the geometric center C of the diamond table 1512. When the groove or channel 1504 is formed on diameters of the cutter 1510, as a chip being cut moves across the diamond table 1512, the forces on the cutter 1510 act about the geometric center C of the cutter 1510. If the groove or channel 1504 is not formed on a diameter of the cutter 1510, the forces on the cutter 1510 from a chip being cut from a formation moving across the diamond table 1512 of the cutter 1510 do not act about the geometric center C of the cutter 1510 thereby causing a force imbalance on the cutter 1510 and a drill bit on which the cutter 1510 is installed which, in turn, may cause the drill bit to vibrate or whirl.

The groove or channel 1510 increases in depth from the bottom of the cutter 1510 to the geometric center C. The shape of the bottom of the grooves 1504 may be any desired shape to facilitate engaging the formation chip being cut to engage the groove or channel 1504, as well as to slide across through the groove or channel 1504. The width of the groove or channel 1504 may be any desired width depending upon the diameter of the cutter 1510 and the width of the individual groove or channel 1504. In this manner, a chip being cut from a formation engages a groove or channel 1504 with a greater stabilizing force as the chip moves across the diamond table 1512 of the cutter 1510 into the groove or channel 1504, while the thickness of the diamond table 1512 on the bottom of the cutter 1510 is maintained to reduce the likelihood of the forces on the diamond table 1512 to cause chipping, spalling or cracking of the diamond table 1512 during operation of the drill bit on which the cutter 1510 is installed during drilling operations.

Figure 14:
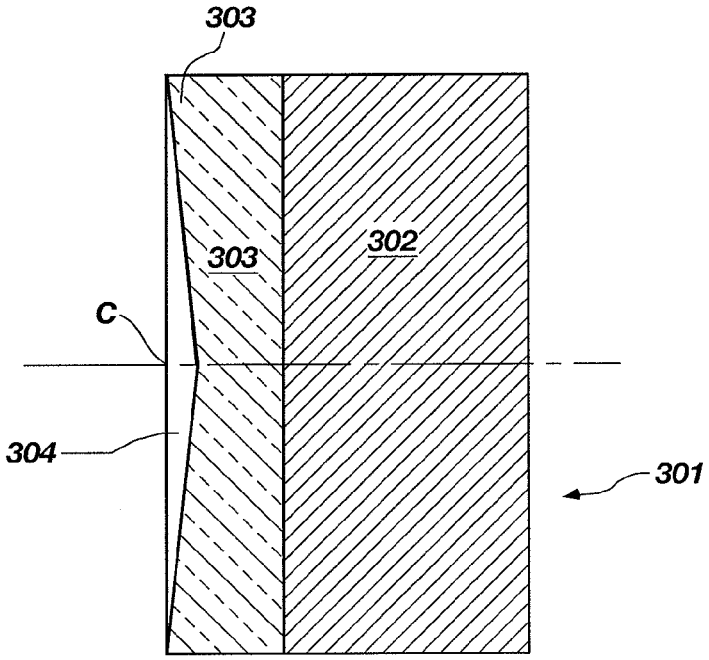
FIG. 14 is a cross-sectional view of a cutter.

Referring to FIG. 14, a cutter 301 of the type illustrated in FIG. 3 and as modified to the configuration shown in FIG. 9 is shown in cross-section along section line 9-9 of drawing FIG. 9. The groove or channel 304 increases in depth from the bottom of the cutter 301 to the geometric center C thereof and decreases in depth from the geometric center C of the cutter 301 to the top thereof in the diamond table 303 of the cutter 301.

Figure 15:
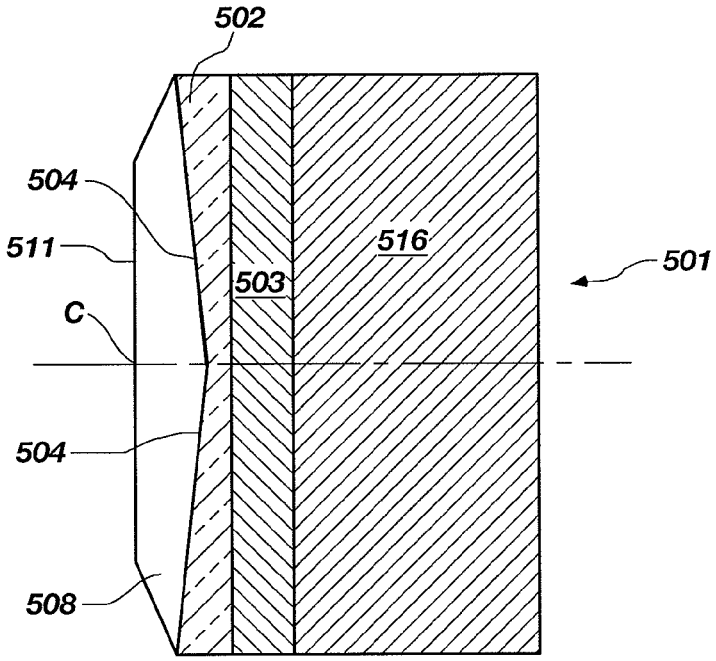
FIG. 15 is a cross-sectional view of a cutter.

Referring to FIG. 15, the cutter 501 of the type illustrated in FIGS. 5*a*-5*d* and as modified to the configuration shown in FIG. 10 is shown in cross-section along section line 10-10 of drawing FIG. 10. The groove or channel 504 increases in depth from the bottom of the cutter 501 to the geometric center C thereof and decreases in depth from the geometric center C of the cutter 501 to the top thereof in the diamond table 502 of the cutter 501.

Figure 16:
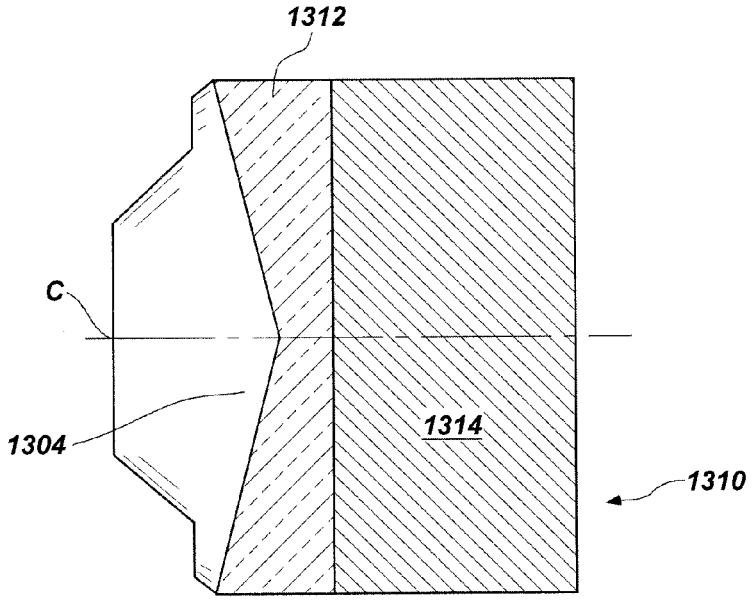
FIG. 16 is a cross-sectional view of a cutter.

Referring to FIG. 16, the cutter 1310 of the type illustrated in FIG. 6 and as modified to the configuration shown in FIG. 11 is shown in cross-section along section line 11-11 of drawing FIG. 11. The groove or channel 1304 increases in depth from the bottom of the cutter 1310 to the geometric center C thereof and decreases in depth from the geometric center C of the cutter 1310 to the top thereof in the diamond table 1312 of the cutter 1310.

Figure 17:
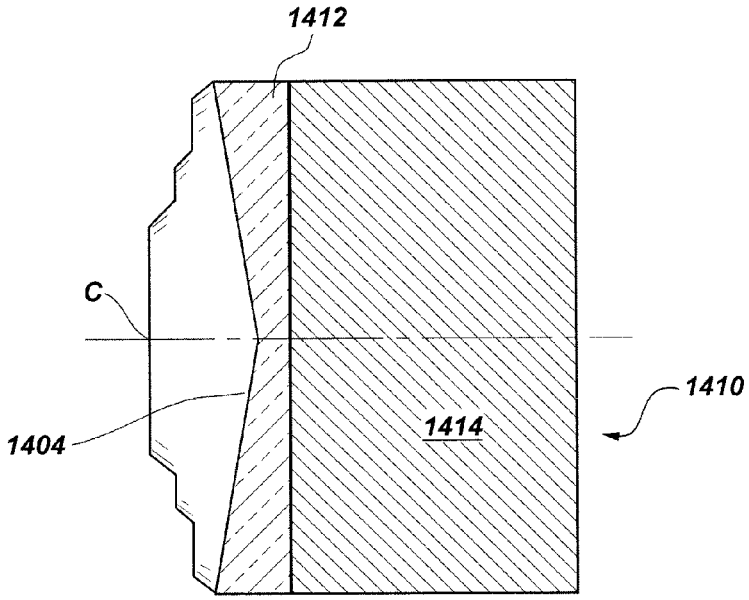
FIG. 17 is a cross-sectional view of a cutter.

Referring to FIG. 17, the cutter 1410 of the type illustrated in FIG. 7 and as modified to the configuration shown in FIG. 12 is shown in cross-section along section line 12-12 of drawing FIG. 12. The groove or channel 1404 increases in depth from the bottom of the cutter 1410 to the geometric center C thereof and decreases in depth from the geometric center C of the cutter 1410 to the top thereof in the diamond table 1412 of the cutter 1410.

Figure 18:
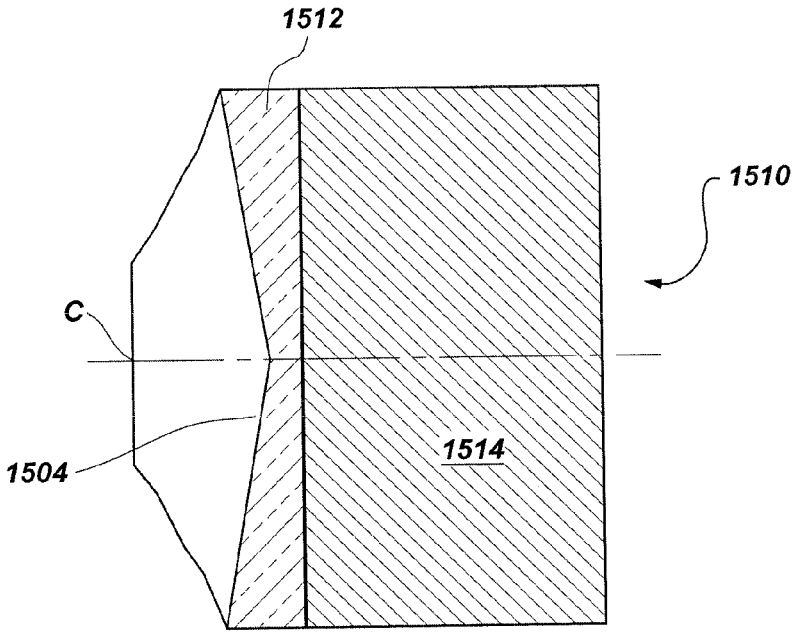
FIG. 18 is a cross-sectional view of a cutter.

Referring to FIG. 18, the cutter 1510 of the type illustrated in FIG. 8 and modified as shown in FIG. 13 is shown in cross-section along section line 13-13 of drawing FIG. 13. The groove or channel 1504 increases in depth from the bottom of the cutter 1510 to the geometric center C thereof and decreases in depth from the geometric center C of the cutter 1510 to the top thereof in the diamond table 1512 of the cutter 1510.

Figure 19:
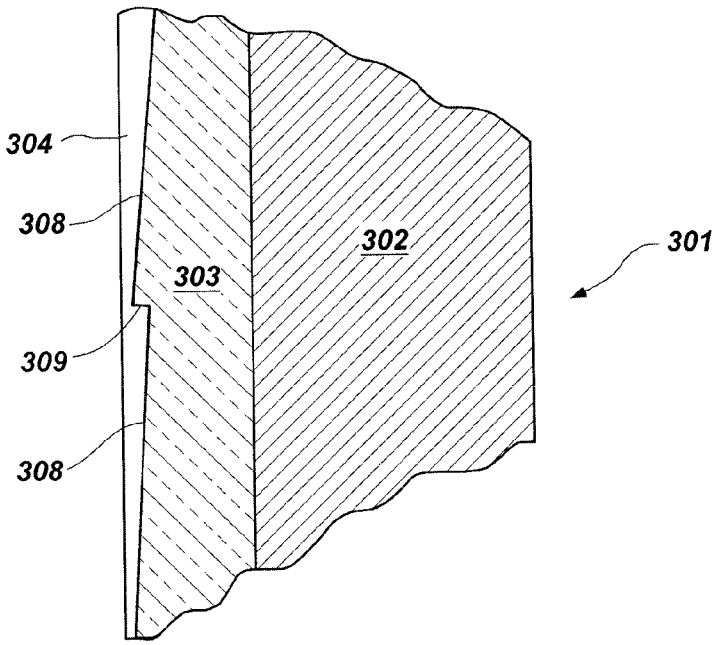
FIG. 19 is a partial cross-sectional view of a cutter.

Referring to FIG. 19, a portion of a cutter 301 of the type illustrated in FIG. 3 is shown having a bottom 308 of the groove or channel 304 formed in the diamond table 303 formed having a step 309 located therein. While illustrated with respect to a cutter 301, the shape of the bottom 308 of the groove 304 in the cutter 301 may be used in any cutter described herein as a matter of design depending upon the characteristics of the formations to be drilled by a drill bit having the cutter 301 thereon.

Figure 20:
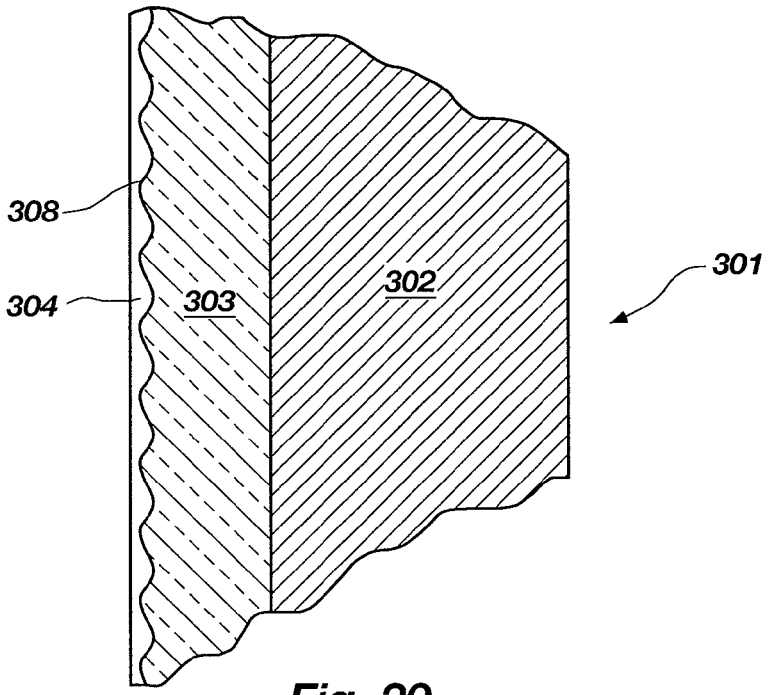
FIG. 20 is a partial cross-sectional view of a cutter.

Referring to FIG. 20, a portion of a cutter 301 of the type illustrated in FIG. 3 is shown having the bottom 308 of the groove or channel 304 formed in the diamond table 303 formed having a serpentine shape or waved shape. While illustrated with respect to a cutter 301, the shape of the bottom 308 of the groove 304 in the cutter 301 may be used in any cutter described herein as a matter of design depending upon the characteristics of the formations to be drilled by a drill bit having the cutter 301 thereon.

Figure 21:
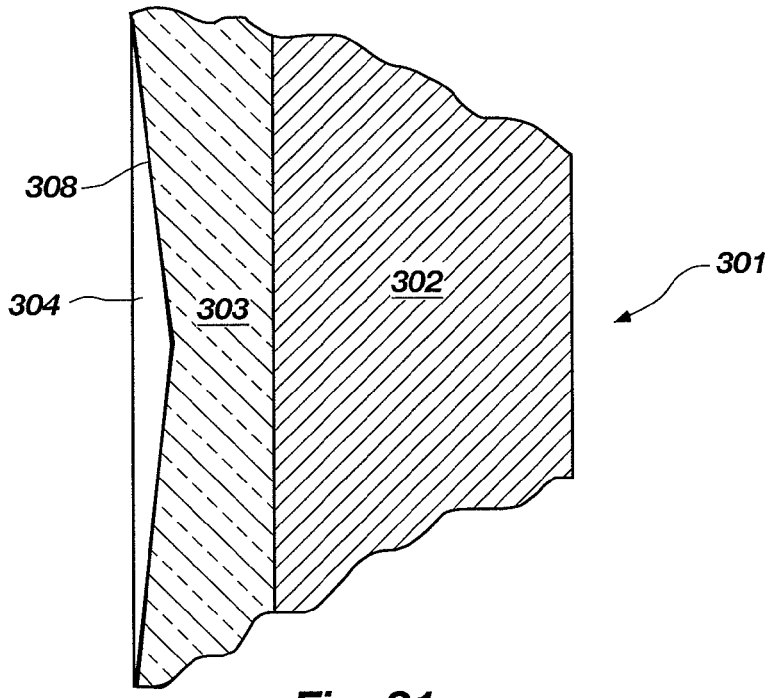
FIG. 21 is a partial cross-sectional view of a cutter.

Referring to FIG. 21, a portion of a cutter 301 of the type illustrated in FIG. 3 is shown having the bottom 308 of the groove or channel 304 formed in the diamond table 303 formed having a V-shape formed therein. While illustrated with respect to a cutter 301, the shape of the bottom 308 of the groove 304 in the cutter 301 may be used in any cutter described herein as a matter of design depending upon the characteristics of the formations to be drilled by a drill bit having the cutter 301 thereon.

Figure 22:
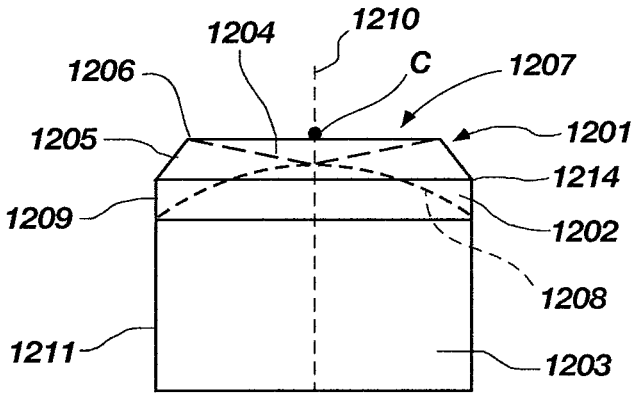
FIG. 22 is a partial cross-sectional view of a cutter.

Referring to FIG. 22, another embodiment of a cutter 1201 of the type depicted in FIG. 5*e* is shown, which embodiment which may be used as a cutter having a groove or channel in the diamond table thereof of the present invention to improve the stability of a drill bit (not depicted) that the cutter 1201 is used thereon to help prevent vibration and whirl of the drill bit. The cutter 1201 has a diamond table 1202 atop a substrate 1203. The substrate 1203 is radiused or forms a dome 1208, as shown by dashed lines, beneath the diamond table 1202. The diamond table 1202 has a sidewall 1209 that is shown as being generally parallel to the sidewall 1211 of the substrate 1203 and to the longitudinal axis 1210 of the cutter 1201, but which could be angled otherwise. The diamond table 1202 also includes a cutting edge 1214, a rake land 1205 and a central cutting face area 1207. The central cutting face area 1207 is that portion of the proximal end of the diamond table 1202 within the inner boundary 1206 of the rake land 1205. The diamond table 1202 is shown having a groove or channel 1204, as shown by dashed line, formed therein increasing in depth from the inner boundary 1206 of the rake land 1205 to the center C of the cutter 1201, which is located on the longitudinal axis 1210 of the cutter 1201.

While the present invention has been described and illustrated in conjunction with a number of specific embodiments, those skilled in the art will appreciate that variations and modifications may be made without departing from the principles of the invention as herein illustrated, described and claimed. The grooves or channels in the cutting faces of the cutting elements may reach maximum depth at any desired location on the cutting face, may be of any desired width, may be of any desired shape, may be of any desired depth at any point of the cutting face, may be of any desired configuration, may have any desired shape on the bottom thereof, etc. Cutting elements according to one or more of the disclosed embodiments may be employed in combination with cutting elements of the same or other disclosed embodiments, or with conventional cutting elements, in paired or other groupings, including but not limited to, side-by-side and leading/trailing combinations of various configurations. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A cutting element for use in drilling subterranean formations, comprising:

a substantially cylindrical substrate;

a volume of superabrasive material mounted to an end of the substrate and including:

a cutting face configured for use on a drag bit, the cutting face comprising at least one planar portion extending in two dimensions generally transverse to a longitudinal axis of the cutting element;

a rear boundary adjacent the substrate;

only one or more grooves in the cutting face, all of the one or more grooves in the cutting face extending along at least a portion of a diameter of the cutting face and having substantially parallel sidewalls, all of the one or more grooves in the cutting face beginning at a lateral periphery of the cutting face and extending across the at least one planar portion of the cutting face at least as far as a geometric center point of the cutting face; and wherein there are no grooves in the cutting face that do not extend across the at least one planar portion at least as far as the geometric center point of the cutting face.

2. The cutting element of claim 1, wherein the one or more grooves comprise a plurality of grooves, wherein all of the one or more grooves in the cutting face intersect proximate the geometric center point of the cutting face.

3. The cutting element of claim 1, wherein the one or more grooves comprise at least one groove having a floor comprising at least one portion sloping toward the geometric center of the cutting face at a non-perpendicular angle to the longitudinal axis of the cutting element, a maximum depth at the geometric center point of the cutting face and a lesser depth at the lateral periphery of the cutting face.

4. The cutting element of claim 1, wherein the one or more grooves comprise a groove having a floor sloping at a non-perpendicular angle to the longitudinal axis of the cutting element and a maximum depth at approximately an opposite side of the lateral periphery of the cutting face greater than a depth at the beginning of the at least one groove.

5. The cutting element of claim 1, wherein the one or more grooves comprise at least one groove having a floor comprising at least one portion sloping toward the geometric center point of the cutting face at a non-perpendicular angle to the longitudinal axis of the cutting element, a maximum depth between opposing sides of the lateral periphery of the cutting face and greater than a depth at the opposing sides of the lateral periphery of the cutting face.

6. The cutting element of claim 1, wherein the one or more grooves include at least one groove extending completely across a diameter of the cutting face.

7. The cutting element of claim 1, wherein the one or more grooves comprise a plurality of grooves, all of the one or more grooves in the cutting face located on and extending completely across a diameter of the cutting face.

8. The cutting element of claim 1, wherein the one or more grooves include a plurality of grooves, all of the one or more grooves in the cutting face located on a diameter of the cutting face beginning at the periphery of the cutting face, and further including a rib raised above or inset into the cutting face and extending parallel to and along at least one longitudinal side wall of at least a portion of at least one groove of the plurality of grooves.

9. The cutting element of claim 8, wherein the rib comprises material selected from the group consisting of diamond material, polycrystalline diamond material, tungsten carbide material, cubic boron nitride material, leached polycrystalline diamond material, cobalt, and any combinations thereof.

10. A cutting element for use on a bit for drilling subterranean formations, comprising:

a substrate;

a volume of diamond material mounted to an end of the substrate and including:

a cutting face configured for use on a drag bit, the cutting face comprising at least one planar portion extending in two dimensions generally transverse to a longitudinal axis of the cutting element, the cutting face having at least another portion located at a non-perpendicular angle with respect to the longitudinal axis of the cutting element;

a rear boundary adjacent the substrate;

only one or more grooves in the cutting face, all of the one and more grooves in the cutting face extending along at least a portion of a diameter of the cutting face and having substantially parallel side walls, all of the one or more grooves in the cutting face extending from a cutting edge at a lateral periphery of the cutting face and extending across the at least one planar portion and the at least another portion of the cutting face at least as far as a geometric center point of the cutting face; and wherein there are no grooves in the cutting face that do not extend across the at least one planar portion at least as far as the geometric center point of the cutting face.

11. The cutting element of claim 10, wherein the one or more grooves in the cutting face comprise a plurality of grooves, all of the one or more grooves in the cutting face located on diameters of the cutting face.

12. The cutting element of claim 10, wherein the one or more grooves comprise at least one groove having a floor comprising at least one portion sloping at a non-perpendicular angle to the longitudinal axis of the cutting element and a maximum depth at one of approximately a geometric center point of the cutting face, approximately opposite of the cutting edge at a lateral periphery of the cutting face, and intermediate of the lateral periphery of the cutting face and the geometric center point of the cutting face and a lesser depth at other portions of the at least one groove.

13. The cutting element of claim 10, wherein the one or more grooves include a plurality of grooves, all of the one or more grooves in the cutting face located on a diameter of the cutting face beginning at the lateral periphery of the cutting face, and further including a rib raised above or inset into the cutting face and extending parallel to and along at least one longitudinal side wall of at least a portion of at least one groove of the plurality of grooves.

14. The cutting element of claim 13, wherein the rib comprises material selected from the group consisting of diamond material, polycrystalline diamond material, tungsten carbide material, cubic boron nitride material, leached polycrystalline diamond material, cobalt, and any combinations thereof.

15. A drilling apparatus, comprising:

a body having structure for connection to a drill string;

cutting elements fixedly mounted to the body at an end thereof opposite the structure, at least one cutting element comprising:

a substrate;

a volume of superabrasive material mounted to an end of the substrate and including:

a cutting face comprising at least one planar portion extending in two dimensions generally transverse to a longitudinal axis of the at least one cutting element;

a rear boundary adjacent the substrate;

only one or more grooves in the cutting face, all of the one or more grooves in the cutting face extending along at least a portion of a diameter of the cutting face and having substantially parallel side walls, all of the one or more grooves in the cutting face beginning at a lateral periphery of the cutting face and extending across the at least one planar portion of the cutting face at least as far as a geometric center point of the cutting face; and wherein there are no grooves in the cutting face that do not extend across the at least one planar portion at least as far as the geometric center point of the cutting face.

16. The drilling apparatus of claim 15, wherein the one or more grooves comprise at least one groove having a floor comprising at least one portion sloping toward the geometric center point of the cutting face at a non-perpendicular angle to the longitudinal axis of the cutting element, a maximum depth at approximately a geometric center point of the cutting face and a lesser depth at the lateral periphery of the cutting face.

17. The drilling apparatus of claim 15, wherein the one or more grooves comprise at least one groove having a floor comprising at least one portion sloping at a non-perpendicular angle to the longitudinal axis of the cutting element, a maximum depth at approximately a side of the lateral periphery of the cutting face greater than a depth at the beginning of the at least one groove.

18. The drilling apparatus of claim 15, wherein the one or more grooves comprise at least one groove having a floor comprising at least one portion sloping toward the geometric center point of the cutting face at a non-perpendicular angle to the longitudinal axis of the cutting element, a maximum depth between opposing sides of the lateral periphery of the cutting face and a lesser depth at the opposing sides of the lateral periphery of the cutting face.

19. The drilling apparatus of claim 15, wherein the one or more grooves include a groove extending across an entire diameter of the cutting face.

20. The drilling apparatus of claim 15, wherein the one or more grooves include a plurality of grooves, all of the one or more grooves in the cutting face located on a diameter of the cutting face beginning at the lateral periphery of the cutting face, and further including a rib raised above or inset into the cutting face and extending parallel to and along at least one longitudinal side wall of at least a portion of at least one groove of the plurality of grooves.

21. The drilling apparatus of claim 20, wherein the rib comprises material selected from the group consisting of diamond material, polycrystalline diamond material, tungsten carbide material, cubic boron nitride material, leached polycrystalline diamond material, cobalt, and any combinations thereof.

* * * * *